US009050605B2

(12) United States Patent
Guo

(10) Patent No.: US 9,050,605 B2
(45) Date of Patent: Jun. 9, 2015

(54) GRAPHENE NANOCOMPOSITES

(71) Applicant: Lamar University, Beaumont, TX (US)

(72) Inventor: Zhanhu Guo, Beaumont, TX (US)

(73) Assignee: Lamar University, A Component of the Texas State University System, An Agency of the State of Texas, Beaumont, TX (US)

( * ) Notice: Subject to any disclaimer, the term of this patent is extended or adjusted under 35 U.S.C. 154(b) by 156 days.

(21) Appl. No.: 13/680,464

(22) Filed: Nov. 19, 2012

(65) Prior Publication Data

US 2013/0344237 A1 Dec. 26, 2013

Related U.S. Application Data

(60) Provisional application No. 61/560,955, filed on Nov. 17, 2011, provisional application No. 61/560,961, filed on Nov. 17, 2011.

(51) Int. Cl.

| | |
|---|---|
| ***B03C 1/00*** | (2006.01) |
| ***H01F 1/42*** | (2006.01) |
| *B03C 1/01* | (2006.01) |

(52) U.S. Cl.

CPC ... *B03C 1/00* (2013.01); *B03C 1/01* (2013.01); *H01F 1/42* (2013.01)

(58) Field of Classification Search

CPC . B03C 1/00; B22F 2301/355; B22F 2301/35; B32B 5/16; H01L 31/0352; B82Y 15/00; B82Y 20/00; B82Y 30/00; B82Y 40/00; B82Y 99/00; C02F 1/00; C02F 2101/20; C02F 210/22

USPC ..... 106/31.92, 196.57, 199.1; 252/62.51 R; 427/127, 128, 129, 130, 131, 132, 427/255.29, 255.31, 419.7, 212, 213.32; 525/62.55, 62.56; 977/734; 428/842.4, 428/403, 404, 405; 210/688, 416.3

See application file for complete search history.

(56) References Cited

U.S. PATENT DOCUMENTS

| | | | | |
|---|---|---|---|---|
| 4,280,918 | A | 7/1981 | Homola et al. | |
| 2009/0220767 | A1 * | 9/2009 | Schlogl et al. | 428/323 |
| 2010/0003530 | A1 * | 1/2010 | Ganguli et al. | 428/457 |

OTHER PUBLICATIONS

Abbas, S.M. et al.; Complex permittivity and microwave absorption properties of $BaTiO_3$-polyaniline composite; Mater. Sci. Eng. B, 2005, 123, pp. 167-171.

(Continued)

*Primary Examiner* — Michael Cleveland
*Assistant Examiner* — Tabassom Tadayyon Eslami
(74) *Attorney, Agent, or Firm* — Kelly Kordzik; Jerry Keys; Matheson Keys & Kordzik PLLC

(57) ABSTRACT

A nanocomposite material for use as an electromagnetic wave or radio frequency absorber or as a filter to trap or remove heavy metals. The nanocomposite material may be made with a one-pot synthesis, or thermodecomposition process, of magnetic graphene nanocomposites decorated with core-double-shell nanoparticles, wherein the double shell iron nanoparticles may comprise a crystalline iron core, an inner iron oxide layer around the crystalline iron core, and an outermost amorphous Si—S—O compound shell around the iron oxide layer.

17 Claims, 37 Drawing Sheets

(56) References Cited

OTHER PUBLICATIONS

Aliev, F.G. et al.; Layer-By-Layer Assembly of Core-Shell Magnetite Nanoparticles: Effect of Silica Coating on Interparticle Interactions and Magnetic Properties; Adv. Mater., 1999, 11, pp. 1006-1110.
Al-Saleh, M.H. et al.; a review of vapor grown carbon nanofiber/polymer conductive composites; Carbon 47, 2009, pp. 2-22.
Ang, P.K. et al.; Solution-Gated Epitaxial Graphene as pH Sensor. J. Am. Chem. Soc., 2008, vol. 130, pp. 14392-14393.
Aydin, Y.A. et al.; Adsorption of Chromium on Chitosan: Optimization, Kinetics and Thermodynamics, Chem. Eng. J., 2009, vol. 151, pp. 188-194.
Babes, L.; Synthesis of Iron Oxide Nanoparticles Used as MRI Contrast Agents: A Parametric Study; Journal of Colloid and Interface Science, 212, 1999, pp. 474-482.
Bagayoko, D. et al.; Lattice-parameter dependence of ferromagnetism in bcc and fcc iron; Physical Review B, vol. 28, No. 10, Nov. 15, 1983, pp. 5419-5422.
Barber, P. et al.; Polymer Composite and Nanocomposite Dielectric Materials for Pulse Power Energy Storage; Materials, 2009, 2, pp. 1697-1733.
Brauer, S.L. et al.; Chromium(VI) Forms a Thiolate Complex with Glutathione, J. Am. Chem. Soc., 1991, vol. 113, pp. 3001-3007.
Burke, N. A.D. et al.; Magnetic Nanocomposites: Preparation and Characterization of Polymer-Coated Iron Nanoparticles, Chem. Mater., 2002, vol. 14, pp. 4752-4761.
Cao, J. et al.; Carbon Nanotube/CdS Core-Shell Nanowires Prepared by a Simple Room-Temperature Chemical Reduction Method; Adv. Mater., 2004, 16, No. 1, pp. 84-87.
Chandra, V. et al.; Water-Dispersible Magnetite-Reduced Graphene Oxide Composites for Arsenic Removal, ACS Nano, 2010, vol. 4, pp. 3979-3986.
Che, R.C. et al.; Fabrication and microwave absorption of carbon nanotubes/$CoFe_2O_4$ spinel nanocomposite; Appl. Phys. Lett.; 2006, 88, 033105.
Che, R.C. et al.; Microwave Absorption Enhancement and Complex Permittivity and Permeability of Fe Encapsulated within Carbon Nanotubes; Adv. Mater., 2004, 16, pp. 401-405.
Chen, Y. et al.; Synthesis and Characterization of Polyimide/Silica Hybrid Composites; Chem. Mater., 1999, 11, pp. 1218-1222.
Chen, Y.J. et al.; Synthesis and enhanced ethanol sensing characteristics of $\alpha$-$Fe_2O_3$/$SnO_2$ core-shell nanorods; Nanotechnology 20, 2009, 045502, pp. 1-6.
Chen, Y.J. et al.; Synthesis, magnetic and electromagnetic wave absorption properties of porous $Fe_3O_4$/Fe/$SiO_2$ core/shell nanorods; J. Appl. Phys., 2009, 106, 054303, pp. 1-4.
Chen. Y. et al.; High capacity and excellent cycling stability of single-walled carbon nanotube/$SnO_2$ core-shell structures as Li-insertion materials; Applied Physics Letters 92, pp. 223101-1-223101-3, 2008.
Chen. Y. et al.; Porous $Fe_3O_4$/$SnO_2$ Core/Shell Nanorods: Synthesis and Electromagnetic Properties; J. Phys. Chem C, 2009, 113, pp. 10061-10064.
Chen. Y. et al.; the enhanced ethanol sensing properties of multi-walled carbon nanotubes/$SnO_2$ core/shell nanostructures; Nanotech. nology 17 (2006), pp. 3012-3017.
Chen. Y. et al.; The synthesis and selective gas sensing characteristics of $SnO_2$/$\alpha$-$Fe_2O_3$ hierarchical nanostructures; IOP Publishing, Nanotechnology, 19, 2008, 205603, 5 pages.
Chen. Y.J. et al.; Microwave absorption properties of the ZnO nanowire-polyester composites; Applied Physics Letters, vol. 84, No. 17, Apr. 26, 2004, pp. 3367-3369.
Chiu, S.C. et al.; High Electromagnetic Wave Absorption Performance of Silicon Carbide Nanowires in the Gigahertz Range; J. Phys. Chem C., 2010, 114, pp. 1947-1952.
Cho, S.J. et al.; Growth Mechanisms and Oxidation Resistance of Gold-Coated Iron Nanoparticles, Chem. Mater., 2005, vol. 17, pp. 3181-3186.
Coleman, J.N. et al.; Small but strong: A review of the mechanical properties of carbon nanotube-polymer composites; Carbon 44, 2006, pp. 1624-1652. Available online at www.sciencedirect.com.
Deng, B. et al.; Surface-Catalyzed Chromium(VI) Reduction: Reactivity Comparisons of Different Organic Reductants and Different Oxide Surfaces, Environmental Science & Technology, vol. 30, No. 8, 1996, pp. 2484-2494.
Deng, L. et al.; Microwave absorbing performances of multiwalled carbon nanotube composites with negative permeability; Applied Physics Letters 91, 023119, 2007, 4 pages.
Dupont, L. et al.; Removal of Hexavalent Chromium with a Lignocellulosic Substrate Extracted from Wheat Bran, Environ. Sci. Technol., 2003, vol. 37, pp. 4235-4241.
Duquesne, S. et al.; Elaboration of EVA-nanoclay systems-characterization, thermal behavior and fire performance; Composites Science and Technology, 63, 2003, pp. 1141-1148.
El-Sikaily, A. et al.; Removal of Toxic Chromium from Wastewater Using Green Alga Ulva Lactuca and Its Activated Carbon, Journal of Hazardous Materials 148 (2007), pp. 216-228. Available online at www.sciencedirect.com.
Fan, Z. et al.; Electromagnetic and microwave absorbing properties of multi-walled carbon nanotubes/polymer composites; Materials Science and Engineering B, 132, 2006, pp. 85-89.
Fu, W. et al.; Preparation and characteristics of core-shell structure cobalt/silica nanoparticles; Materials Chemistry and Physics 100, 2006, pp. 246-250.
Fujii T. et al.; In situ XPS analysis of various iron oxide films grown by $NO_2$-assisted molecular-beam epitaxy; Physical Review B, vol. 59, No. 4, Jan. 15, 1999, pp. 3195-3202.
Gardner, M. et al.; Determination of Trace Concentrations of Hexavalent Chromium, Analyst, 2002, vol. 127, pp. 153-156. First published as an Advance Article on the internet, Dec. 11, 2001.
Garg, U.K. et al.; Removal of Hexavalent Chromium from Aqueous Solution by Agricultural Waste Biomass, Journal of Hazardous Materials, 140, 2007, pp. 60-68.
Gee, S.H. et al.; Synthesis and aging effect of spherical magnetite ($Fe_3O_4$) nanoparticles for biosensor applications; Journal of Applied Physics, vol. 93, No. 10, May 15, 2003, pp. 7560-7562.
Goya, G.F. et al.; Static and dynamic magnetic properties of spherical magnetite nanoparticles; Journal of Applied Physics, vol. 94, No. 5, Sep. 1, 2003, pp. 3520-3528.
Graf. C. et al.; A General Method to Coat Colloidal Particles with Silica; Langmuir, 2003,19, pp. 6693-6700.
Guo, J. et al.; Poly(N-isopropylacrylamide)-Coated Luminescent/Magnetic Silica Microspheres: Preparation, Characterization, and Biomedical Applications; Chem. Mater., 2006, 18, pp. 5554-5562.
Guo, X. et al.; Synthesis and microwave absorption of uniform hematite nanoparticles and their core-shell mesoporous silica nanocomposites; Journal of Materials Chemistry, vol. 19, No. 37, Oct. 7, 2009, pp. 6706-6712.
Guo, Z. et al.; Fabrication and characterization of iron oxide nanoparticles reinforced vinyl-ester resin nanocomposites; Composites Science and Technology, 2008, 68, pp. 1513-1520. Available online at www.sciencedirect.com.
Guo, Z. et al.; Fabrication, characterization and microwave properties of polyurethane nanocomposites reinforced with iron oxide and barium titanate nanoparticles; Acta Materialia 57, 2009, pp. 267-277. Available online at www.sciencedirect.com.
Guo, Z. et al.; Facile Monomer Stabilization Approach to Fabricate Iron/Vinyl Ester Resin Nanocomposites, Composites Science and Technology, vol. 68, 2008, pp. 2551-2556.
Guo, Z. et al.; Giant Magnetoresistance Behavior of an Iron/Carbonized Polyurethane Nanocomposite; Applied Physics Letters, vol. 90, pp. 053111-1-053111-3, 2007.
Guo, Z. et al.; Magnetic and electromagnetic evaluation of the magnetic nanoparticle filled polyurethane nanocomposites; Journal of Applied Physics, 2007, 101, pp. 09M511-1-09M511-3.
Guo, Z. et al.; Magnetoresistance and Annealing Behaviors of Particulate Co-Au Nanocomposites; Electrochemical and Solid-State Letters, 10 (12), pp. E31-E35, 2007.
Guo, Z. et al.; Strengthening and thermal stabilization of polyurethane nanocomposites with silicon carbide nanoparticles by a surface-initiated-topolymerization approach; Composites Science and Technology, 2008, 68, pp. 164-170. Available online at www.sciencedirect.com.

(56) References Cited

OTHER PUBLICATIONS

Hafez, A. et al.; Design and Performance of the Two-stage/two-pass RO Membrane System for Chromium Removal from Tannery Wastewater. Part 3, Desalination 165, May 30, 2004, pp. 141-151.
Haijun, Z. et al.; Complex permittivity, permeability, and microwave absorption of Zn- and Ti-substituted barium ferrite by citrate sol-gel process; Materials Science and Engineering B96, 2002, pp. 289-295.
Hasar, H.; Adsorption of Nickel(II) from Aqueous Solution onto Activated Carbon Prepared from Almond Husk, Journal of Hazardous Materials, B97, 2003, vol. 97, pp. 49-57.
Ho, Y.S. et al.; Study of the Sorption of Divalent Metal Ions on to Peat; Adsorpt. Sci. Teclmol., 2000, vol. 18, pp. 639-650.
Hsu, L.C. et al.; Cr(VI) Removal on Fungal Biomass of Neurospora Crassa: The Importance of Dissolved Organic Carbons Derived from the Biomass to Cr(VI) Reduction; Environ. Sci. Technol., 2010, vol. 44, No. 16, pp. 6202-6208.
Hu, F.Q. et al.; Preparation of Biocompatible Magnetite Nanocrystals for In Vivo Magnetic Resonance Detection of Cancer; Adv. Mater., 2006; vol. 18, pp. 2553-2556.
Hu, H. et al.; Ag-Coated $Fe_3O_4$@$SiO_2$; J. Phys. Chem. C, 2010, vol. 114, pp. 7738-7742.
Hu, J. et al.; Removal and Recovery of Cr(VI) from Wastewater by Maghemite Nanoparticles; Water Research (2005), vol. 39, pp. 4528-4536.
Hu, J.S. et al.; Synthesis of Hierarchically Structured Metal Oxides and their Application in Heavy Metal Ion Removal; Adv. Mater., 2008, vol. 20, pp. 2977-2982.
Hu, J.M. et al.; Corrosion electrochemical characteristics of red iron oxide pigmented epoxy coatings on aluminum alloys; Corrosion Science, vol. 47, 2005, pp. 2607-2618. Available online at www.sciencedirect.com.
Huang, W. M. et al.; Thermo-moisture responsive polyurethane shape-memory polymer and composites: a review; Journal of Materials Chemistry; 2010, vol. 20, pp. 3367-3381.
Huh, Y. M. et al.; In Vivo Magnetic Resonance Detection of Cancer by Using Multifunctional Magnetic Nanocrystals; J. Am. Chem. Soc., 2005, vol. 127, pp. 12387-12391.
Imamoglu, M. et al.; Removal of Copper (II) and Lead (II) Ions from Aqueous Solutions by Adsorption on Activated Carbon from a New Precursor Hazelnut Husks; Desalination, vol. 228, 2008, pp. 108-113. Available online at www.sciencedirect.com.
Jagadale et al.; N-Doped $TiO_2$ Nanoparticle Based Visible Light Photocatalyst by Modified Peroxide Sol-Gel Method; J. Phys. Chem. C, 2008, vol. 112, pp. 14595-14602.
Jia C. H. et al.; Large-Scale Synthesis of Single-Crystalline Iron Oxide Magnetic Nanorings; J. Am. Chem. Soc., 2008, vol. 130, pp. 16968-16977.
Juang R.S. et al.; Application of the Elovich Equation to the Kinetics of Metal Sorption with Solvent-Impregnated Resins; Ind. Eng. Chem. Res., 1997, vol. 36, pp. 813-820.
Kadirvelu K. et al.; Activated Carbon from Coconut Coirpith as Metal Adsorbent: Adsorption of Cd(II) from Aqueous Solution; Advances in Environmental Research, vol. 7, 2003, pp. 471-478.
Kim D. W. et al.; Highly Conductive Coaxial $SnO_2$-$In_{2O3}$ Heterostructured Nanowires for Li Ion Battery Electrodes; Nano Letters, 2007, vol. 7, No. 10, pp. 3041-3045.
Kim H. et al.; Graphene/Polyurethane Nanocomposites for Improved Gas Barrier and Electrical Conductivity; Chem. Mater., 2010, vol. 22, pp. 3441-3450.
Kim J. et al.; Multifunctional Uniform Nanoparticles Composed of a Magnetite Nanocrystal Core and a Mesoporous Silica Shell for Magnetic Resonance and Fluorescence Imaging and for Drug Delivery; Angew. Chem., 2008, vol. 120, pp. 8566-8569.
Kirkpatrick, S.; Percolation and Conduction; Reviews of Modern Physics; vol. 45, No. 4, Oct. 1973, pp. 574-588.
Kittel C.; On the Theory of Ferromagnetic Resonance Absorption; Physical Review, vol. 73, No. 2, Jan. 15, 1948, pp. 155-161.
Klanova, J. et al.; Assessing the Influence of Meteorological Parameters on the Performance of Polyurethane Foam-Based Passive Air Samplers; Environ. Sci. Technol., 2008, vol. 42, pp. 550-555.
Kobayashi, Y. et al.; Silica coating of silver nanoparticles using a modified Stöber method; Journal of Colloid Interface Science, vol. 283, 2005, pp. 392-396. Available online at www.sciencedirect.com.
Kong, D. Y. et al.; Sol-Gel Synthesis and Characterization of $Zn_2SiO_4$:Mn@$SiO_2$ Spherical Core-Shell Particles; Journal of the Electrochemical Society, vol. 152 (9), pp. H146-H151 (2005). Available electronically Jul. 28, 2005.
Kongsricharoern, N. et al.; Chromium Removal by a Bipolar Electrochemical Precipitation Process; Wat. Sci. Tech., vol. 34, No. 9, 1996, pp. 109-116.
Krauss, P. R: et al.; Nano-compact disks with 400 Gbit/in$^2$ storage density fabricated using nanoimprint lithography and read with proximal probe; Appl. Phys. Lett. 71 (21), Nov. 24, 1997, pp. 3174-3176.
Kuang. Q. et al.; Tailoring the Optical Property by a Three-Dimensional Epitaxial Heterostructure: A Case of ZnO/$SnO_2$; J. Am. Chem. Soc., 2005; vol. 127, pp. 11777-11784.
Lagarkov, A.N. et al.; Electromagnetic properties of composites containing elongated conducting inclusions; Physical Review B, vol. 53, No. 10, Mar. 1, 1996, pp. 6318-6336.
Lalvani, S. B. et al.; Removal of Hexavalent Chromium and Metal Cations by a Selective and Novel Carbon Adsorbent; Carbon vol. 36, No. 7-8, 1998, pp. 1219-1226.
Lee, C. C. et al.; Ag nanoshell-induced dual-frequency electromagnetic wave absorption of Ni nanoparticles; Applied Physics Letters 90, pp. 193102-1-193102-3, 2007.
Lee, H. et al.; Antibiofouling Polymer-Coated Superparamagnetic Iron Oxide Nanoparticles as Potential Magnetic Resonance Contrast Agents for in Vivo Cancer Imaging; J. Am. Chem. Soc., 2006, 128, pp. 7383-7389.
Li, Y. et al.; Hexavalent Chromium Removal From Aqueous Solution by Adsorption on Aluminum Magnesium Mixed Hydroxide; Water Research, 2009, vol. 43, pp. 3067-3075.
Liang, J. et al.; Molecular-Level Dispersion of Graphene into Poly(vinyl alcohol) and Effective Reinforcement of their Nanocomposites; Adv. Funct. Mater., 2009, vol. 19, pp. 2297-2302.
Lin, C. J. et al.; Design of an Amphiphilic Polymer for Nanoparticle Coating and Functionalization; Small, 2008, vol. 4, No. 3, pp. 334-341.
Lin, Y. et al.; Preparation of highly dispersed $CeO_2$/$TiO_2$ core-shell nanoparticles; Materials Letters, vol. 62, 2008, pp. 3764-3766.
Liu, B. et al.; Ordered Alignment of CdS Nanocrystals on MWCNTs without Surface Modification; Journal of Physical Chemistry B Letters, 2005, 109, pp. 23783-23786.
Liu, J.R. et al.; Enhanced electromagnetic wave absorption properties of Fe nanowires in gigaherz range; Applied Physics Letters, 91, pp. 093101-1-093101-3, 2007.
Liu, X. G. et al.; Microwave-absorption properties of FeCo microspheres self-assembled by $A1_2O_3$ —coated FeCo Nanocapsules; Applied Physics Letters 92, 2008, pp. 243110-1-243110-3.
Liu, X.G. et al.; Microwave-absorption properties of ZnO-coated iron nanocapsules; Applied Physics Letters 92, pp. 173117-1-173117-3, 2008.
Loyaux-Lawniczak, S. et al.; Trapping of Cr by Formation of Ferrihydrite during the Reduction of Chromate Ions by Fe(II)-Fe(III) Hydroxysalt Green Rusts; Environ. Sci. Technol., 2000, vol. 34, No. 3, pp. 438-443.
Lu, Y; Modifying the Surface Properties of Superparamagnetic Iron Oxide Nanoparticles through a Sol-gel Approach; Nano Letters, 2002, vol. 2, No. 3, pp. 183-186.
Lu, Z. et al.; Magnetic Switch of Permeability for Polyelectrolyte Microcapsules Embedded with Co-Au Nanoparticles; Langmuir, 2005, vol. 21, pp. 2042-2050.
McAllister, M. J. et al.; Single Sheet Functionalized Graphene by Oxidation and Thermal Expansion of Graphite; Chem. Mater., 2007, vol. 19, pp. 4396-4404.
McCloskey, K.E.; Magnetic Cell Separation: Characterization of Magnetophoretic Mobility; Anal. Chem., 2003, vol. 75, pp. 6868-6874.

(56) References Cited

OTHER PUBLICATIONS

Melitas, N. et al.; Kinetics of Soluble Chromium Removal from Contaminated Water by Zerovalent Iron Media: Corrosion Inhibition and Passive Oxide Effects; Environ. Sci. Technol., 2001, vol. 35, pp. 3948-3953.
Meng, X. et al.; Treatment of Arsenic in Bangladesh Well Water Using a Household Co-Precipitation and Filtration System; Water Res. vol. 35, No. 12, 2001, pp. 2805-2810.
Miles, P. A. et al.; Dielectric Spectroscopy of Ferromagnetic Semiconductors; Reviews of Modern Physics, vol. 29, No. 3, Jul. 1957, pp. 279-307.
Miltenyi, S.; High Gradient Magnetic Cel Separation With MACS[1]; Cytometry, 1990, vol. 11, pp. 231-238.
Mishra, P. C. et al.; Removal of Lead and Zinc Ions from Water by Low Cost Adsorbents; Journal of Hazardous Materials, vol. 168, 2009, pp. 319-325.
Modrzejewska, Z. et al.; Separation of Cr(VI) on Chitosan Membranes; Ind. Eng. Chem. Res., 1999, vol. 38, pp. 4946-4950.
Mohan, D. et al.; Removal of Hexavalent Chromium from Aqueous Solution Using Low-Cost Activated Carbons Derived from Agricultural Waste Materials and Activated Carbon Fabric Cloth; Ind. Eng. Chem. Res., 2005, vol. 44, pp. 1027-1042.
Monser, L.; et al.; Modified Activated Carbon for the Removal of Copper, Zinc, Chromium and Cyanide from Wastewater; Separation and Purification Technology, vol. 26, 2002, pp. 137-146.
Nemr, A. E.; Potential of Pomegranate Husk Carbon for Cr(VI) Removal From Wastewater: Kinetic and Isotherm Studies. J. Hazard. Mater., 2009, vol. 161, pp. 132-141.
Ni, S. B. et al.; Designed Synthesis of Wide Range Microwave Absorption $Fe_3O_4$; Journal of Alloys and Compounds, vol. 489, 2010, pp. 252-256.
Ni, S. B. et al.; Hydrothermal synthesis and microwave absorption properties of $Fe_3O_4$ nanocrystals; J. Phys. D: App. Phys; vol. 42, 2009, 055004, pp. 1-5.
Ni, X. et al.; Silica Coated Iron Nanocubes; Journal of Colloid and Interface Science, vol. 341, 2010, pp. 18-22.
Nicolson, A M. et al.; Broad-Band Microwave Transmission Characteristics from a Single Measurement of the Transient Response; IEEE; Transactions on Instrumentation and Measurement, vol. 17, Nov. 4, Dec. 1968, pp. 395-402.
Nicolson, A M. et al.; Measurement of the Intrinsic Properties of Materials by Time-Domain Techniques; IEEE; Transactions on Instrumentation and Measurement; vol. IM-19, No. 4, Nov. 1970, pp. 377-382.
Nooney, R. I. et al.; Self-Assembly of Mesoporous Nanoscale Silica/Gold Composites; Langmuir, 2003, vol. 19, pp. 7628-7637.
Oliveira, L. C. A. et al.; Activated Carbon/Iron Oxide Magnetic Composites for the Adsorption of Contaminants in Water; Carbon, vol. 40, 2002, pp. 2177-2183.
Paliwoda-Porebska, G et al.; Oh the development of polypyrrole coatings with self-healing properties for iron corrosion protection; Corrosion Science, vol. 47, 2005, pp. 3216-3233.
Parsons, J. G. et al.; An XAS Study of the Binding of Copper(II), Zinc(II), Chromium(III) and Chromium(VI) to Hops Biomass; Microchemical Journal, vol. 71, 2002, pp. 211-219.
Pastoriza-Santos, I. et al.; Silica-Coating and Hydrophobation of CTAB—Stabilized Gold Nanorods; Chem. Mater., 2006, 18, pp. 2465-2467.
Pellegrino, T. et al.; Hydrophobic Nanocrystals Coated with an Amphiphilic Polymer Shell: A General Route to Water Soluble Nanocrystals; Nano Letters, vol. 4, No. 4, 2004, pp. 703-707.
Pillay, K. et al.; Multi-walled Carbon Nanotubes as Adsorbents for the Removal of Parts Per Billion Levels of Hexavalent Chromium from Aqueous Solution; Journal of Hazardous Materials, vol. 166, 2009, pp. 1067-1075.
Ponder, S. M. et al.; Remediation of Cr(VI) and Pb(II) Aqueous Solutions Using Supported, Nanoscale Zero-valent Iron; Environ. Sci. Technol., 2000, vol. 34, pp. 2564-2569.
Powell, R. M. et al.; Coupled Iron Corrosion and Chromate Reduction: Mechanisms for Subsurface Remediation; Environ. Sci. Technol., 1995, vol. 29, pp. 1913-1922.
Rengaraj, S. et al.; Kinetics of Removal of Chromium from Water and Electronic Process Wastewater by Ion Exchange Resins: 1200H, 1500H and IRN97H; Journal of Hazardous Materials; B102,2003, pp. 257-275.
Santra, S. et al.; Synthesis and Characterization of Silica-Coated Iron Oxide Nanoparticles in Microelmusion: The Effect of Nonionic Surfactants; Langmuir, 2001, 17, pp. 2900-2906.
Sawalha, M. F. et al.; Determination of Adsorption and Speciation of Chromium Species by Saltbush (Atriplex Canescens) Biomass Using a Combination of XAS and ICP-OES; Microchemical Journal, 2005, vol. 81, pp. 122-132. Available online at www.sciencedirect.com.
Sharma, Y. C. et al.; Removal of Chromium by Riverbed Sand From Water and Wastewater Effect of Important Parameters; Journal of Hazardous Materials vol. 151, 2008, pp. 789-793. Available online at www.sciencedirect.com.
Shin, S. et al.; Thiol Containing Polymer Encapsulated Magnetic Nanoparticles as Reusable and Efficiently Separable Adsorbent for Heavy Metal Ions. Chem. Comm., 2007, vol. 41, pp. 4230-4232.
Singh, P. et al.; Microwave Absorption studies of Ca-NiTi hexaferrite composites in X-band; Materials Science and Engineering, B78, 2000, pp. 70-74.
Skumryev, V. et al.; Beating the Superparamagnetic Limit with Exchange Bias; Nature, vol. 423, Jun. 19, 2003, pp. 850-853.
Stumm, W. et al.; Aquatic Chemistry; Chemical Equilibria and Rates in Natural Waters; Third Edition; A Wiley-Interscience Publication, John Wiley & Sons, Inc., Oct. 1995 (list of contents only provided).
Suns, X.C. et al.; Microstructure and Magnetic Properties of Fe(C) and Fe(0) Nanoparticles; Nano Letters, 2002, vol. 2, No. 7, pp. 765-769.
Suslick, K. S. et al.; Sonochemical Synthesis of Iron Colloids; J. Am. Chem. Soc., 1996, vol. 118, pp. 11960-11961.
Tang, J. K. et al.; Magnetic Properties of Nanocrystalline Fe304 Films; Journal of Applied Physics, vol. 89, 2001, pp. 7690-7692.
Tartaj, P. et al.; Synthesis of Monodisperse Superparamagnetic Fe/Silica Nanospherical Composites; J. Am. Chem. Soc., 2003, 125, pp. 15754-15755.
Toneguzzo, P. et al.; Monodisperse Ferromagnetic Particles for Microwave Applications; Adv. Mater., 1998, vol. 10, No. 13, pp. 1032-1035.
Truchaud, A. et al.; New trends for automation in immunoassays; Pure & Appi. Chem., vol. 63, No. 8, 1991, pp. 1123-1126.
Vaughan Jr, R. L. et al.; Modeling As(V) Removal by a Iron Oxide Impregnated Activated Carbon Using the Surface Complexation Approach; Water Research vol. 39, 2005, pp. 1005-1014.
Venkatesan, M. et al.; Enhanced Magnetoresistance in Nanocrystalline Magnetite; Journal of Applied Physics, vol. 93, No. 10, May 15, 2003, pp. 8023-8025.
Verwey, E.J.W.; Effect of Tube-Length on the Visibility of Dust Particles with an Oil-Immersion Objective; Nature Publishing Group, Aug. 19, 1939; No. 3642, pp. 327-328.
Wadhawan, A. et al.; Nanoparticle-assisted microwave absorption by single-wall carbon nanotubes; Appl. Phys. Lett., vol. 83, No. 13, Sep. 29, 2003, pp. 2683-2685.
Wang, F. et al.; Template free synthesis and electromagnetic wave absorption properties of monodispersed hollow magnetite nanospheres; J. Mater. Chem., 2011, 21, pp. 4314-4320.
Wang, G. et al., Note Preparation of Iron Particles Coated with Silica; Journal of Colloid and Interface Science, vol. 217, 1999, pp. 203-207.
Wang, S. Y. et al.; Effects of Manufacturing Conditions on the Adsorption Capacity of Heavy Metal Ions by Makino Bamboo Charcoal; Bioresource Technology, 99, 2008, pp. 7027-7033. Available online at www.sciencedirect.com.
Wang, X. et al.; A General Strategy for Nanocrystal Synthesis; Nature, 2005, vol. 437, Sep. 1, 2005, pp. 121-124.
Watts, P.C.P. et al.; High Permittivity from Defective Multiwalled Carbon Nanotubes in the X-Band; Adv. Mater., vol. 15, No. 7-8, Apr. 17, 2003, pp. 600-603.
Weckhuysen, B. M. et al.; Surface Chemistry and Spectroscopy of Chromium in Inorganic Oxides; Chem. Rev., 1996, vol. 96, pp. 3327-3349.

(56) References Cited

OTHER PUBLICATIONS

Westervelt, R. M.; Graphene Nanoelectronics; Science, vol. 320, Apr. 18, 2008, pp. 324-325.
Wood, J.H.; Energy Bands in Iron via the Augmented Plane Wave Method; Physical Review, vol. 126, No. 2, pp. 517-527, Apr. 15, 1962.
Wu, M. Z. et al.; Microwave magnetic properties of $Co_{50}/(SiO_2)_{50}$ nanoparticles; Applied Physics Letters, vol. 80, No. 23, Jun. 10, 2002, pp. 4404-4406.
Xu, Y. et al.; Reductive Immobilization of Chromate in Water and Soil Using Stabilized Iron Nanoparticles; Water Research vol. 41, 2007, pp. 2101-2108.
Xu, Z. et al.; In situ Polymerization Approach to Graphene-Reinforced Nylon-6 Composites; Macromolecules, 2010, vol. 43, pp. 6716-6723.
Yang, J. K. et al.; Removal of Cu(II) by Activated Carbon Impregnated with Iron(III); Colloids and Surfaces A: Physiochem. Eng. Aspects vol. 337, 2009, pp. 154-158.
Yang, Y. et al.; Microwave absorption studies of W-hexaferrite prepared by co-precipitation/mechanical milling; Journal of Magnetism and Magnetic Materials, vol. 265, 2003, pp. 119-122. Available online at www.sciencedirect.com.
Yang, Y. et al.; Novel Carbon Nanotube-Polystyrene Foam Composites for Electromagnetic Interference Shielding; Nano Letters, 2005, vol. 5, No. 11, pp. 2131-2134.
Yin, Y. et al.; Silver Nanowires Can Be Directly Coated with Amorphous Silica to Generate Well-Controlled Coaxial Nanocables of Silver/Silica; Nano Letters, 2002, vol. 2, No. 4, pp. 427-430.
Yong, V. et al.; Monodisperse SiC/vinyl ester nanocomposites: Dispersant formulation, synthesis, and characterization; J. Mater. Res., vol. 24, No. 4, Apr. 2009, pp. 1553-1558.
Yoshida, S. et al.; Permeability and electromagnetic-interference characteristics of Fe-Si-A alloy flakes-polymer composite; Journal of Applied Physics, vol. 85, No. 8, Apr. 15, 1999, pp. 4636-4638.
Yue, L. et al.; Colloids Seeded Deposition: Growth of Titania Nanotubes in Solution; J. Am. Chem. Soc., 2006; vol. 128, pp. 11042-11043.
Zaini, M. A. A. et al.; Adsorption of Aqueous Metal Ions on Cattle-manure-compost Based Activated Carbons; Journal of Hazardous Materials, vol. 170, 2009, pp. 1119-1124.
Zhang, D. et al.; Carbon-stabilized Iron Nanoparticles for Enviromnental Remediation; Nanoscale, 2010, vol. 2, pp. 917-919.
Zhang, D. F. et al.; Heirarchical Assembly of $SnO_2$ Nanorod Arrays on $\alpha$-$Fe_2O_3$ Nanotubes: A Case of Interfacial Lattice Compatibility; J. Am. Chem. Soc., 2005, vol. 127, pp. 13492-13493.
Zhang, W. X.; Nanoscale Iron Particles for Enviromnental Remediation: An Overview; Journal of Nanoparticle Research, vol. 5, 2003, pp. 323-332.
Zhang, X. F. et al.; Microstructure and microwave absorption properties of carbon-coated iron nanocapsules; J. Phys. D: Appl. Phys. vol. 40, 2007, pp. 5383-5387.
Zhang, X. F. et al.; Microwave Absorption Properties of the Carbon-Coated Nickel Nanocapsules; Applied Physics Letters, vol. 89, pp. 053115-1-053115-3, 2006.
Zhao, Y. et al.; Kinetin Increases Chromium Absorption, Modulates Its Distribution, and Changes the Activity of Catalase and Ascorbate Peroxidase in Mexican Palo Verde; Environ. Sci. Technol., 2011, vol. 45, pp. 1082-1087.
Zhou, R. F. et al.; Multistep Synthesis, Growth Mechanism, Optical, and Microwave Absorption Properties of ZnO Dendritic Nanostructures; J. Phys. Chem. C, 2008, vol. 112, pp. 11767-11775.
Zhu, et al.; $Fe_3O_4/TiO_2$ Core/Shell Nanotubes: Synthesis and Magnetic and Electromagnetic Wave Absorption Characteristics; J. Phys. Chem. C.; vol. 114, pp. 16229-16235. Published on internet Sep. 9, 2010.
Zhu, J. et al., Magnetic field induced capacitance enhancement in graphene and magnetic graphene nanocomposites, Energy Environ. Sci., 2012, xx, pp. 1-12.
Zhu, J. et al., Magnetic graphene nancomposites: electron conduction, giant magnetoresistance and tunable negative permittivity, J. Mater. Chem. 2012, vol. 12, pp. 835-844. Published on internet Oct. 28, 2011.
Zhu, J. et al., Studies on the Mechanism by Which the Formation of Nanocomposites Enhances Thermal Stability; Chem. Mater., 2001, vol. 13, pp. 4649-4654.
Zhu, J. et al.; Comprehensive and sustainable recycling of polymer nanocomposites; J. Mat. Chem., 2011, vol. 21, pp. 16239-16246.
Zhu, J. et al.; Conductive Polypyrrole/Tungsten Oxide Metacomposites with Negative Permittivity; J. Phys. Chem. C; 2010, vol. 114, pp. 16335-16342. Published on internet Sep. 10, 2010.
Zhu, J. et al.; Electromagnetic Field Shielding Polyurethane Nanocomposites Reinforced with Core-Shell Fe-Silica Nanoparticles; Journal of Physical Chemistry C, 2011, vol. 115, pp. 15304-15310.
Zhu, J. et al.; Enhanced Electrical Switching and Electrochromic Properties of Poly(p-phenylenebenzobisthiazole) Thin Films Embedded with Nano-$WO_3$; Adv. Funct. Mater., 2010, vol. 20, pp. 3076-3084.
Zhu, J. et al.; In situ stabilized carbon nanofiber (CNF) reinforced epoxy nanocomposites; J. Mater. Chem., 2010, vol. 20, pp. 4937-4948.
Zhu, J. et al.; Magnetic Epoxy Resin Nanocomposites Reinforced with Core-Shell Structured Fe@FeO Nanoparticles: Fabrication and Property Analysis; ACS Applied Materials & Interfaces, vol. 2, No. 7, 2010, pp. 2100-2107. Published on internet Jul. 1, 2010.
Zhu, J. et al.; One-pot synthesis of Magnetic Graphene Nanocomposites Decorated with Core@Double-shell Nanoparticles for Fast Chromium Removal; Environ. Sci. Technol., 2012, vol. 46, pp. 977-985.
Zhu, J. et al.; Polyaniline-tungsten oxide metacomposites with tunable electronic properties; J. Mater. Chem., 2011, vol. 21, pp. 342-348.
Zhu, J. et al.; Silica Stabilized Iron Particles Toward Anti-corrosion Magnetic Polyurethane Nanocomposites; RSC Advances, 2012, vol. 2, pp. 1136-1143.
Zhu, J. et al.; Surfactant-Free Synthesized Magnetic Polypropylene Nanocomposites: Rheological, Electrical, Magnetic, and Thermal Properties; Macromolecules, 2011, vol. 44, pp. 4382-4391.
Azough et al., "The Relationship Between the Microstructure and Microwave Dielectric Properties of Ziconium Titanate Ceramics," J. Mater. Sci., 1996, vol. 31, pp. 2539-2549, May 15, 1996.
Gu et al., "Magnetic polyaniline nanocomposites toward toxic hexavalent chromium removal," RSC Adv., 2012, vol. 2, pp. 11007-11018, Sep. 17, 2012.
Hu et al.; Synthesis of Hierarchically Structured Metal Oxides and their Application in Heavy Metal Ion Removal; Adv. Mater., 2008, vol. 20, pp. 2977-2982.
Jardine et al., "Fate and Transport of Hexavalent Chromium in Undisturbed Heterogeneous Soil," Environ. Sci. Technol., 1999, vol. 33, pp. 2939-2944, Jul. 29, 1999.
Lee et al., "Microwave Properties of Graphite Nanoplatelet/Epoxy Composites," J. Appl. Phys., 2008, vol. 104, pp. 033705-1-033705-7, Aug. 1, 2008.
Lu et al., "Large low field magnetoresistance in ultrathin nanocrystalline magnetite $Fe_3O_4$ films at room temperature," Appl. Phys. Lett., 2007, vol. 91, pp. 102508-1-102508-3, Sep. 7, 2007.
Michielssen et al., "Design of lightweight, broad-band microwave absorbers using genetic algorithms," IEEE Trans., 1993, vol. 41, No. 6/7, pp. 1024-1030, Jun./Jul. 1993.
Ohmori et al., "Preparation and properties of uniform coated colloidal particles," Colloid Interface Sci., May 1992, vol. 150, issue 2, pp. 594-598.
Pansini et al., "Chromium removal from water by ion exchange using zeolite,"Desalination, 1991, vol. 83, issues 1-3, pp. 145-157, Sep. 1991.
Ramanathan et al., "Beyond Carbon Nanotubes: Functionalized Graphene Sheets for Polymer Nanocomposites," Nature Publishing Group, 2008, vol. 3, pp. 1-14, Mar. 27, 2008.
Ramanathan et al., "Functionalized graphene sheets for polymer nanocomposites," Nature, 2008, vol. 1481, No. 1898, pp. 327-331, May 11, 2008.

(56) References Cited

OTHER PUBLICATIONS

Reardon, "Anaerobic Corrosion of Granular Iron: Measurement and Interpretation of Hydrogen Evolution Rates," Environ. Sci. Technol., 1995, vol. 29, No. 12, pp. 2936-2945, Dec. 1995.

Rengaraj et al., "Removal of Chromium from Water and Wastewater by Ion Exchange Resins," J. Hazard. Mater., 2001, vol. 87, issues 1-3, pp. 273-287, Sep. 13,2001.

Santra et al., "Synthesis and Characterization of Silica-Coated Iron Oxide Nanoparticles in Microemulsion: The Effect of Nonionic Surfactants," Langmuir, 2001, vol. 17, No. 10, pp. 2900-2906, Apr. 19, 2001.

Snoek, "Dispersion and absorption in magnetic ferrites at frequencies above one Mc/s," Physica, vol. 14, No. 4, pp. 207-217, May 1948.

Srivastava et al., "Adsorption of Heavy Metal Ions on Carbonaceous Material Developed from the Waste Slurry Generated in Local Fertilizer Plants," Water Res., vol. 23, issue 9, pp. 1161-1165, Sep. 1989.

Stöber et al., "Controlled Growth of Monodisperse Silica Spheres in the Micron Size Range," J. Colloid and Interface Science, vol. 26, No. 1, pp. 62-69, Jan. 1968.

Tartaj et al., "Synthesis of Monodisperse Superparamagnetic Fe/Silica Nanospherical Composites," J. Am. Chem. Soc., 2003, vol. 125, pp. 15754-15755, Nov. 26, 2003.

Tu et al., "1-(2-Formamidoethyl)-3-phenylurea Functionalized Activated Carbon for Selective Solid-phase Extraction and Preconcentration of Metal Ions," Anal. Chim. Acta, 2009, vol. 649, pp. 252-257, Jul. 21, 2009.

Walz, "The Verway transition—a topical review," J. Phys. Condens. Matter, 2002, vol. 14, pp. R258-R340, Mar. 15, 2002.

Wang et al., "The electromagnetic property of chemically reduced graphene oxide and its application as microwave absorbing material," Appl. Phys. Lett., 2011, vol. 98, pp. 072906-1-072906-3, Feb. 18, 2011.

Wei et al., "Electropolymerized Polyaniline Stabilized Tungsten Oxide Nanocomposite Films: Electrochromic Behavior and Electrochemical Energy Storage," J. Phys. Chem. C, 2012, vol. 116, No. 47, pp. 25052-25064, Nov. 1, 2012.

Wei et al., "Multifunctional composite core-shell nanoparticles," Nanoscale, 2011, vol. 3, pp. 4474-4502, Oct. 7, 2011.

Zhang et al., "Magnetic and Magnetoresistance Behaviors of Solvent Extracted Particulate Iron/Polyacrylonitrile Nanocomposites," J. Phys. Chem. C, 2009, vol. 114, pp. 212-219, Nov. 9, 2009.

* cited by examiner (19A)

(19B)

(19C)

GRAPHENE NANOCOMPOSITES

This application claims priority to U.S. provisional patent application Ser. Nos. 61/560,955 and 61/560,961, which are hereby incorporated by reference herein.

TECHNICAL FIELD

The present invention relates to a nanocomposite material including nanoparticles on a graphene substrate.

BACKGROUND AND SUMMARY

Aspects of the present invention relate to a nanocomposite (also referred to herein as a "composite") material for use as an electromagnetic ("EM") wave or radio frequency ("RF") (e.g., microwave) absorber or as a filter to trap or remove heavy metals. In aspects of the present invention, a method has been created for a one-pot synthesis (e.g., thermodecomposition process) of magnetic graphene nanocomposites decorated with core-double-shell nanoparticles ("MGNCs"), which can be used for removal of heavy metals, such as chromium. Additional information is included in Jiahua Zhu et al., "One-pot synthesis of Magnetic Graphene Nanocomposites Decorated with Core-Double-shell Nanoparticles for Fast Chromium Removal." High-resolution transmission electron microscopy and energy filtered elemental mapping reveal a core-double-shell structure of the nanoparticles (e.g., with crystalline iron as the core, iron oxide as an inner shell, and an amorphous Si—S—O compound as an outer shell).

The MGNCs demonstrate an extremely fast heavy metal (e.g., chromium (e.g., Cr(VI))) removal (e.g., from wastewater or water) with a high removal efficiency and with an almost complete removal within at least 5 minutes. The adsorption kinetics follows a pseudo-second-order model, and the novel MGNCs exhibit greatly enhanced heavy metal removal efficiency in solutions with low pH. The large saturation magnetization (e.g., 96.3 emu/g) of the synthesized nanoparticles allows fast separation of the MGNCs from the liquid suspension. By using a permanent magnet, for example, the recycling process of both the MGNC adsorbents and the adsorbed heavy metals may be more energetically and/or economically sustainable. The significantly reduced treatment time required to remove the heavy metals and the applicability in treating the solutions with low pH make such MGNCs promising for the efficient removal of heavy metals from water or wastewater.

Aspects of the invention feature a composition (also referred to herein as a "composite structure" or a "composite material") that includes a substrate (e.g., graphene), which graphene may be in sheet form or may be in a very small platelet form. This substrate is coated with (or "decorated," i.e., sparsely covered with) nanoparticles. These nanoparticles may comprise a core of either iron (Fe), nickel (Ni), or cobalt (Co), which is surrounded by at least one shell comprising a material containing silicon and/or sulfur. A thermodecomposition method may be used to produce the metal nanoparticles, which are adhered to the graphene surface. Such a "decorated" graphene substrate may be loaded into a polymeric matrix and formed as needed (e.g., a spray coating, laminate, thin film, honeycomb, foam, etc.). By such a method, a composite structure may be obtained, rather than merely a single piece of graphene powder.

According to aspects of the present invention, such composite materials provide at least two highly useful properties, namely (1) the composite material strongly absorbs RF radiation over a wide frequency range; and/or (2) the composite material efficiently adsorbs heavy metals.

Aspects of the present invention provide a nanocomposite material that may be used in a variety of forms (e.g., bulk material, film, coating, etc.) either as a shield from electromagnetic radiation and/or as an absorber of RF radiation. In aspects of the present invention, methods have been created for making electromagnetic field shielding polyurethane nanocomposites reinforced with core-shell Fe-silica nanoparticles. An aspect of the invention features a composition that includes two-component particles with diameters in a range of nanometers to microns. These components comprise a core made of either iron (Fe), cobalt (Co), or nickel (Ni) surrounded by a shell composed of silica ($SiO_2$) or zirconia ($ZrO_2$) dispersed at high loadings (e.g., greater than 60 wt % of the composite), either randomly or in an aligned fashion. The composition may further include a polymer matrix of polyurethane or any other thermoplastic or thermoset polymeric material.

In a silica coating process that may be used in aspects of the present invention, iron particles (e.g., carbonyl iron particles "CIP," e.g., 3.0 g) may be dispersed in a solvent (e.g., 120 mL ethanol) containing 3-aminopropyltriethoxysilane ("APTES," e.g., 0.4 mL at room temperature). After mixing (e.g., 30 minutes of sonication), the obtained suspension may be allowed to age (e.g., for 1 hour) to arrive at a complete complexation reaction between the amine groups of APTES and the CIP surface. Gelatin B (e.g., 1 wt %, 20 mL solution) may be also used to functionalize the CIP surface, which may have a primer effect on the final shell morphology. The CIP may be coated with a layer of silica (e.g., by a modified Stöber process). The suspension may be vigorously mechanically stirred (e.g., 500 rpm). Different amounts of tetraethyl orthosilicate ("TEOS," e.g., 1.8-5 mL) and ammonia (e.g., 12-16 mL) may be used in the reaction system to control the silica shell thickness. TEOS may be injected into the suspension and followed by an addition of ammonia (e.g., dropwise for about 5 minutes ("min")). The reaction may be continued (e.g., for 5 hours) and then the powders separated from the mother liquid (e.g., using a magnet). The powders may be washed (e.g., with ethanol and DI water several times) and then dried (e.g., in a vacuum oven overnight at room temperature) to obtain core-shell CIP-silica particles (also referred to herein as "CIP-silica"). A final annealing of the CIP-silica may be performed (e.g., at 650° C. for 2 hours under $H_2$/Ar atmosphere (hydrogen ratio: 5%)), with an aim to complete the reaction from TEOS to silica and reduce the iron oxides.

Polymer nanocomposites in accordance with aspects of the present invention may be synthesized as follows. The CIP (e.g., 7.0 g) may be initially mixed with a diluted mixture solution containing an accelerator part A (e.g., 0.36 g), a catalyst part C (e.g., 0.40 g), and THF (e.g., 20.0 mL), followed by mixing (e.g., 1 hour sonication at room temperature) to allow the adsorption of the accelerator part A and the catalyst part C on the CIP surface. Then a monomer part B (e.g., 2.24 g) may be added to the suspension and mechanically stirred together (e.g., at 200 rpm in an ultrasonic bath for one hour at 50° C.). The suspension becomes more viscous as the reaction proceeded. The viscous suspension may be transferred into a mold (e.g., and maintained at room temperature for an additional 7 days) to further the reaction and solvent evaporation. Composites with the same loading of CIP-silica (e.g., shell thickness: 55 nm) may be fabricated following similar procedures. A CIP-silica/PU composite thin film (e.g., thickness: ~10 μm) on glass slide may be prepared from the THF-diluted composite solution (e.g., by using a drop casting method).

The composite may then be fabricated into a variety of forms as dictated by the application (e.g., a composite part, a coating, a skin or laminate, or any other form into which polymeric materials can be formed). The shape can be easily controlled because the processing starts from a liquid and because the curing does not require any special heat treatment. Such materials exhibit high RF absorption over a wide range of frequencies (MHz to GHz regions), which properties can be controlled by virtue of the properties of the nanoparticle fillers. For example, the specific microwave absorption properties may be tailored by varying the size and/or composition of the particles, and/or the composition and thickness of the matrix.

With respect to RF adsorption, currently available materials for RF absorption typically either exhibit high RF adsorption over a narrow frequency range, or they exhibit relatively low absorption over a broad frequency range. In contrast, the composite material in accordance with aspects of the present invention is an easily moldable and processable material, which exhibits high RF absorption over a broad frequency range. Some aspects of the present invention exhibit high RF absorption over a broad frequency range between about 10 Hz and about $10^6$ Hz. Some aspects of the present invention exhibit high RF absorption over a broad frequency range between about 1 Hz to about 20 GHz. At a high RF absorption, radiation will be prevented or significantly reduced to generally acceptable levels.

Commercial applications utilizing this RF absorption property include shielding for electronics, low observable materials (e.g., reduction of detectability via radar) for defense applications (e.g., airplanes, missiles, and ships), and electronic components. For example, refer to FIG. 33 showing electromagnetic shielding from an EM source 3301 in which the composites of the present invention are molded into a polymeric matrix to form the packaging 3302 for inhibiting the EM waves from escaping from the product 3300, such as a cell phone. Aspects of the present invention are generally much lighter materials that can enhance microwave absorption performance with an intensified absorption and a broad absorption wave gap.

Additional information on the foregoing is included in Jiahua Zhu et al., "Electromagnetic Field Shielding Polyurethane Nanocomposites Reinforced with Core-Shell Fe Silica Nanoparticles," J. Phys. Chem. C, 2011, 115, 11304-15310 (published Jul. 5, 2011), and Jiahua Zhu et al., "Silica Stabilized Iron Particles toward Anti-corrosion Magnetic Polyurethane Nanocomposites," (2011).

Background information is included in Chun-Ling Zhu et al., "$Fe_3O_4/TiO_2$ Core/Shell Nanotubes: Synthesis and Magnetic and Electromagnetic Wave Absorption Characteristics," J. Phys. Chem. C, 2010, 114, 16229-16235 (published online Sep. 9, 2010).

With respect to chemical filtering (or trapping) of heavy metals, currently, activated carbon is the material most commonly used for filtering of heavy metals. Aspects of the present invention adsorb a greater quantity and/or percentage of such much more heavy metals than such activated carbon. Furthermore, aspects of the present invention implemented in a polymeric matrix are also more easily formable and more durable than activated carbon. Commercial applications utilizing the absorbance property include filtering of fluids (e.g., water) containing heavy metals for environmental remediation or for industrial processes.

In aspects of the present invention, carbonyl iron particles ("CIP") may be coated with silica by using both gelatin and 3-aminopropyltriethoxysilane ("APTES") as primers to promote the deposition and adhesion of silica on the CAP surface. The silica shell thickness may be controlled through adjusting the concentrations of tetraethyl orthosilicate ("TEOS") and ammonia. Polyurethane nanocomposites filled with either bare magnetic CIP or silica-coated CIP may be fabricated with a surface-initialized polymerization ("SIP") method.

The examples provided herein are to more fully illustrate some of the aspects of the present invention. It should be appreciated by those of skill in the art that the techniques disclosed in the examples which follow represent techniques discovered by the inventors to function well in the practice of the invention, and thus can be considered to constitute exemplary modes for its practice. However, those of skill in the art should, in light of the present disclosure, appreciate that many changes can be made in the specific aspects that are disclosed and still obtain a like or similar result without departing from the spirit and scope of the invention.

All patents and publications referenced herein are hereby incorporated by reference herein. It will be understood that certain of the herein described structures, functions, and operations of the aspects are not necessary to practice the present invention and are included in the description simply for completeness of an exemplary embodiment or aspects. In addition, it will be understood that specific structures, functions, and operations set forth in the referenced patents and publications can be practiced in conjunction with the aspects of the present invention, but they are not essential to its practice. It is therefore to be understood that aspects disclosed herein may be practiced otherwise than as specifically described without actually departing from the spirit and scope of the present invention as defined by the appended claims. Furthermore, specific parameters are provided herein, such as quantities, temperatures, etc., but it should be understood that aspects of the invention are not limited to these exact parameter values, but may be approximate and still enable such aspects of the invention.

BRIEF DESCRIPTION OF THE DRAWINGS

FIG. 1(*a*) shows the nanoparticles are uniformly distributed on the graphene sheet (inset shows the particle size distribution with an average size of 22 nm). FIG. 1(*b*) is an enlarged magnification of the image in FIG. 1(*a*) showing the core-shell structure of the nanoparticles independent of the particle size (top inset shows the core-double-shell structure of one nanoparticle). FIG. 1(*c*) shows a HRTEM of a single particle showing an iron core surrounded by a double shell structure, where the top-left inset gives a closer view on the lattice fringes of inner shell showing an interlayer distance of 2.52 Å corresponding to the (311) plane of iron oxide, and the bottom right inset gives a closer view on the lattice fringes of the core showing an interlayer distance of 2.03 Å corresponding to (110) plane of iron (the characteristic interlaminar spacing of graphite 3.40 Å is marked at the upright corner). FIG. 1(*d*) shows a selected area electron diffraction (SAED) pattern of the core-shell nanoparticles.

DETAILED DESCRIPTION

Figure 1:
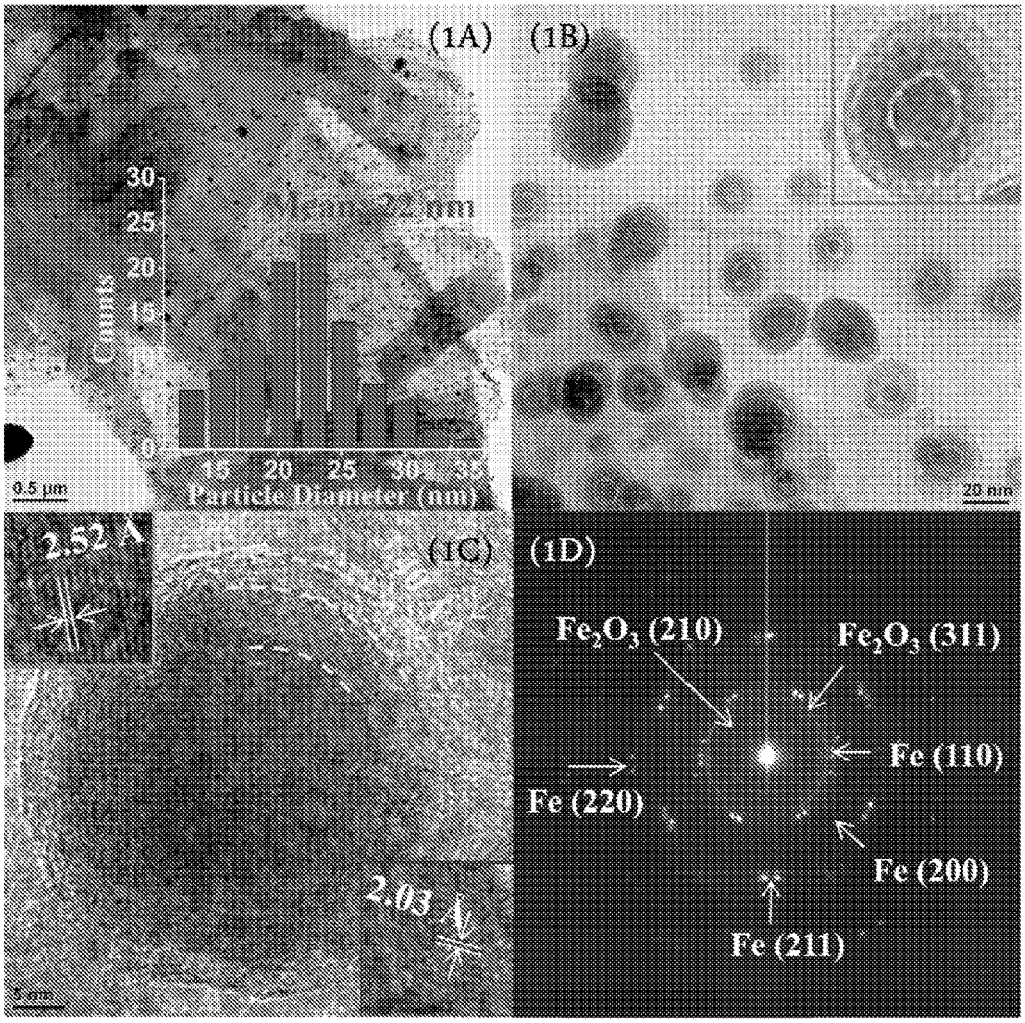
FIG. 1 shows TEM images of MGNCs with a nanoparticle loading of 10 wt %.

Rapid industrialization has led to an increase in discharged wastewater containing heavy metals (e.g., Cr, Cd, Hg, Pb, and As), which have detrimental effects on the environment and human health. Among those heavy metal species, Cr(VI) (chromium) is a commonly identified contaminant because of its high toxicity and mobility.[1] The maximum permissible limit of the total Cr in drinking water has been recommended as 100 μg/L by the U.S. Environmental Protection Agency ("EPA").[2] With better awareness of these problems, a number of technologies to remove Cr(VI) have been developed, including cyanide treatrnent,[3] electro-chemical precipitation,[4] reverse osmosis ("RO").[5, 6] ion exchange ("IE")[7, 8] and adsorption.[9-16] However, chlorination of cyanides can result in highly toxic intermediate and other toxic organochlorines. These compounds together with residual chlorine create additional environmental problems. Precipitation is considered to be the most applicable and economical approach. However, this technique produces a large amount of precipitate sludge that requires additional process for the further treatment. Though RO can effectively reduce metal ions, but its applications are limited by a number of disadvantages such as high operational cost and limited pH range.[6] IE is a convenient method to treat the wastewater containing chromium ions, but only limited literatures have been reported on the removal of Cr(III).[7, 8, 17] Operation cost is also higher than that of the other methods.[5] In addition to the aforementioned technologies, Cr(VI) reduction by zero-valence Fe,[18] Fe(II),[19, 20] atomic hydrogen,[21, 22] dissolved organic compounds[23] and reduced sulfur compounds[24] has been developed and the removal capacity is satisfactory with an extended treating time. However, separating and recycling these materials turn out to be a challenge especially when the particle size goes down to nanoscale and thus reducing the operation time in each cycle is urgently required in modern industry. Consequently, adsorption is an alternative favorable and feasible approach because of its low cost and high efficiency.[9-13, 25-28] Besides, adsorption can effectively remove heavy metals present in the wastewater at low concentrations.[27, 29] Though activated carbon is one of the adsorbents to purify polluted water,[29-31] it still fails to reduce the concentration of contaminants at ppb levels.[32] Iron minerals have been recognized as an effective media to remove various heavy metals such as As(III) and As(V),[33] Cr(VI)[12] and Pd(II).[34] More recently, iron and iron oxide nanostructures have been proved as higher efficient materials for the heavy metal removal by reduction or adsroption.[35-37] However, there are two major challenges when using these nanomaterials. One comes from the easy oxidation/dissolution of the pure Fe nanoparticles (nanoparticles), especially in acidic solutions. The other is the difficulty to recycle these nanoparticles with such a small size, especially in a continuous flowing system. To protect the magnetic nanoparticles against oxidation, a shell structure is often introduced, including silica,[38-43] polymer,[34, 41, 42] carbon[9] and noble metals.[43, 44] And to overcome the latter challenge and to prevent the side pollutants of the released nanomaterials, researchers are trying to embed these nanoparticles into an easily separable substrate, the most typical substrate is carbon due to its low cost and high specific surface area.[45, 46]

Graphene and graphene oxide have shown many applications in nanoelectronics,[47] sensors[48] and structural composite materials,[49] With a large dimension in XY plane reaching several micrometers and extremely thin thickness (nanometer) in Z-axis, graphene has large specific surface area and possesses great advantages to be a perfect platform for fixing nanoparticles. Though magnetic carbon nanocomposites with large specific surface area enhanced the heavy metal removal and a magnet facilitated the recycling of the nanoparticles with a reported 95% removal rate,[9] a 2-hour treatment was required. Furthermore, there are few reports on the fabrication of magnetic graphene nanocomposites (MGNCs), especially those with great potential to be used in environmental remediation with fast treatment. Herein disclosed is a facile one-pot thermodecomposition process developed to synthesize magnetic graphene nanocomposites decorated with core-double-shell crystalline nanoparticles, which may comprise a crystalline iron core, iron oxide inner shell, and amorphous Si—S—O compound outer shell. The magnetic nanoparticles benefiting from the double-shell structure may be uniformly mono-dispersed on the graphene sheet and are stable against oxidation/dissolution in HCl acid (1 M). The structure and magnetic properties of the magnetic graphene nanocomposites were investigated by transmission electron microscopy ("TEM"), energy filtered TEM for elemental mapping, and 9-T physical properties measurement system ("PPMS"). The effects of the treatment time, adsorbent loading, and pH values on the Cr(VI) removal were investigated for the prepared magnetic graphene nanocomposites and compared with those of pure graphene. The adsorption kinetics were also investigated by fitting the experimental data with different models and the removal mechanism proposed. The magnetic graphene nanocomposites were found to possess unique capability to remove heavy metals (e.g., chromium) very quickly and efficiently from wastewater.

An exemplary aspect of the present invention utilized the following materials. Graphene (e.g., N006-010-P, XY: ≤14 μm, Z: <40 nm) was commercially obtained from Angstron Materials Inc. Sodium dodecylbenzenesulfonate ("SDBS") may be used as a surfactant during preparation of graphene. Iron(0) pentacarbonyl ($Fe(CO)_5$, 99%) and dimethylformamide ("DMF," 99%) were commercially obtained from Sigma Aldrich. Potassium dichromate ($K_2Cr_2O_7$, 99%) and 1,5-diphenyl carbazide ("DPC") were commercially obtained from Alfa Aesar Company. O-phosphoric acid ($H_3PO_4$, 85 wt %) was commercially obtained from Fisher Scientific.

An exemplary aspect of the present invention utilized the following methods. The magnetic graphene nanocomposites may be fabricated using a one-pot thermodecomposition method (also further described below with respect to FIG. 3). For example, graphene (e.g., 1.0 g) may be dispersed in a solvent, such as DMF (e.g., 100.0 mL) (e.g., using ultrasonication for 30 minutes at room temperature). And then $Fe(CO)_5$ (e.g., 0.385 g) may be injected into the graphene suspended DMF solution (DMF and $Fe(CO)_5$ are intermiscible). The suspension may be heated to a boiling temperature (e.g., ~153° C.) and refluxed (e.g., for additional 4 hours). The solid products may then be removed from the suspension (e.g., using a permanent magnet). The residue solution was transparent, indicating that $Fe(CO)_5$ has been completely decomposed (otherwise the solution would be yellow). The collected solid residues may be dried (e.g., vacuum oven for 24 hours) and then annealed (e.g., at 500° C. for 2 hours in an $H_2$/Ar atmosphere (e.g., 5% hydrogen balanced with argon)) for further characterization and testing for removal of heavy metals.

The potassium dichromate solution containing (e.g., 1000 μg/L) chromium was treated with graphene and magnetic graphene nanocomposites. Briefly, the chromium solution was mixed with a pre-determined amount of graphene and magnetic graphene nanocomposites to the concentrations of graphene (e.g., 0.25, 1.0, 2.0, 2.5, and 3.0 g $L^{-1}$) and magnetic graphene nanocomposites (e.g., 0.25, 0.5, 1.0, 2.0, 2.5, and 3.0 g $L^{-1}$). The mixture was stirred (e.g., under ultrasonication at room temperature for 5 minutes). Then, graphene and magnetic graphene nanocomposites were separated from the solutions (e.g., by centrifuging in a centrifuge (e.g., Fisher Scientific, Centrific 228)). Magnetic graphene nanocomposites may also be separated from the solutions by using a permanent magnet and achieve similar analytical results. The clear solutions were then collected and subjected to colorimetric analysis to determine the final chromium concentrations. For the kinetic study, the magnetic graphene nanocomposites concentration was maintained at 1 g $L^{-1}$ in the neutral solution for different adsorption times, such as 5, 10, 15, 25, and 50 minutes. The pH study was conducted at different pH values from 1 to 11 (the pH value may be adjusted by adding hydrochloric acid or sodium hydroxide solutions). For colorimetric analysis,[50] the aforementioned clear solutions (e.g., 5.25 mL) may be taken into test tubes, with o-phosphoric acid (e.g., 0.50 mL, 4.5 M) and DPC (e.g., 0.25 mL, 5 g $L^{-1}$) added. After incubated (e.g., at room temperature for 30 minutes) for color development, the absorbance of the samples was measured (e.g., in a UV-vis spectrophotometer (e.g., Cary 50)). Peaks with varied intensities were observed in the spectrometer scans at 540 nm wavelength depending on the concentrations of the remaining Cr(VI) in the samples.

Characterizations: The morphology of the magnetic graphene nanocomposites was characterized (e.g., by a transmission electron microscopy (TEM, FEI Tecnai $G^2$ F20) with a field emission gun, operated at an accelerating voltage of 200 kV). The TEM samples were prepared (e.g., by drying a drop of magnetic graphene nanocomposites/ethanol suspension on carbon-coated copper TEM grids).

The powder XRD analysis of the samples was carried out with a Bruker AXS D8 Discover diffractometer with GADDS (General Area Detector Diffraction System) operating with a Cu—Ka radiation source filtered with a graphite monochromator (λ=1.5406 Å). The magnetic property of the magnetic graphene nanocomposites at room temperature was measured in a 9 T physical properties measurement system (PPMS) by Quantum Design.

Brunauer-Emmett-Teller (BET) was used to measure the specific surface area of the pure graphene and magnetic graphene nanocomposites. BET adsorption and desorption isotherms were obtained using a surface area analyzer (NOVA 1000 Series, Quantachrome). The solid sample to be analyzed was weighed and placed inside the sample holder cell of a known volume. The used refrigerant was liquid nitrogen placed in a vacuum Dewar at about 77 K and the carrier gas was $N_2$ (ultra high purity grade, Airgas).

The thermal degradation of graphene and magnetic graphene nanocomposites was studied with a thermo-gravimetric analysis (TGA, TA instruments Q-500) from 25 to 900° C. with an air flow rate of 60 ml/min in and a heating rate of 10° C./min.

Microstructure Investigation: Two aspects about the fabrication of the nanocomposites, which is helpful for better understanding the unique properties of this material. One concerns the particle size distribution and dispersion quality in the matrix, and the other concerns the specific component of the as-fabricated nanoparticles. For the core-shell nanoparticles, the identification of the core and shell components may be performed. To address these concerns, both high-resolution TEM ("HRTEM") and selected area electron diffraction ("SAED") techniques were utilized.

FIG. 1(*a*) shows the TEM image, depicting that the magnetic nanoparticles have grown on the graphene sheet with a narrow size distribution and uniform dispersion. An exemplary particle size is in a range of 10-35 nm (average: 22 nm), as shown with the graph in the inset of FIG. 1(*a*). The graphene showing a folding nature is clearly visible, and the relatively dark area in FIG. 1(*a*) is due to the stacking of several graphene sheets. FIG. 1(*b*) shows an enlarged image of some of the nanoparticles, and it is interesting to observe that the nanoparticles show a core-shell structure and the shell is homogeneous on each individual nanoparticle, regardless of the original size and morphology. As a result, the shape of each nanoparticle is maintained after the shell formation. This phenomenon is more obvious from the observations in FIG. 2, where square and triangle-shaped iron nanoparticles are coated by the same shaped coating materials. As shown in the FIG. 1(*b*) inset of an enlarged image of a single nanoparticle, the core exhibits dark contrast, the inner shell light contrast, and the outer shell even lighter. The bright ring surrounding the core is the Fresnel fringe[51] caused by a larger defocus to enhance the contrast. FIG. 1(*c*) shows a HRTEM image of a core-shell structured single nanoparticle, taken at near Scherzer defocus condition:[51]

$$\Delta f_{Sch}=-\sqrt{4C_S\lambda/3}=-81.8\text{ nm}$$

where $C_s$ and $\lambda$ are the spherical aberration coefficient and electron wavelength at 200 kV, respectively, so that the Frenel fringe is not present. The nanoparticle is observed to comprise a core and at least one or more shells (e.g., a crystalline inner shell and amorphous outer shell). To identify the crystalline structure and specific component of the core and inner shell material, an enlarged HRTEM image is taken from the core and inner shell, as seen in the bottom and top insets of FIG. 1(*c*), respectively. A lattice fringe of 2.03 Å calculated for the core corresponds to the (110) plane of Fe, while the calculated lattice fringe of 2.52 Å for the inner shell corresponds to the (311) plane of $Fe_2O_3$. The XRD results are in good agreement with the HRTEM observations. Referring to FIG. 1(*c*), the lattice fringe of 3.40 Å on the right upper corner indicates a characteristic interlaminar spacing of graphite.[52] However, the wrinkled structure is probably caused by the stress induced by the attached nanoparticles. The SAED patterns in FIG. 1(*d*) show the crystalline planes of the Fe core (110, 200, 211 and 220) and $Fe_2O_3$ shell (210 and 311), which are consistent with the HRTEM observations. Due to the amorphous nature of the outer shell, it is difficult to identify the specific component from HRTEM and SAED.

Figure 2:
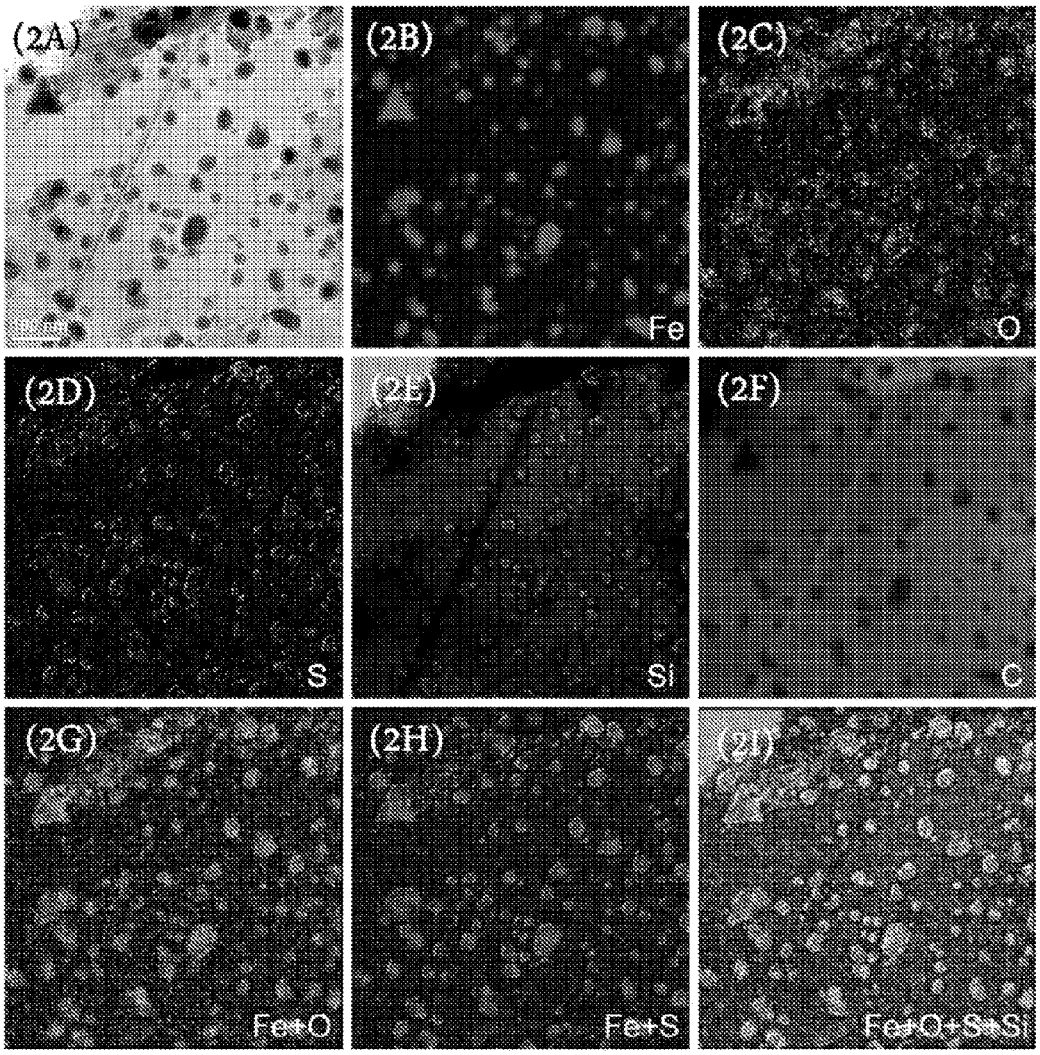
FIG. 2 shows EFTEM of the MGNCs (*a*) zero-loss image, (*b*) Fe map, (*c*) O map, (*d*) S map, (*e*) Si map, (*f*) C map, (*g*) Fe+O map, (*h*) Fe+S map and (*i*) Fe+O+S+Si map.

Referring to FIGS. 2(*a*)-(*i*), energy-filtered TEM ("EFTEM") was conducted on the sample to further clarify the specific component of the core-double-shell structure, especially the outer shell. The zero loss image is shown in FIG. 2(*a*). Elemental maps are shown with iron in FIG. 2(*b*), oxygen shown in FIG. 2(*c*), sulfur shown in FIG. 2(*d*), silica shown in FIG. 2(*e*), and carbon shown in FIG. 2(*f*). The EFTEM mapping provides a 2-dimensional elemental distribution. A brighter area in the elemental map indicates a higher concentration of the corresponding element in that area. They may be shown in different colors for the purpose to identify their positions within the nanoparticles. FIG. 2(*b*) depicts the iron map showing the bright iron core with mostly spherical shaped together with some triangle- and square-shaped nanostructures. However, the oxygen map of FIG. 2(*c*) shows circular shapes with wide thickness. Summation of Fe and O maps yields FIG. 2(*g*), where it is seen that the oxygen areas occupy the Fe outside as well as their peripheral areas, indicating the core areas have low O but the inner shell as Fe and O. With regard to the sulfur mapping in FIG. 2(*d*), the bright circles with narrow thickness reveal that the sulfur element distributes at the outside of the nanoparticles. The summation of Fe and S maps results of FIG. 2(*h*) clearly shows S being on the surface of the nanoparticles. Si is also noticed on the outer shell, which is similar to the sulfur mapping, as well as on the graphene sheet shown in FIG. 2(*e*). The summation of Fe, O, S, and Si gives the elemental distribution in FIG. 2(*i*). Carbon mapping in FIG. 2(*f*) shows the dark nanoparticles decorated in the bright graphene substrate. There are no shinning spots on the nanoparticles, indicating that the carbon element is not involved in the shell structure formation. All these results confirm an iron core covered with a crystalline iron oxide inner shell and an amorphous outer shell made of sulfur and silicon elements.

Figure 3:
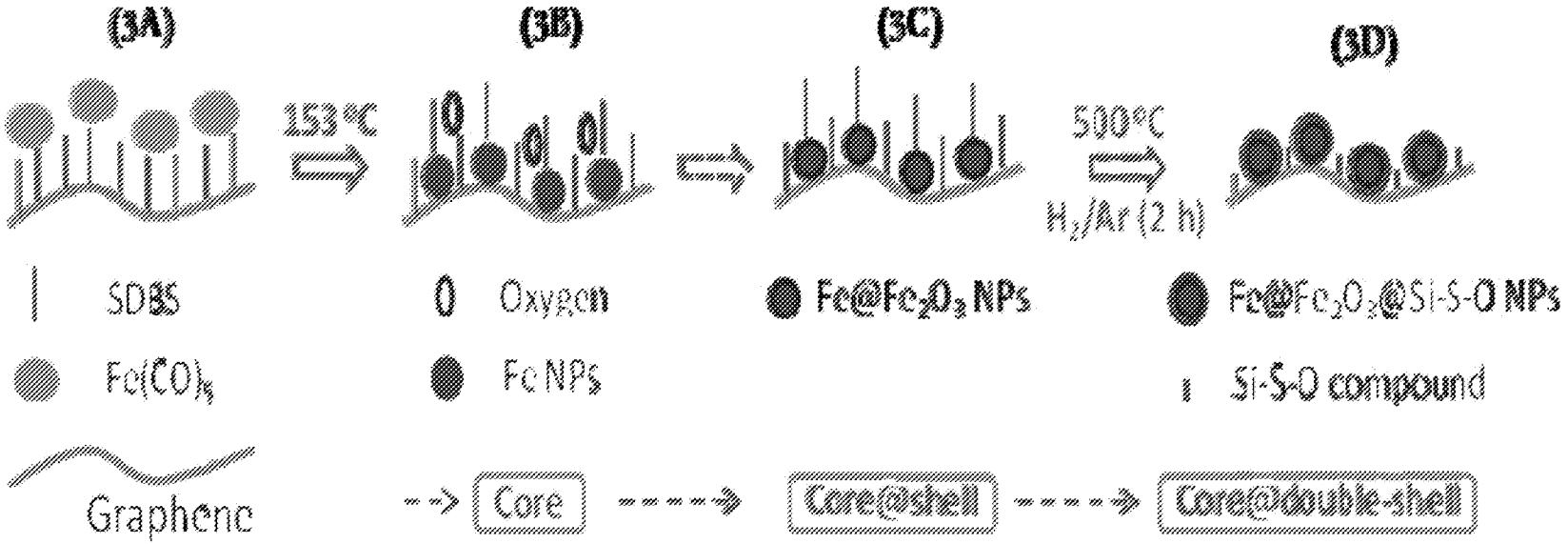
FIG. 3 is a schematic illustration of formation of MGNCs in accordance with embodiments of the present invention.

FIG. 3 depicts a formation mechanism of the magnetic graphene nanocomposites according to aspects of the present invention. As shown in steps (a)-(c), during the magnetic graphene nanocomposites synthesis, the iron precursor was transformed to iron nanoparticles and adhered on the graphene sheet, which are partially oxidized from the outer surface due to the existence of residue oxygen in the solution. Meanwhile, the dissipated SDBS in the solution was assembled on the nanoparticle surface. After an annealing process (e.g., at 500° C. for 2 hours under $H_2$(5%)/Ar atmosphere), the organics including the benzene and alkyl chains were removed, and the S and O remained, as shown in step (d). The slight amount of silicon detected on the graphene and particle surface comes from the impurity of the graphene precursor. In this case, it is beneficial since the silicon containing compounds on the outer shell have been demonstrated to protect the iron core from corrosion (e.g., in 1 M HCl acid).

Figure 4:
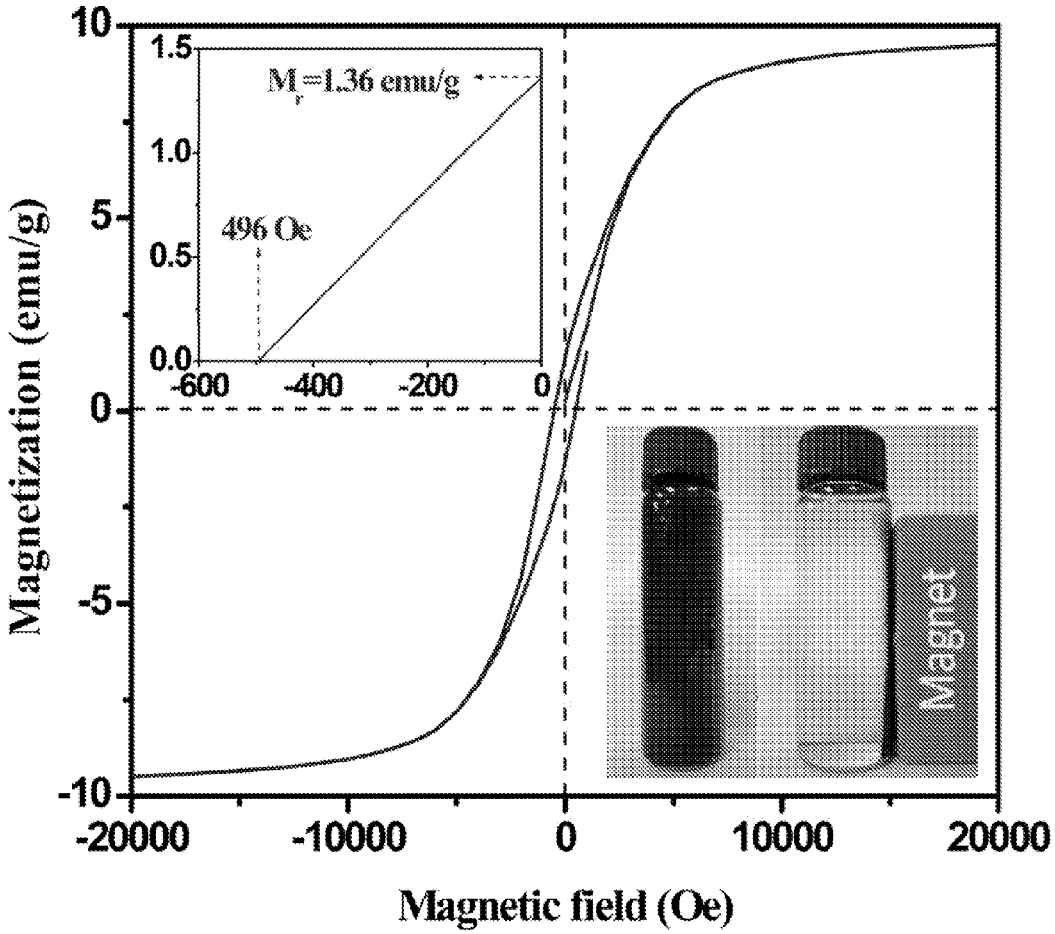
FIG. 4 shows a room temperature hysteresis loop of the MGNCs, wherein a top inset shows the enlarged partial curve, and a bottom inset shows the MGNCs dispersed in acid and magnetic separation (the MGNCs are tested to be stable over a 4-hour immersion in 1 M HCl).

Exemplary Magnetic Properties: FIG. 4 shows a room temperature hysteresis loop of the magnetic graphene nanocomposites. The initial particle loading was calculated as 10 wt % iron based on the total weight of graphene sheet and iron. However, the calculated iron loading from TGA was 9.87 wt %, indicating a 98.7% conversion of the iron precursor to nanoparticles due to the evaporation of some $Fe(CO)_5$ during refluxing.

The saturated magnetization ($M_s$) of the magnetic graphene nanocomposites is 9.50 emu/g, corresponding to a calculated $M_s$ of 96.3 emu/g for the nanoparticles, which is lower than that of the bulk Fe (222 emu/g)[53, 54] due to the large number of the oxidized atoms around the iron core. The coercivity (coercive force, $H_c$) is observed to be 496.0 Oe in the formed core-double-shell nanoparticles, which is significantly larger than that of the bare Fe nanoparticles (5.0 Oe) with a comparable size.[55, 56] This observation indicates that the nanoparticles become much harder (e.g., ferromagnetic state at room temperature) after they are decorated on the graphene sheet. The observed large $H_c$ is due to the decreased interparticle dipolar interaction arising from the increased interparticle distance as compared to the close contact of pure iron nanoparticles, and also due to the interfacial exchange coupling[57] between the ferromagnetic core and antiferromagnetic iron oxide shell.[58] There were no bubbles observed from the immersion of the magnetic graphene nanocomposites in the 1 M HCl solution, indicating that the shell has effectively protected the iron core from oxidation/dissolution. The magnetic graphene nanocomposites show a tendency to be attracted by a permanent magnet and the black suspended aqueous solution turns transparent within seconds when it is placed nearby, as shown in the bottom insert of FIG. 4. This property shows exemplary convenient recycling of these magnetic graphene nanocomposites.

Figure 5A:
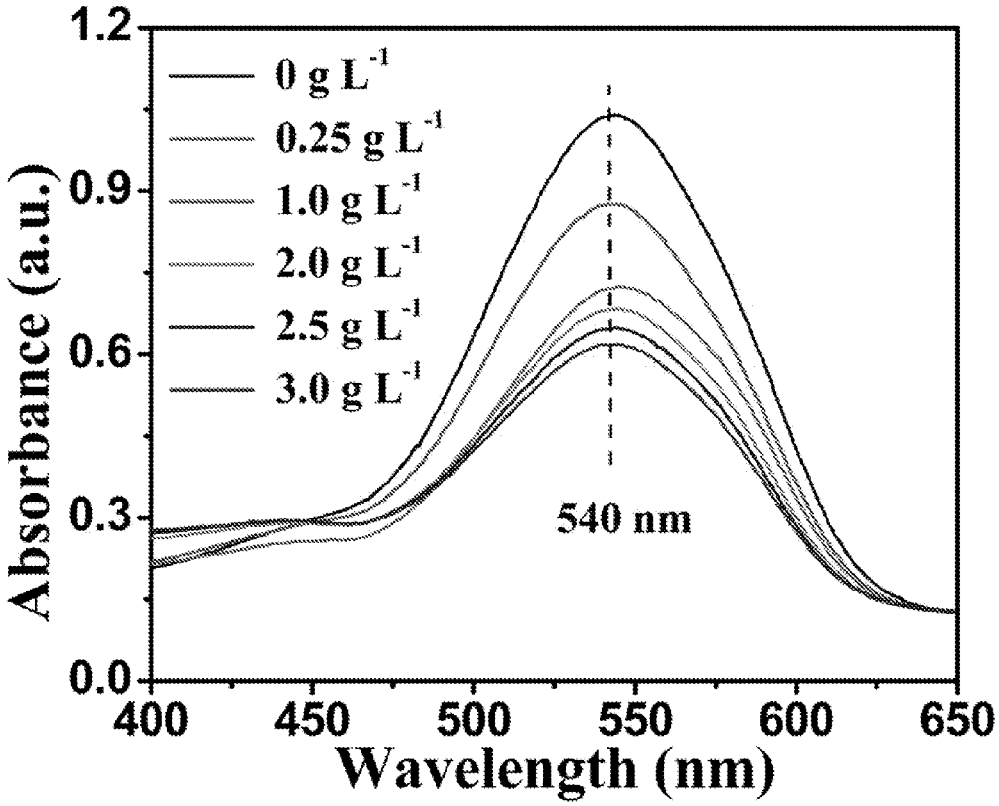
FIG. 5 shows UV-vis absorption of the solutions after treated with (*a*) different loadings of graphene (Gra), (*b*) different loadings of magnetic graphene nanocomposites, and (*c*) Cr(VI) removal percentage based on different loadings of Gra and magnetic graphene nanocomposites.
Figure 5B:
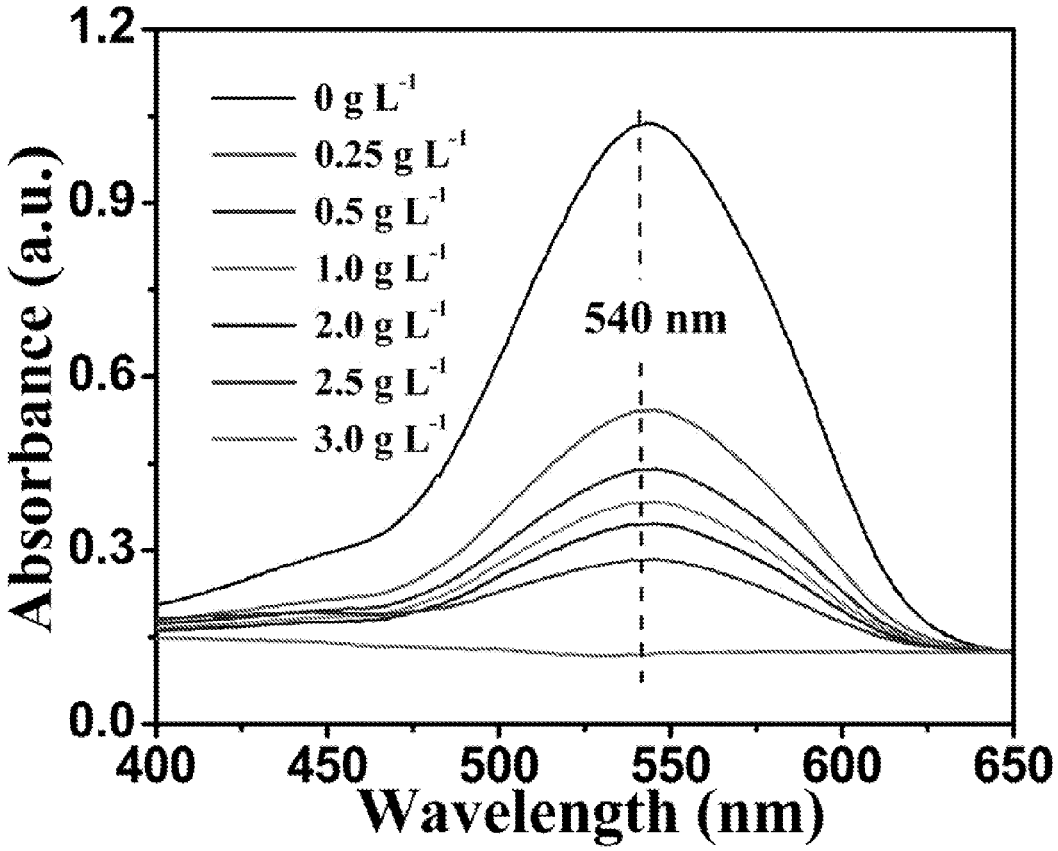
Figure 5C:
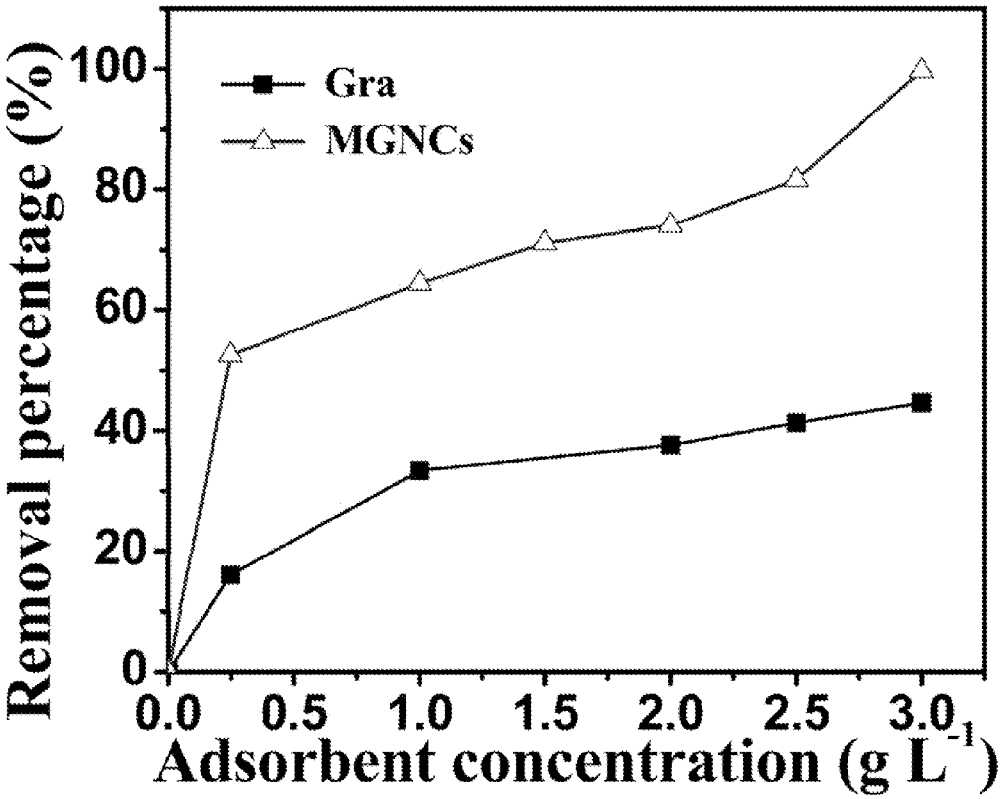

Exemplary Heavy Metal (e.g., Chromium) Removal: Iron minerals have been demonstrated to be an effective adsorbent to remove hazardous materials from wastewater.[59] The magnetic graphene nanocomposites were used to remove Cr(VI), and pure graphene was also studied for comparison. FIGS. 5(*a*)-(*c*) show the UV-vis absorption of a 1000 μg $L^{-1}$ Cr(VI) solution and the solutions after treatment with graphene (20 mg) and magnetic graphene nanocomposites (5, 10, and 20 mg) (e.g., in ultrasonication for 5 minutes). The quantification of Cr(VI) in the solution is performed using a colorimetric method. The Cr(VI) shows a characteristic peak at 540 nm in the UV-vis absorption curve. The higher the Cr(VI) concentration in the solution, the stronger peak intensity was observed. The solution with Cr(VI) concentration of 1000 μg/L shows the strongest absorbance of 1.04, which is consistent with the standard curve after subtracting the absorbance at 540 nm (0.12) of the base solution comprising the same volume of DI water, phosphoric acid and DPC. After treated with different concentrations of graphene (see FIG. 5(*a*)) and magnetic graphene nanocomposites (see FIG. 5(*b*)) (0~3 g $L^{-1}$) under ultrasonication for 5 minutes, the peak intensity decreased gradually with increasing the adsorbent concentration indicating the reduced Cr(VI) amount in the solution. The Cr(VI) removal percentage treated by different concentrations of graphene and magnetic graphene nanocomposites is shown in FIG. 5(*c*). The pure graphene (see FIG. 5(*a*)) shows much lower removal efficiency than that of the magnetic graphene nanocomposites (see FIG. 5(*b*)), only 44.6% of the Cr(VI) is removed from the solution even with the highest testing concentration of 3 g $L^{-1}$. However, the magnetic graphene nanocomposites exhibit a much higher removal efficiency in that 52.6% of the Cr(VI) is removed with a much lower magnetic graphene nanocomposites concentration of 0.25 g $L^{-1}$. The Cr(VI) removal is increased by about 100% in the magnetic graphene nanocomposites decorated with the 10% nanoparticle loading. Thus, the Cr(VI) can be completely removed while using (e.g., 20 mg) magnetic graphene nanocomposites (e.g., within at least approximately 5 minutes) (indicated in FIG. 5(*b*) where the peak at 540 nm has been flattened).

Figure 36:
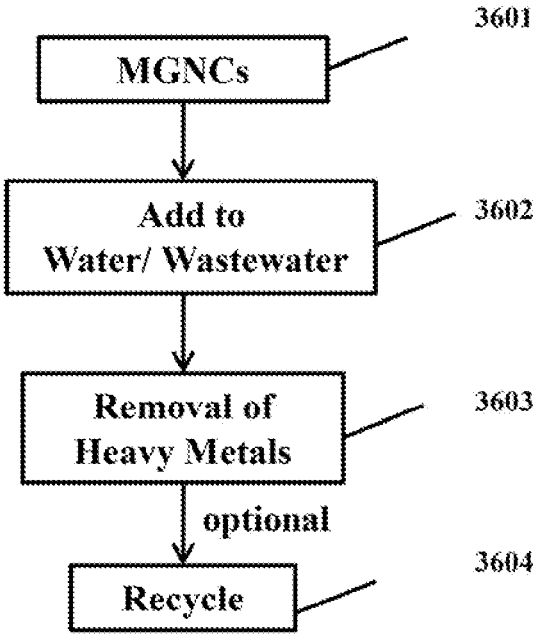
FIG. 36 shows a process for heavy metal remediation.

FIG. 36 shows a typical process for utilizing embodiments of the present invention for heavy metal remediation. The MGNCs 3601 are added to the water/wastewater site in step 3602, in which the MGNCs adsorb the heavy metals, such as chromium, in step 3603, and the solution is retrieved. Optionally, in step 3604, the recycling of the MGNCs may be performed with techniques described herein and their equivalents.

Figure 6:
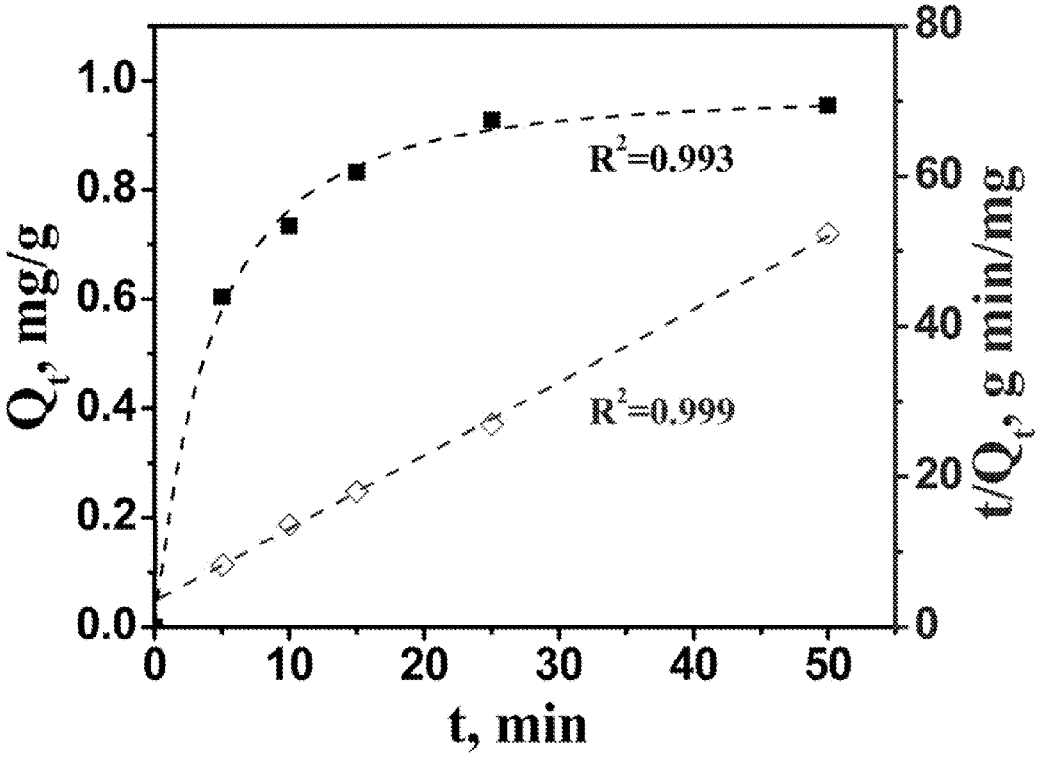
FIG. 6 shows Kinetic adsorption data plots of Cr(VI) by magnetic graphene nanocomposites: Cr(VI) removal rate Qt vs. time t (square line) and the transformed rate plot t/Qt vs. t (triangle line).

The kinetics of the adsorption describing the Cr(VI) uptake rate is a characteristic that control the residence time of adsorbate uptake at the solid-liquid interface. Hence, in this example, the kinetics of Cr(VI) removal was carried out to understand the adsorption behavior of the prepared magnetic graphene nanocomposites. FIG. 6 shows the Cr(VI) adsorption data over magnetic graphene nanocomposites at different time intervals. Quantifying the changes in adsorption with time requires an appropriate kinetic model, and pseudo-first-order,[60] pseudo-second-order,[61] Elovich[62, 63] and intraparticle diffusion[64] kinetic models are investigated and compared. To evaluate the suitability of different models, the correlation coefficient ($R^2$, close or equal to 1) is introduced. The higher $R^2$ value indicates a more applicable model to the kinetics of Cr(VI) adsorption. The fitting results obtained from different models are summarized in Table 1.

TABLE 1

| Models | Equation | Parameters | | | $R^2$ |
|---|---|---|---|---|---|
| psuedo-first-order[60] | $\log(Q_e - Q_t) = \log Q_e - \frac{k_1}{2.303}t$ | $k_1$ ($min^{-1}$) 0.18 | $Q_e$ (mg $g^{-1}$) 0.93 | | 0.898 |
| psuedo-second-order[61] | $\frac{t}{Q_t} = \frac{1}{k_{ad}Q_e^2} + \frac{t}{Q_e}$ | $k_{ad}$ (g $mg^{-1}$ $min^{-1}$) 0.28 | $Q_e$ (mg $g^{-1}$) 1.03 | h (mg $g^{-1}$ $min^{-1}$) 0.29 | 0.999 |
| Elovich[62, 63] | $Q_t = \frac{1}{\beta}\ln(\alpha\beta) + \frac{1}{\beta}\ln(t)$ | α (mg $g^{-1}$ $min^{-1}$) 1.63 | β (g $mg^{-1}$) 6.25 | | 0.881 |
| intraparticle diffusion[64] | $Q_t = k_{dif}t^{0.5} + C$ | $k_{dif}$ (mg $g^{-1}$ $min^{-0.5}$) 0.07 | C (mg $g^{-1}$) 0.51 | | 0.672 |

$Q_t$ is the solid-phase loading of Cr(VI) in the adsorbent at time t, $Q_e$ is the adsorption capacity at equilibrium, $k_1$ is the rate constant of pseudo-first-order adsorption. In the pseudo-second-order model, $k_{ad}$ is the rate constant of adsorption, and h is the initial adsorption rate at t approaching zero, $h=k_{ad}Q_e^2$. α and β represent the initial adsorption rate and desorption constant in the Elovich model. $K_{dif}$ indicates the intraparticle diffusion rate constant, and C provides information about the thickness of the boundary layer.

With the highest correlation coefficient of $R^2$=0.999 (fitting curve is shown in FIG. 6, square symbol curve), the pseudo-second-order model provides an excellent correlation for the adsorption of Cr(VI) on magnetic graphene nanocomposites. The correlation coefficients for the pseudo-first-order, Elovich, and intraparticle diffusion models are 0.898, 0.881 and 0.672, respectively, indicating that these models are not suitable for describing the Cr(VI) adsorption on magnetic graphene nanocomposites. The higher adsorption rate constant $k_{ad}$ (0.28 g $mg^{-1}$ $min^{-1}$) of magnetic graphene nanocomposites from the pseudo-second-order model than that of the aluminum magnesium mixed with hydroxide (<0.024 g $mg^{-1}$ $min^{-1}$),[65] pomegranate husk carbon (<0.032 g $mg^{-1}$ $min^{-1}$)[66] and active carbon (<0.093 g $mg^{-1}$ $min^{-1}$)[67] confirms further the much faster removal rate of the magnetic graphene nanocomposites.

Figure 7:
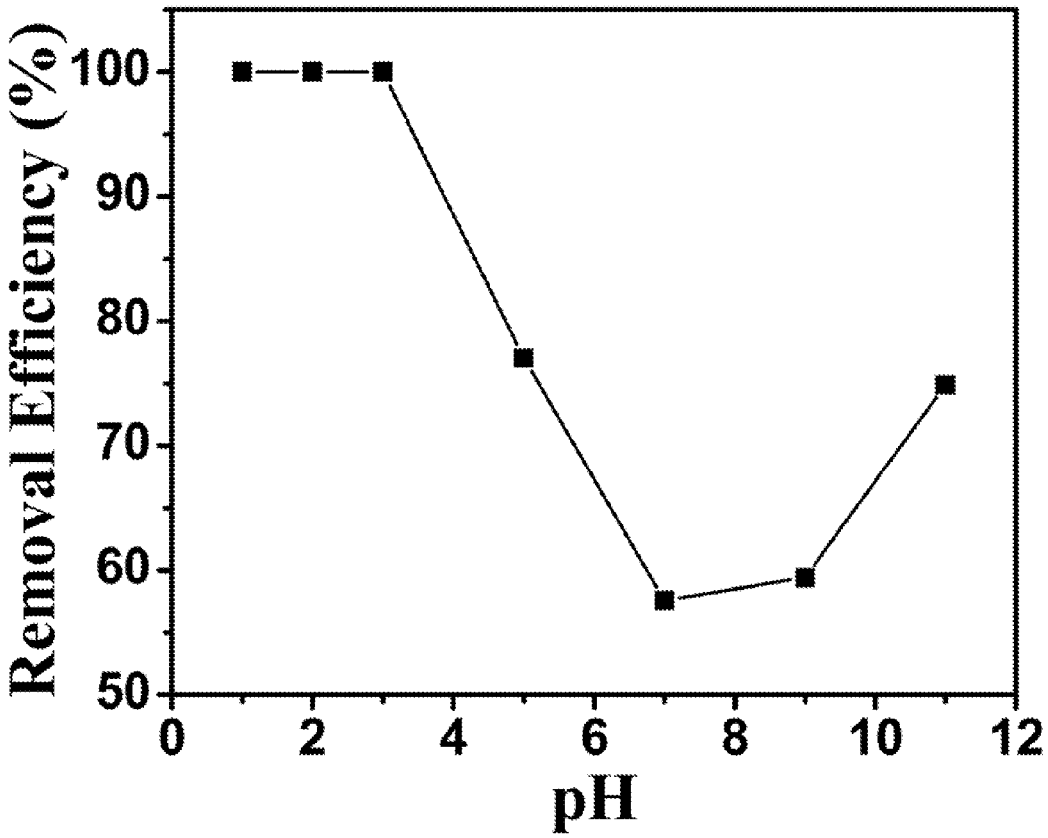
FIG. 7 shows an effect of solution pH on Cr(VI) removal efficiency of magnetic graphene nanocomposites.

Solution pH is one of the variables affecting the adsorption characteristics. The Cr(VI) removal efficiency by magnetic graphene nanocomposites in different pH solutions are shown in FIG. 7 with an initial Cr(VI) concentration of 1000 μg $L^{-1}$ and magnetic graphene nanocomposites concentration of 1 g $L^{-1}$. At a fixed adsorbent concentration, the complete Cr(VI) removal was achieved under acidic condition when the pH is between 1 to 3 rather than in neutral and basic conditions. A complete removal may be achieved from a less concentrated magnetic graphene nanocomposites solution, such as 0.5 g $L^{-1}$ and even 0.25 g $L^{-1}$ when controlling the solution pH at 1, 2 and 3. Therefore, the magnetic graphene nanocomposites exhibit much higher adsorption capacity at lower pH value solutions. Cr(VI) exists with different ionic forms in solution. Important Cr(VI) ion forms in solution are chromate ($CrO_4^{2-}$), dichromate ($Cr_2O_7^{2-}$), and hydrogen chromate ($HCrO_4^-$), and these ion forms are related to the solution pH and total chromate concentration.[65, 68] The predominance diagram[65] of the chromium species based on thermodynamic database[69, 70] using both pH and total Cr(VI) as variables indicates that the major species of Cr(VI) are $CrO_4^{2-}$ and $HCrO_4^-$. For pH lower than 6.8, $HCrO_4^-$ is the dominant species, and above 6.8 only $CrO_4^{2-}$ is stable. The results show that magnetic graphene nanocomposites are favorable for the adsorption of $HCrO_4^-$ rather than $CrO_4^{2-}$. The dependence of the Cr(VI) removal on solution pH can be explained from the surface chemistry at the interface. The surface of metal oxides is generally covered with hydroxyl groups that vary in form at different pH levels. With an increase in pH, the uptake of Cr(VI) ions decreased, which is due to the higher concentration of $OH^-$ ions present in the mixture that compete with Cr(VI) species.

Figure 8:
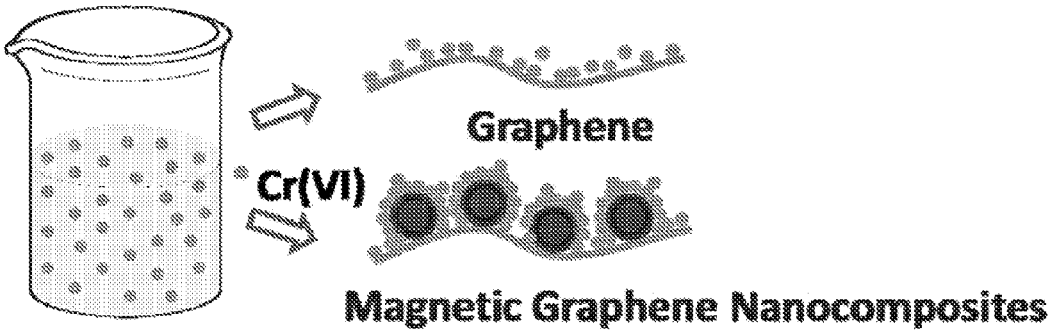
FIG. 8 is a schematic illustration of adsorption mechanisms on graphene and magnetic graphene nanocomposites in accordance with embodiments of the present invention.
Figure 34:
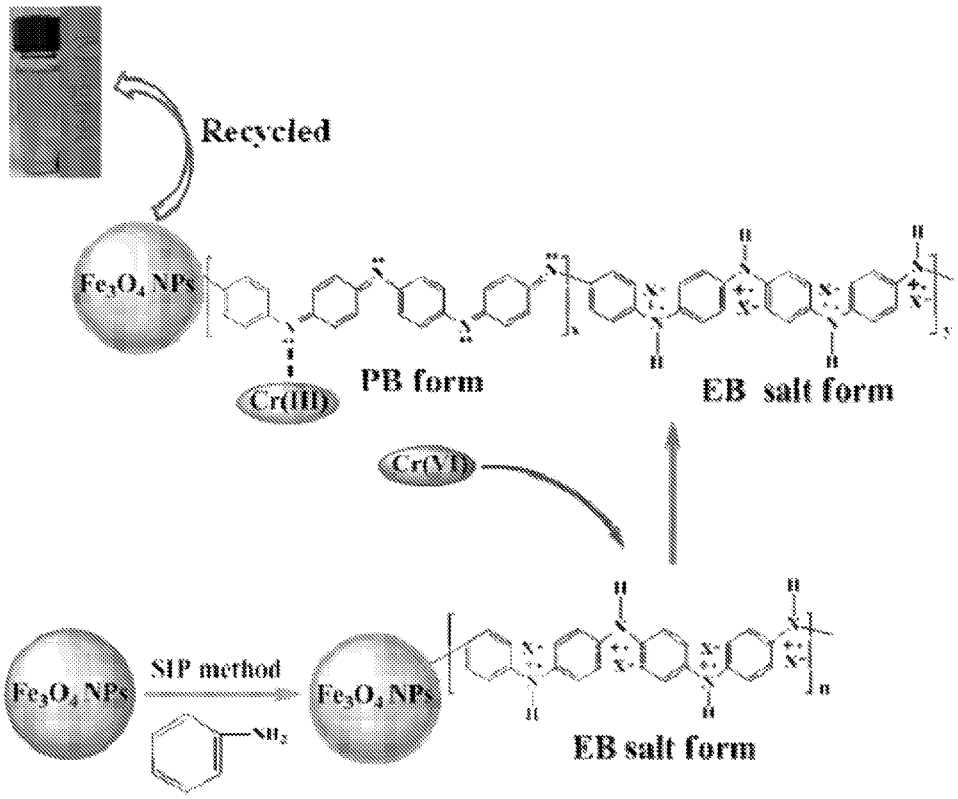
FIG. 34 shows an embodiment of chromium removal with embodiments of the present invention.

Exemplary Removal Mechanism: Referring to FIGS. 8 and 34, the adsorption mechanism of Cr(VI) on pure graphene and magnetic graphene nanocomposites is different. The Cr(VI) on pure graphene is a single-layer adsorption just like active carbon,[71] while on the magnetic graphene nanocomposites, it is a combined process of surface complexation between sulfur on the outer shell and Cr(VI) together with the single layer adsorption on the bare area of graphene.[72] Besides the difference in adsorption mechanisms, the large difference between pure graphene and magnetic graphene nanocomposites also conies from the greater surface area after the deposition of nanoparticles (pure graphene: 36.4 $m^2/g$; magnetic graphene nanocomposites: 42.1 $m^2/g$), which contributes to the extension of the active surface for sorption. Subsequently, more efficient utilization of the respective adsorption sites can be achieved by these new adsorbents.

The foregoing describes a facile one-pot synthesis method to obtain magnetic graphene nanocomposites (MGNP) decorated with core-double-shell nanoparticles. The mono-dispersed nanoparticles on the graphene sheet, composed of a crystalline iron core, inner iron oxide shell, and the outmost amorphous Si—S—O compound shell, are highly stable even immersed in 1 M HCl aqueous acid. The magnetic graphene nanocomposites show an extremely fast Cr(VI) removal performance to reach a complete removal with only 5 minutes. In contrast, other materials like carbon,[71] waste biomass[73] and lignocellulosic substrate[74] often require hours even days of treatment and still the Cr(VI) could not be completely removed.

REFERENCES (1) Hsu, L. C.; Wang, S. L.; Lin, Y. C.; Wang, M. K.; Chiang, P. N.; Liu, J. C.; Kuan, W. H.; Chen, C. C.; Tzou, Y. M., Cr(VI) Removal on Fungal Biomass of *Neurospora Crassa*: the Importance of Dissolved Organic Carbons Derived from the Biomass to Cr(VI) Reduction. Environ. Sci. Technol. 2010, 44, 6202-6208.

(2) Xu, Y.; Zhao, D., Reductive Immobilization of Chromate in Water and Soil Using Stabilized iron Nanoparticles. Water Res. 2007, 41, 2101-2108.

(3) Monser, L.; Adhoum, N., Modified Activated Carbon for the Removal of Copper, Zinc, Chromium and Cyanide from Wastewater. Sep. Purif. Technol. 2002, 26, 137-146.

(4) Kongsricharoern, N.; Polprasert, C., Chromium Removal by a Bipolar Electro-chemical Precipitation Process. Water Sci. Technol. 1996, 34, 109-116.

(5) Hafez, A.; El-Mariharawy, S., Design and Performance of the Two-stage/two-pass RO Membrane System for Chromium Removal from Tannery Wastewater. Part. 3. Desalination 2004, 165, 141-151.

(6) Modrzejewska, Z.; Kaminski, W., Separation of Cr(VI) on Chitosan Membranes. Ind. Eng. Chem. Res. 1999, 38, 4946-4950.

(7) Rengaraj, S.; Joo, C. K.; Kim, Y.; Yi, J., Kinetics of Removal of Chromium from Water and Electronic Process Wastewater by Ion Exchange Resins: 1200H, 1500H and IRN97H. J. Hazard. Mater. 2003, 102, 257-275.

(8) Rengaraj, S.; Yeon, K.-H.; Moon, S.-H., Removal of Chromium from Water and Wastewater by Ion Exchange Resins. J. Hazard. Mater, 2001, 87, 273-287.

(9) Zhang, D,; Wei, S,; Kaila, C.; Su, X.; Wu, J.; Karki, A. B.; Young, D. P.; Guo, Z., Carbon-stabilized Iron Nanoparticles for Environmental Remediation. Nanoscale 2010, 2, 917-919.

(10) Mohan, D.; Singh, K. P.; Singh, V. K., Removal of Hexavalent Chromium from Aqueous Solution Using Low-Cost Activated Carbons Derived from Agricultural Waste Materials and Activated Carbon Fabric Cloth. Ind. Eng. Chem. Res. 2005, 44, 1027-1042.

(11) Sharma, Y. C.; Singh, B.; Agrawal, A,; Weng, C. H., Removal of Chromium by Riverbed Sand From Water and Wastewater Effect of Important Parameters. J. Hazard. Mater. 2008, 151, 789-793.

(12) Hu, J.; Chen, G.; M. C. Lo, I., Removal and Recovery of Cr(VI) from Wastewater by Maghemite Nanoparticles. Water Res. 2005, 39, 4528-4536.

(13) AydIn, Y. A.; Aksoy, N. D., Adsorption of Chromium on Chitosan: Optimization, Kinetics and Thermodynamics. Chem. Eng. J. 2009, 151, 188-194.

(14) Zhao, Y.; Peralta-Videa, J. R.; Lopez-Moreno, M. L.; Ren, M.: Saupe, G.; Gardea-Torresdey, J. L., Kinetin Increases Chromium Absorption, Modulates its Distribution, and Changes the Activity of Catalase and Ascorbate Peroxidase in Mexican Palo Verde. Environ. Sci. Technol. 2011, 45, 10824087.

(15) Sawalha, M. F,; Gardea-Torresdey, J. L; Parsons, J. G.; Saupe, G.; Peralta-Videa, J. R., Determination of Adsorption and Speciation of Chromium Species by Saltbush (Atriplex Canescens) Biomass Using a Combination of XAS and ECP-OES. Microchem. J. 2005, 81, 122-132.

(16) Parsons, J. G.; Hejazi, M.; Tiemann, K. J.; Henning, J.; Gardea-Torresdey, J. L., An XAS Study of the Binding of Copper(II), Zinc(II), Chromium(III) and Chromium(VI) to Hops Biomass. Microchem. J. 2002, 71, 211-219.

(17) Pansini, M.; Colella, C.; De Gennaro, M., Chromium removal from water by ion exchange using zeolite. Desalination 1991, 83, 145-157.

(18) Melitas, N.; Chuffe-Moscoso, O.; Farrell, J., Kinetics of Soluble Chromium Removal from Contaminated Water by Zerovalent iron Media: Corrosion Inhibition and Passive Oxide Effects. Environ. Sci. Technol. 2001, 35, 3948-3953.

(19) Deng, B.; Stone, A. T., Surface-Catalyzed Chromium (VI) Reduction: Reactivity Comparisons of Different Organic Reductants and Different Oxide Surfaces. Environ. Sci. Technol. 1996, 30, 2484-2494.

(20) Jardine, P. M.; Fendorf, S. E.; Mayes, M. A.; Larsen, I. L.; Brooks, S. C.; Bailey, W. B., Fate and Transport of Hexavalent Chromium in Undisturbed Heterogeneous Soil. Environ. Sci. Technol 1999, 33, 2939-2944.

(21) Powell, R. M.; Puls, R. W.; Hightower, S. K.; Sabatini, D. A., Coupled Iron Corrosion and Chromate Reduction: Mechanisms for Subsurface Remediation. Environ. Sci. Technol. 1995, 29, 1913-1922.

(22) Loyaux-Lawniczak, S.; Refait, P.; Ehrhardt, J.-J.; Lecomte, P.; Génin, J.-M. R., Trapping of Cr by Formation of Ferrihydrite during the Reduction of Chromate Ions by Fe(II)-Fe(III) Hydroxysalt Green Rusts. Environ. Sci. Technol. 1999, 34, 438-443.

(23) Reardon, E. J., Anaerobic Corrosion of Granular Iron: Measurement and Interpretation of Hydrogen Evolution Rates. Environ. Sci, Technol. 1995, 29, 2936-2945.

(24) Gangoly, N; Markey, D. C.; Thodos, G. Water-Reuse: Water's Interface with Energy, Air, and Solids; American Institute of Chemical Engineers: New York, 1975; CONF-750530.

(25) Kadirvelu, K.; Namasivayam, C., Activated Carbon from Coconut Coirpith as Metal Adsorbent: Adsorption of Cd(II) from Aqueous Solution. Adv. Environ. Res. 2003, 7, 471-478.

(26) Hasar, H., Adsorption of Nickel(II) from Aqueous Solution onto Activated Carbon Prepared from Almond Husk. J. Hazard. Mater. 2003, 97, 49-57.

(27) Yang, J. K.; Park, H. J.; Lee, H. D.; Lee, S. M., Removal of Cu(II) by Activated Carbon Impregnated with Iron(III). Colloids Surf. A 2009, 337, 154-158.

(28) Imamoglu, M.; Tekir, O., Removal of Copper(II) and Lead(II) Ions from Aqueous Solutions by Adsorption on Activated Carbon from a New Precursor Hazelnut Husks. Desalination 2008, 228, 108-113.

(29) Zaini, M. A. A.; Okayama, R.; Machida, M., Adsorption of Aqueous Metal Ions on Cattle-manure-compost Based Activated Carbons. J. Hazard. Mater. 2009, 170, 1119-1124.

(30) Wang, S. Y.; Tsai, M. H.; Lo, S. F.; Tsai, M. J., Effects of Manufacturing Conditions on the Adsorption Capacity of Heavy Metal Ions by Makino Bamboo Charcoal. Bioresour. Technol. 2008, 99, 7027-7033.

(31) Tu, Z.; He, Q.; Chang, X.; Hu, Z.; Gao, R.; Zhang, L.; Li, Z., 1-(2-Formamidoethyl)-3-phenylurea Functionalized Activated Carbon for Selective Solid-phase Extraction and Preconcentration of Metal Ions. Anal. Chim. Acta 2009, 649, 252-257.

(32) Pillay, K.; Cukrowska, E. M.; Coville, N. J., Multi-walled Carbon Nanotubes as Adsorbents for the Removal of Parts Per Billion Levels of Hexavalent Chromium from Aqueous Solution. J. Hazard. Mater. 2009, 166, 1067-1075.

(33) Chandra, V.; Park, J.; Chun, Y.; Lee, J. W.; Hwang, I.-C.; Kim, K. S., Water-Dispersible Magnetite-Reduced Graphene Oxide Composites for Arsenic Removal. ACS Nano 2010, 4, 3979-3986.

(34) Shin, S.; Jang, J., Thiol Containing Polymer Encapsulated Magnetic Nanoparticles as Reusable and Efficiently Separable Adsorbent for Heavy Metal Ions. Chem. Comm. 2007, 41, 4230-4232.

(35) Zhang, W. X., Nanoscale iron Particles for Environmental Remediation: An Overview. J. Nanopart, Res. 2003, 5, 323-332.

(36) Ponder, S. M.; Darab, J. G.; Mallouk, T. E., Remediation of Cr(VI) and Pb(II) Aqueous Solutions Using Supported, Nanoscale Zero-valent Iron. Environ. Sci. Technol. 2000, 34, 2564-2569.

(37) Hu, J.-S.; Thong, L.-S.; Song, W.-G.; Wan, L.-J., Synthesis of Hierarchically Structured Metal Oxides and their Application in Heavy Metal Ion Removal. Adv. Mater. 2008, 20, 2977-2982.

(38) Lu, Y.; Yin, Y.; Mayers, B. T.; Xia, Y., Modifying the Surface Properties of Superparamagnetic Iron Oxide Nanoparticles through a Sol-gel Approach. Nano Lett. 2002, 2, 183-186.

(39) Wang, G.; Harrison, A., Preparation of Iron Particles Coated with Silica. J. Colloid Interface Sci. 1999, 217, 203-207.

(40) Zhu, J.; Wei, S.; Haldolaarachchige, N.; Young, D. P.; Guo, Z., Electromagnetic Field Shielding Polyurethane Nanocomposites Reinforced with Core-Shell Fe-Silica Nanoparticles. J. Phys. Chem. C 2011, 115, 15304-15310.

(41) Pellegrino, T.; Manna, L.; Kudera, S.; Liedl, T.; Koktysh, D.; Rogach, A. L.; Keller, S.; Rädler, J.; Natile, G.; Parak, W. J., Hydrophobic Nanocrystals Coated with an Amphiphilic Polymer Shell: A General Route to Water Soluble Nanocrystals. Nano Lett. 2004, 4, 703-707.

(42) Lin, C.-A. J.; Sperling, R. A.; Li, J. K.; Yang, T.-Y.; Li, P.-Y.; Zanella, M.; Chang, W. H.; Parak, W. J., Design of an Amphiphilic Polymer for Nanoparticle Coating and Functionalization. Small 2008, 4, 334-341.

(43) Cho, S.-J.; Idrobo, J.-C.; Olamit, J.; Liu, K.; Browning, N. D.; Kauzlarich, S. M., Growth Mechanisms and Oxidation Resistance of Gold-Coated Iron Nanoparticles. Chem. Mater. 2005, 17, 3181-3186.

(44) Lu, Z.; Prouty, M. D.; Guo, Z.; Golub, V. O.; Kumar, C. S. S. R.; Lvov, Y. M., Magnetic Switch of Permeability for Polyelectrolyte Microcapsules Embedded with Co—Au Nanoparticles. Langmuir 2005, 21, 2042-2050.

(45) Oliveira, L. C. A.; Rios, R. V. R. A.; Fabris, J. D.; Garg, V.; Sapag, K.; Lago, R. M., Activated Carbon/Iron. Oxide Magnetic Composites for the Adsorption of Contaminants in Water, Carbon 2002, 40, 2177-2183.

(46) Vaughan Jr, R. L.; Reed, B. E., Modeling As(V) Removal by a Iron Oxide Impregnated Activated Carbon Using the Surface Complexation Approach. Water Res. 2005, 39, 1005-1014.

(47) Westervelt, R. M., Graphene Nanoelectronics. Science 2008, 320, 324-325.

(48) Ang, P. K.; Chen, W.; Wee, A. T. S.; Loh, K. P., Solution-Gated Epitaxial Graphene as pH Sensor. J. Am. Chem. Soc. 2008, 130, 14392-14393.

(49) Huang, J.; Huang, Y.; Zhang, L.; Wang, Y.; Ma, Y.; Guo, T.; Chen, Y., Molecular-Level Dispersion of Graphene into Poly(vinyl alcohol) and Effective Reinforcement of Their Nanocomposites. Adv. Func. Mater. 2009, 19, 2297-2302.

(50) Gardner, M.; Comber, S., Determination of Trace Concentrations of Hexavalent Chromium. Analyst 2002, 127, 153-156.

(51) Williams D. B.; Carter. C. B., Transmission Electron Microscopy: A Textbook for Materials Science. Springer; New York, 2009.

(52) McAllister, M. J.; Li, J.-L.; Adamson, D. H.; Schniepp, H. C.; Abdala, A. A.; Liu, J.; Herrera-Alonso, M.; Milius, D. L.; Car, R.; Prud'homme, R. K.; Aksay, I. A., Single Sheet Functionalized Graphene by Oxidation and Thermal Expansion of Graphite. Chem. Mater. 2007, 19, 4396-4404.

(53) Suslick, K. S.; Fang, M.; Hyeon, T., Sonochemical Synthesis of Iron Colloids. J. Am. Chem. Soc. 1996, 118, 11960-11961.

(54) Burke, N. A. D.; Stöver, H. D. H.; Dawson, F. P., Magnetic Nanocomposites: Preparation and Characterization of Polymer-Coated lion Nanoparticles. Chem. Mater, 2002, 14, 4752-4761.

(55) Guo, Z.; Park, S.; Hahn, H. T.; Wei, S.; Moldovan, M.; Karki, A. B.; Young, D. P., Giant Magnetoresistance Behavior of an Iron/Carbonized Polyurethane Nanocomposite. Appl. Phys. Lett. 2007, 90, 053111.

(56) Guo, Z.; Lin, H.; Karki, A. B.; Wei, S.; Young, D. P.; Park, S.; Willis, J.; Hahn, T. H., Facile Monomer Stabilization Approach to Fabricate lion/Vinyl Ester Resin Nanocomposites. Compos. Sci. Technol. 2008, 68, 2551-2556.

(57) Skumryev, V.; Stoyanov, S.; Zhang, Y.; Hadjipanayis, G.; Givord, D.; Nogues, J., Beating the Superparamagnetic Limit with Exchange Bias. Nature 2003, 423, 850-853.

(58) Cullity, B. D.; Graham, C. D. Introduction to Magnetic Materials. Addison-Wiley: New York, 1972.

(59) Meng, X.; Korfiatis, G. P.; Christodoulatos, C.; Bang, S., Treatment of arsenic in Bangladesh well water using a household co-precipitation and filtration system. Water Res. 2001, 35, 2805-2810.

(60) Lagergren, S., Zur Theorie Der Sogenannten Adsorption Gelöster Stoffe, Kungliga Svenska Vetenskapsakademiens. Handlingar, 1898, 24, 1-39.

(61) Ho, Y. S.; McKay, G.; Wase, D. A. J.; Forster, C. F., Study of the Sorption of Divalent Metal Ions on to Peat. Adsorpt. Sci. Technol. 2000, 18, 639-650.

(62) Juang, R.-S.; Chen, M.-L., Application of the Elovich Equation to the Kinetics of Metal Sorption with Solvent-Impregnated Resins. Ind. Eng. Chem. Res. 1997, 36, 813-820.

(63) Sparks, D. L., Kinetics of Reaction in Pure and Mixed Systems, in Soil Physical Chemistry. CRC press: Boca Raton, 1986.

(64) Srivastava, S. K.; Tyagi, R.; Pant, N., Adsorption of Heavy Metal ions on Carbonaceous Material Developed from the Waste Slurry Generated in Local Fertilizer Plants. Water Res. 1989, 23, 1161-1165.

(65) Li, Y.; Gao, B.; Wu, T.; Sun, D.; Li, X.; Wang, B.; Lu, F., Hexavalent Chromium Removal From Aqueous Solution by Adsorption on Aluminum Magnesium Mixed Hydroxide. Water Res. 2009, 43, 3067-3075.

(66) Ahmed El, N., Potential of Pomegranate Husk Carbon for Cr(VI) Removal From Wastewater: Kinetic and Isotherm Studies. J. Hazard, Mater. 2009, 161, 132-141.

(67) El-Sikaily, A.; Near, A. E.; Khaled, A.; Abdelwehab, O., Removal of Toxic Chromium from Wastewater Using Green Alga Ulva Lactuca and Its Activated Carbon. J. Hazard Mater. 2007, 148, 216-228.

(68) Weckhuysen, B. M.; Wachs, I. E., Surface Chemistry and Spectroscopy of Chromium in Inorganic Oxides. Chem. Rev. 1996, 96, 3327-3349.

(69) Butler, J. N., Ionic Equilibrium 1967, Addison-Wesley, New York.

(70) Stumm, W.; Morgan, J. J., Aquatic Chemistry: An Introduction Emphasizing Chemical Equilibria in Natural Waters, 1996, John Wiley & Sons, Inc., New York.

(71) Lalvani, S. B.; Wiltowski, T.; Hübner, A.; Weston, A.; Mandich, N., Removal of Hexavalent Chromium and Metal Cations by a Selective and Novel Carbon Adsorbent. Carbon 1998, 36, 1219-1226.

(72) Brauer, S. L.; Wetterhahn, K. E., Chromium(VI) Forms a Thiolate Complex with Glutathione. J. Am. Chem. Soc. 1991, 113, 3001-3007.

(73) Garg, U. K.; Kaur, M. P.; Garg, V. K.; Sud, D., Removal of Hexavalent Chromium from Aqueous Solution by Agricultural Waste Biomass. J. Hazard. Mater. 2007, 140, 60-68.

(74) Dupont, L.; Guillon, E., Removal of Hexavalent Chromium with a Lignocellulosic Substrate Extracted from Wheat Bran. Environ. Sci. Technol. 2003, 37, 4235-4241.

Aspects of the present invention further provide electromagnetic field shielding polyurethane nanocomposites reinforced with core-shell Fe-silica nanoparticles. Aspects of the present invention implement a modified Stöber method to synthesize Fe—$SiO_2$ nanoparticles ("NPs") using 3-aminopropyltriethoxysilane ("APTES") as a primer to render the metal particle surface compatible with silica. High resolution transmission electron microscopy ("HRTEM") and selected area electron diffraction ("SAED") results indicate a highly crystalline iron core coated with a uniform layer of silica. Polyurethane ("PU") nanocomposites filled with (e.g., 71 wt %) Fe—FeO and (e.g., 71 wt %) Fe—$SiO_2$ nanoparticles may be fabricated via a surface initiated polymerization ("SIP") method. The significantly increased coercivity of the resulting nanocomposites than that of the pure Fe—FeO nanoparticles indicates that the nanoparticles become magnetically harder after dispersed in a PU matrix. Both Fe—$SiO_2$ nanoparticles and Fe—$SiO_2$/PU nanocomposites exhibit better thermal stability and antioxidation capability than Fe—FeO and Fe—FeO/PU, respectively, owing to the barrier effect of the silica shell, which can be revealed by a thermalgravimetric analysis ("TGA"). Meanwhile, the silica shell greatly reduces the eddy current loss and increases the anisotropy energy, which achieves a higher reflection loss and broader absorption bandwidth for the microwave absorption. The Fe—$SiO_2$/PU nanocomposites show good electromagnetic wave absorption performance (e.g., reflection loss, RL<−20 dB) at high frequencies (e.g., 11.3 GHz), while the better RL of Fe—FeO/PU is still larger than −20 dB even with a larger absorber thickness.

Polymer nanocomposites ("PNCs") have attracted considerable interests recently owing to their cost effective processability, light weight, and tunable physiochemical properties. Deriving from the different composition, size, and morphology of the fillers, versatile unique properties are expected once they are combined with specific polymers. Progress has been made from different filler/polymer PNCs, such as the significantly enhanced mechanical strength and toughness of PNCs reinforced with carbon nanofibers ("CNFs"),[1, 2] carbon nanotubes ("CNTs")[3] and graphene[4, 5]; the improved electrical conductivity in the conductive polymers (such as polyaniline and polypyrrole) incorporating semi-conductive tungsten oxide nanoparticles (NPs) and nanorods;[6, 7] and the improved thermal stability in PNCs with nano-clay as the fire retardant materials.[8, 9]

The fast development of wireless communications has made electromagnetic ("EM") wave absorption materials ever more attractive. High-efficient electromagnetic absorption materials that possess broad absorption frequency, high absorption capacity, low weight, good thermal stability, and antioxidation capability are in great demand and less work has been done until now.[10-13] PNCs are one of the best candidates, which can be designed to meet the above requirements due to their adjustable properties in a wide range. Two groups of fillers are often introduced in a polymer to fabricate EM wave absorbers. The first group is carbon-based fillers, such as CNTs, graphite nanoplatelets ("GNPs"), and reduced graphene oxide ("r-GO"). For example, the shielding effectiveness of CNTs/polystyrene foam composites containing 7 wt % CNTs was measured to be 18.2-19.3 dB over a frequency range of 8.2-12.4 GHz.[14] And even higher reflection loss of 24.27 dB at 15.3 GHz was observed in CNTs/varnish composites with a CNT loading of 8 wt %.[15] GNP[16] and r-GO[17] were also studied as effective fillers for microwave absorption. The second group is metal and metal oxides, which attract more interest due to their unique permittivity and permeability properties at microwave frequencies. Materials with large dielectric permittivity (∈), such as barium titanate ($BaTiO_3$, ∈≈1700[18]) and zirconium titanate ($ZrTiO_3$, ∈≈2000[18]), are widely studied for their microwave absorption properties.[11,19,20] However, high permittivity itself does not guarantee a high-efficiency microwave absorption; high permeability is required especially at high frequency ranges. Therefore, ferromagnetic fillers, such as ferrites and carbonyl iron particles ("CIPs") are often used to obtain high permeability; however, their permeabilities are drastically reduced at frequencies in the giga-hertz ranges.[21,22] To obtain high reflection loss (RL) within a broad absorption frequency, researchers have paid attention to the modification of the filler structure and composition. For example, Wang et al. synthesized monodispersed hollow $Fe_3O_4$ nano-spheres from a template free process, and a minimum RL value of −42.7 dB was Observed at 2.0 GHz with a thickness of 6.9 mm.[12] Zhu et al. coated a $TiO_9$ nanoparticles layer on $Fe_3O_4$ nanotubes to obtain a core-shell structure,[23] which showed a minimum RL value of −20.6 dB at 17.28 GHz with an absorber thickness of 5 mm due to the reduced eddy current effect and improved anisotropy energy from $TiO_2$ shells.

Magnetic nanostructures of iron have been in great interest for EM wave absorption applications, which is supposed to remain high EM parameters in a high frequency range due to its large saturation magnetization ($M_s$) and high Snoek's limit.[24-26] The Snoek's limit[27] is the line μ=F(f) (μ: permeability, w: frequency), calculated in the absence of an external field, above which the μ cannot have values, as long as a cubic magnetocrystalline anisotropy is present. However, the weak magnetocrystalline anisotropy and attenuated permeability due to the eddy current phenomenon usually limit their applications at high frequencies.[28] Coating the iron particles with an insulating material is realized as an effective way to increase the surface anisotropy and reduce the eddy current effect.[29] Extensive studies have been conducted on the uniform coating of metal nanoparticles with silica shells.[30-33] The silica shell not only enhances the colloidal stability but also controls the distance between the core particles within the assemblies through shell thickness. $Fe_2O_3$[34] and Fe nanocubes[35] coated with silica have been reported for microwave absorption with a maximum RL of about −5 and −18.2 dB, respectively. However, a RL of lower than −20 dB is required for real applications. Work of the inventor discloses that the pure Fe nanoparticles and the microwave absorption bandwidth become narrow due to the eddy current loss though with a significant weight reduction.[36] To find suitable microwave absorptive PNCs with an enlarged RL and wide bandwidth is not a trial.

In this disclosure, microwave absorptive polyurethane ("PU") PNCs filled with Fe—$SiO_2$ nanoparticles are reported with a much higher absorption capacity and broader absorption bandwidth at high frequency than the PU PNCs filled with the Fe—FeO nanoparticles. The silica shell surrounding the Fe nanoparticles may be synthesized by a modified Stöber method with 3-aminopropyltriethoxysilane ("APTES") as a primer to promote the deposition and adhesion of silica on the nanoparticle surface. The PU PNCs may be fabricated with a surface initialized polymerization ("SIP") method. The thermal stability, electrical, magnetic, and microwave absorption properties are comparatively investigated in both PNC systems. The antioxidation capability is improved due to the protective silica shell.

Figure 9:
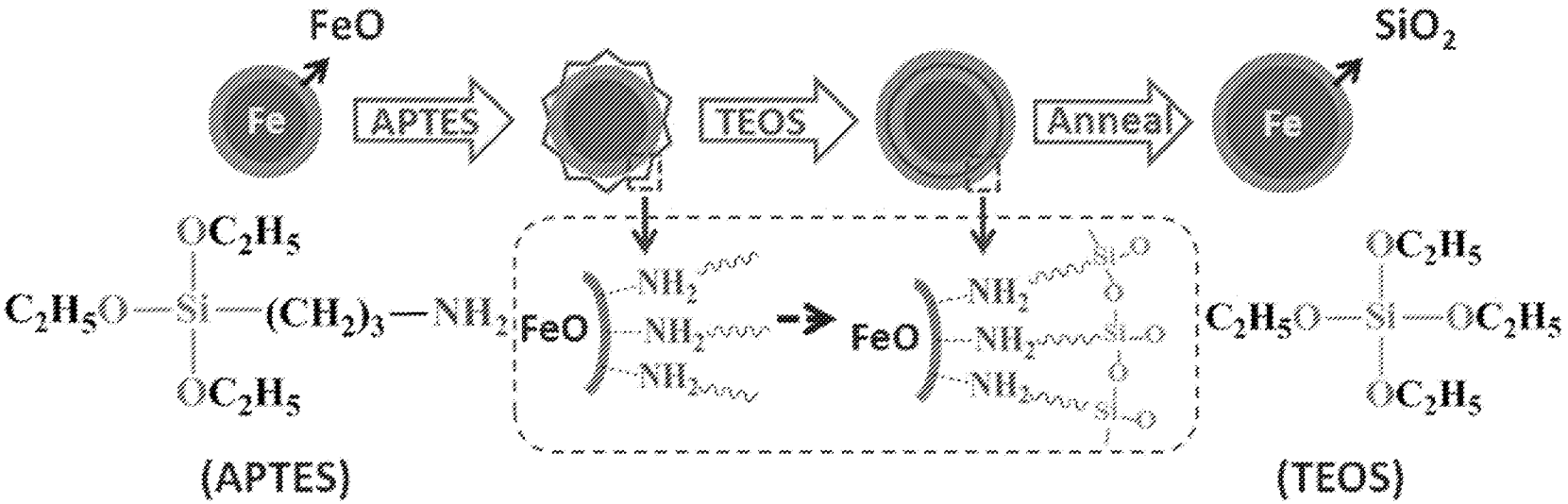
FIG. 9 is a schematic illustration of silica coating on Fe—FeO nanoparticles in accordance with embodiments of the present invention.

Core-shell structured Fe—FeO nanoparticles, with an average size of 25 nm and shell thickness of 0.5 nm, were commercially obtained from QuantumSphere, Inc. 3-aminopropyltriethoxysilane (APTES, e.g., 99%) were commercially obtained from Sigma-Aldrich and tetraethyl orthosilicate (TEOS, e.g., 99+%) was commercially obtained from Alfa Aesar, Ammonia (e.g., 28%, lab grade), ethanol (e.g., 99%), and tetrahydrofuran (THF, 99%) were commercially obtained from Fisher Scientific. The molecular structures of the APTES and TEOS, as well as the silica coating procedure are shown in FIG. 9. The details of the silica coating are described hereinafter.

Figure 10:
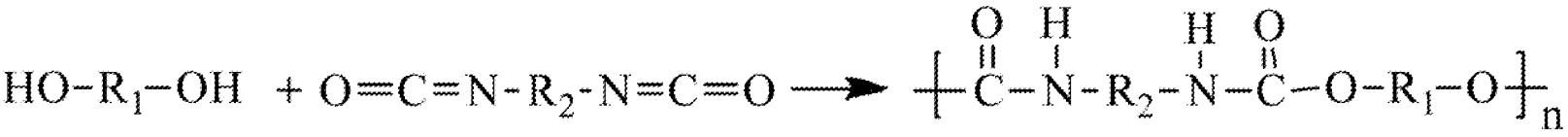
FIG. 10 is a schematic illustration of synthesis of PU.

The PU were commercially obtained from PRC-Desoto international, Inc, which contains three parts, part A and part C are accelerators and catalysts, and part B is the base compound. The synthesis of PU is shown in FIG. 10.

Fe—FeO nanoparticles (e.g., 3 g) may be dispersed (e.g., ultrasonically) in a mixture solution (e.g., solvent) (e.g., ethanol 120 ml) and APTES (e.g., 0.4 ml) (e.g., for 30 minutes at 25° C.). The suspension may be stored (e.g., for 1 hour) to achieve the complexation between the amine groups of APTES and the nanoparticle surface. The silica shell growth may be achieved by a well-known Stöber method.[37] More specifically, the suspension may be stirred (e.g., vigorously at 500 rpm), and TEOS (e.g., 1.8 ml) injected (e.g., rapidly) into the suspension. Then, ammonia (e.g., 12 ml) may be added to the suspension (e.g., by dropping slowly). The mechanical stirring may be continued (e.g., for 5 hours) and then the particles may be separated (e.g., using a magnet). The particles may be washed (e.g., with ethanol and DI water three times) and then dried (e.g., in a vacuum oven overnight at room temperature). The dried particles may be annealed (e.g., at 650° C. for 2 hours under $H_2$/Ar (hydrogen ratio: ~5%) atmosphere) to reduce the iron oxides to iron and complete the reaction from TEOS to silica.

The Fe—FeO nanoparticles (e.g., 5 g) may be initially mixed with a diluted mixture solution containing accelerators part A (e.g., 0.36 g), and catalysts part C (e.g., 0.40 g) and THF (e.g., 20 ml), followed by sonication (e.g., for 1 hour at room temperature) to allow the adsorption of part A and C on nanoparticle surface. Then, base compound part B (e.g., 2.24 g) is added in the suspension, and the mixture suspension may be mechanically stirred (e.g., at 200 rpm in ultrasonic bath for 1 hour at 50° C.). The suspension is observed to become more viscous as the reaction proceeds. The viscous suspension may be transferred into a mold and stored (e.g., at room temperature for 7 days) to complete the reaction and solvent evaporation. The final weight loading of the nanoparticles is estimated to be 71 wt % and a similar weight of Fe—$SiO_2$ is used to synthesize the Fe—$SiO_2$/PU PNCs following similar procedures.

The core-shell structures of the Fe—FeO and Fe—$SiO_2$ nanoparticles were examined by transmission electron microscopy (TEM). The samples were observed in a FEI Tecnai G2 F20 with a field emission gun at a working voltage of 200 kV. All images were recorded as zero-loss images by excluding the contributions of inelastically scattered electrons using a Gatan Image Filter.

The thermal stability of the Fe—FeO, Fe—$SiO_2$ and their corresponding PNCs were studied with a thermogravimetric analysis (TGA, TA Instruments TGA Q-500). TGA was conducted on these samples from 25 to 800° C. with an air flow rate of 60 mL/min and a heating rate of 10° C./min.

A high resistance meter (Agilent 4339B) equipped with a resistivity cell (Agilent, 16008B) was used to measure the volume resistivity after inputting the sample thickness. This equipment allows resistivity measurement up to $10^{16}\Omega$. The source voltage was set at 0.1 V for all the samples. The reported values represented the mean value of eight measurements with a deviation less than 10%. The magnetic properties of the PNCs at room temperature were carried out in a 9 T physical properties measurement system (PPMS) by Quantum Design.

The relative complex permeability and permitivity were measured using a transmission line technique. A washer shaped specimen was cut from a thin sheet (e.g., ~2 mm) of magnetic composite. The nominal outer and inner diameters of the specimen were 7.00 and 3.04 mm, respectively. The specimen may be faced by abrading (e.g., with a 320-grit SiC abrasive paper on a granite flat) until a smooth and uniform surface is achieved. The specimen was then placed in a sample holder, located in between the rigid beaded airline (APC-7) and the flexible coaxial airline (APC-7) that are connected to the network analyzer (HP Model 8510B). The frequency generator was used to generate electromagnetic waves from 2 to 18 GHz. The permeability and permittivity were then deduced from the scattering parameters using a Nicholson-Ross algorithm.[38,39] The metal-backed reflection loss ("MBRL") was calculated from the measured permittivity and permeability.

Figure 11:
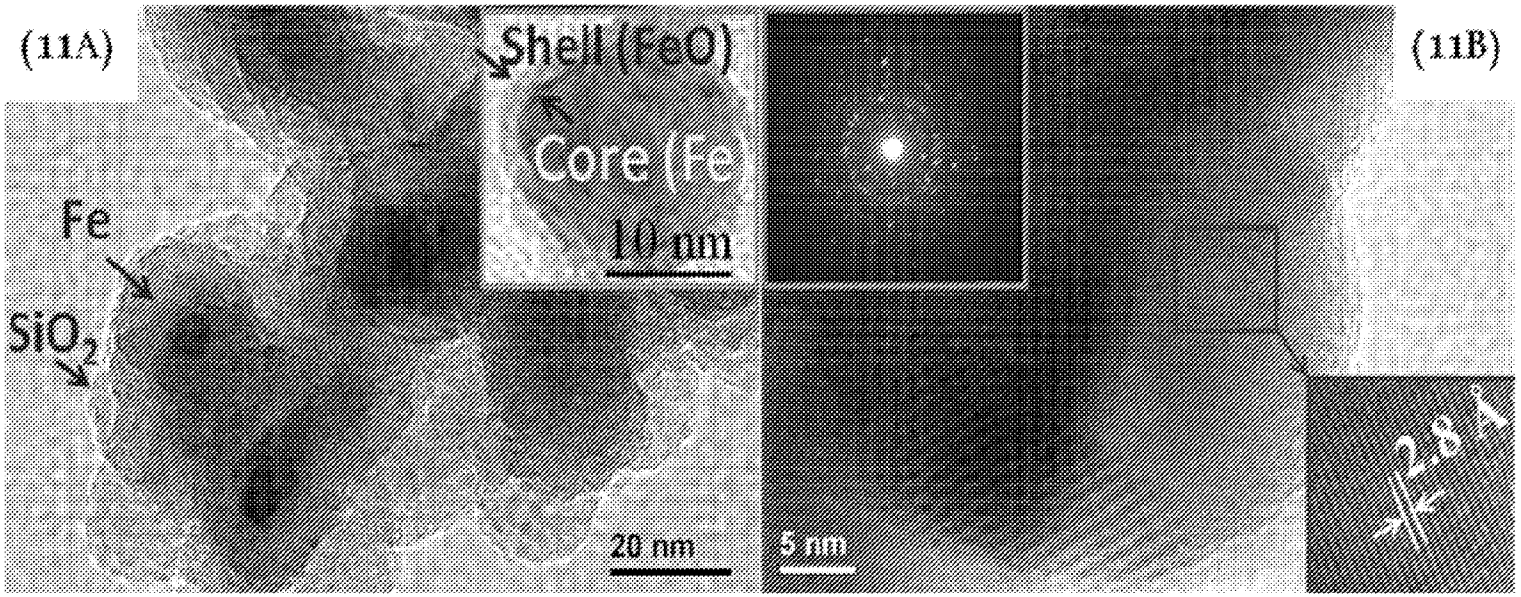
FIG. 11 shows (*a*) a TEM of Fe—$SiO_2$ core-shell structured nanoparticles, and the top inset exhibits the core-shell structure of the as-received nanoparticles with a Fe core and FeO shell, and (*b*) a HRTEM of the Fe—$SiO_2$ nanoparticles, the left inset shows the selected area electron diffraction (SAED) pattern of the nanoparticles and right inset shows a lattice distance of 2.8 Å corresponding to the body-centered cubic iron.

Image (*a*) of FIG. 11 shows the microstructure of the Fe—$SiO_2$ core-shell nanoparticles. The nanoparticles are observed to be completely encapsulated by silica shells. The relatively dark areas in the image are iron nanoparticles, and the light grey areas surrounding them are $SiO_2$, marked with arrows in FIG. 11(*a*). The as-received nanoparticles are core-shell structured with a FeO shell thickness of about 1 nm, as shown in the inset of FIG. 11(*a*). To ensure the reduction of the iron oxide shell to iron during the annealing, a high resolution TEM image of the Fe—$SiO_2$ nanoparticles is taken, as shown in the image (*b*) of FIG. 11. Focusing on the edge of the Fe—$SiO_2$ nanoparticles, the iron core extends its crystalline structure to the end of the interface and is covered by a thin layer of amorphous silica; the FeO shell disappears in the Fe—$SiO_2$ nanoparticles. This observation confirms that the FeO shell has been reduced to Fe during the annealing. Referring to the left inset of FIG. 11(*b*), the selected area electron diffraction (SAED) pattern shows the crystalline structure of the iron core. As shown in the bottom inset of FIG. 11(*b*), the lattice fringe space of 2.8 Å, bottom inset of FIG. 11(*b*), corresponds to the typical lattice distance of the body-centered cubic iron.[40,41]

Figure 12:
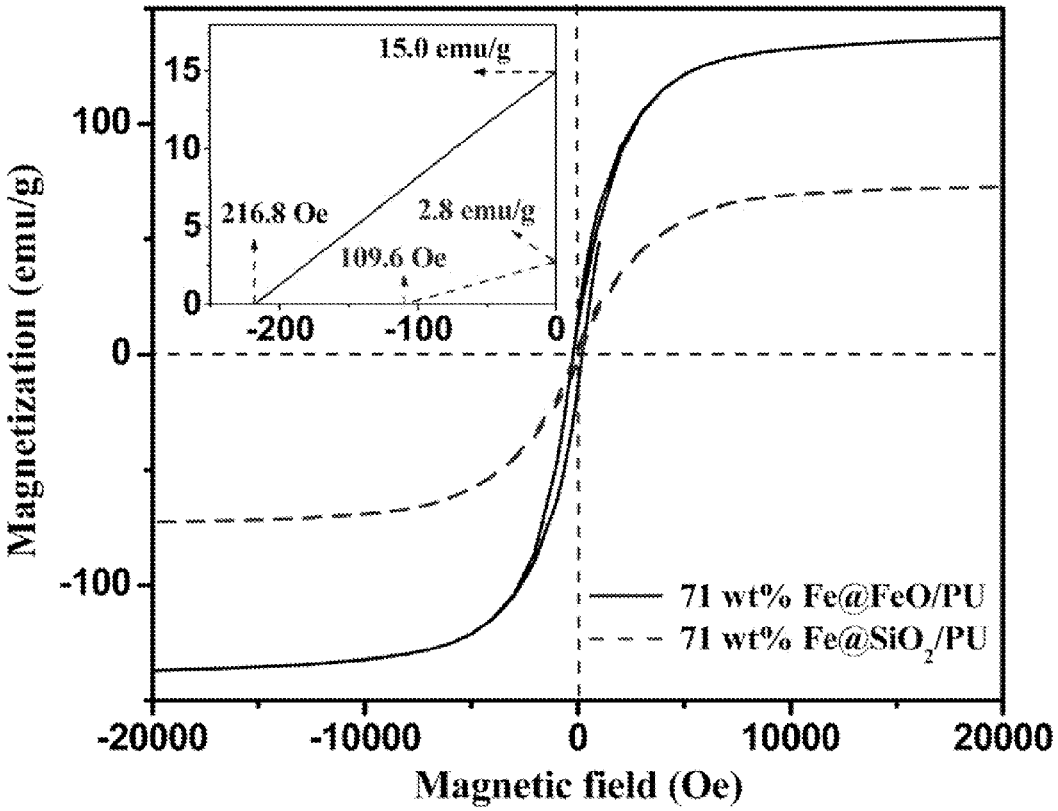
FIG. 12 shows hysteresis loops of PU nanocomposites filled with 71 wt % Fe@FeO and Fe@$SiO_2$ NPs.

FIG. 12 shows the magnetic hysteresis loops of the PNCs filled with the same loading of Fe—FeO and Fe—$SiO_2$ nanoparticles. Both PNCs are saturated at a relatively high magnetic field. The Fe—$SiO_2$/PU PNCs exhibit lower saturated magnetization ($M_s$) (72.6 emu/g) than that of the Fe—FeO/PU PNCs (137.1 emu/g), which is due to the silica shell with an almost zero $M_s$ in the Fe—$SiO_2$ nanoparticles. Much larger coercivities ($H_c$) of 216.8 and 109.6 Oe are observed in the PNCs filled with Fe—FeO and Fe—$SiO_2$ nanoparticles, respectively. The coercivity of the Fe—FeO nanoparticles is reported as 62.3 Oe in previous work,[42] and the enhanced $H_c$ of the PNCs is due to the decreased interparticle dipolar interaction, which arises from the enlarged internanoparticle distance for the single domain nanoparticles,[43,44] as compared to the close contact of the Fe—FeO nanoparticles.

Figure 13:
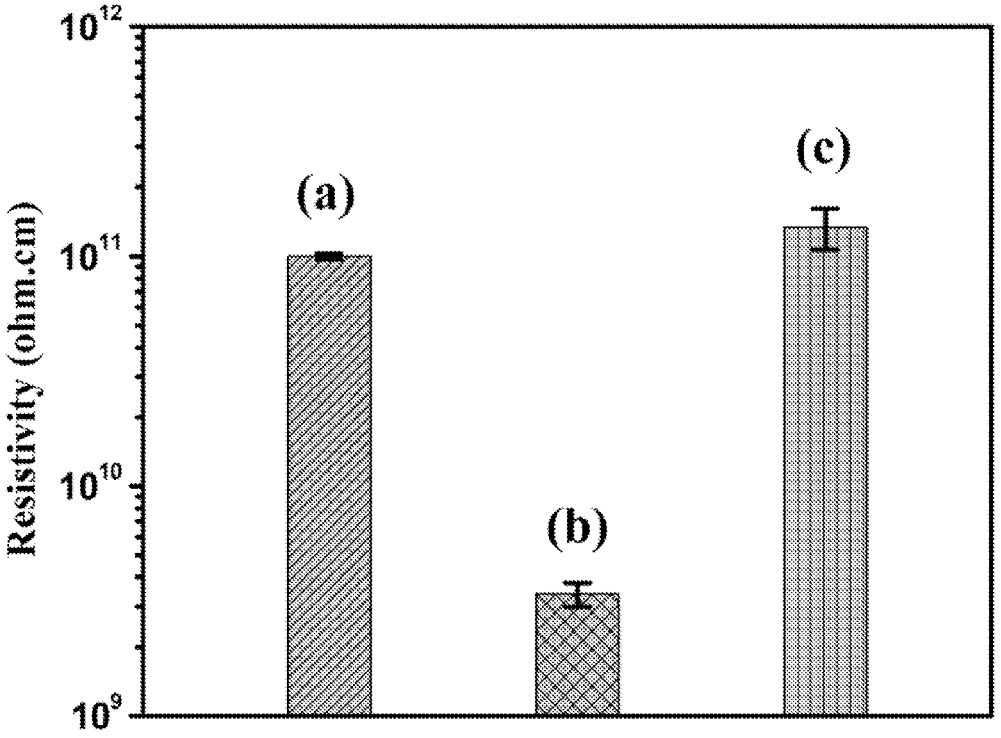
FIG. 13 shows resistivity of (a) Pure PU, (b) 71 wt % Fe@FeO/PU, and (c) 71 wt % Fe@SiO2/PU PNCs.

FIG. 13 shows the volume resistivity of the pure PU (a) and its PNCs filled with 71 wt % Fe—FeO (b) and 71 wt % Fe—$SiO_2$ (c), respectively. The pure PU shows a volume resistivity of about $10^{11}$ ohm·cm, which is in good agreement with the other reported value.[45] The 71 wt % Fe—FeO/PU PNCs still behave like an insulator even though a significant resistivity reduction as high as 96.6% is observed. Compared with the prominent geometrical models created by Kirkpatrick[46] and Zallen,[47] the required minimum touching spherical particles is 16 vol %. This value is in approximate agreement with the most experimental observations that the critical volume fraction is between 5 and 20 vol % for polymer composites filled with powdery materials.[42] However, the much higher spherical Fe—FeO nanoparticles loading of 71 wt % (24.8 vol %, estimated from $\rho_{Fe-FeO}$=7.80 g/cm$^3$ and $\rho_{PU}$=1.05 g/cm$^3$) is above the critical volume fraction and the Fe—FeO/PU PNCs still remain insulated. This non-conductive behavior is attributed to the compact insulating PU layer on the nanoparticle surface from the surface initialized polymerization method, which prevents the direct contact among the Fe—FeO nanoparticles. After coating the Fe—FeO nanoparticles with a silica shell, the corresponding PNCs exhibit even higher volume resistivity than that of pure PU, which is due to the higher resistance of the silica coating ($10^{14}$-$10^{16}$ ohm·cm) on the nanoparticles.[48]

Figure 14:
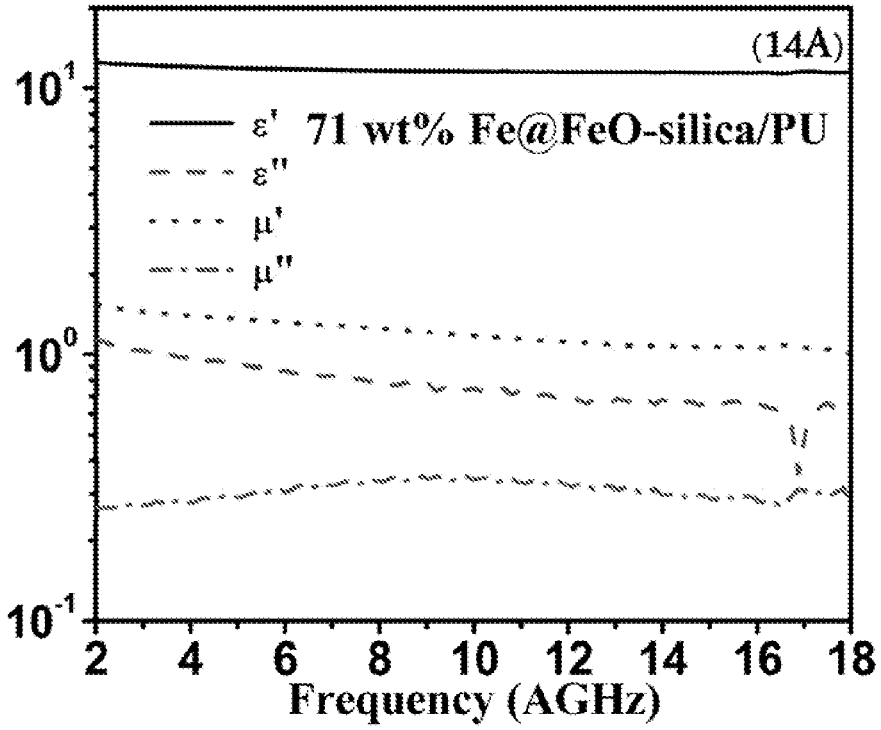
FIG. 14 shows permittivity and permeability vs. frequency of PNCs with a 71 wt % particle loading of (*a*) Fe@$SiO_2$ and (*b*) Fe@ FeO.
Figure 14:
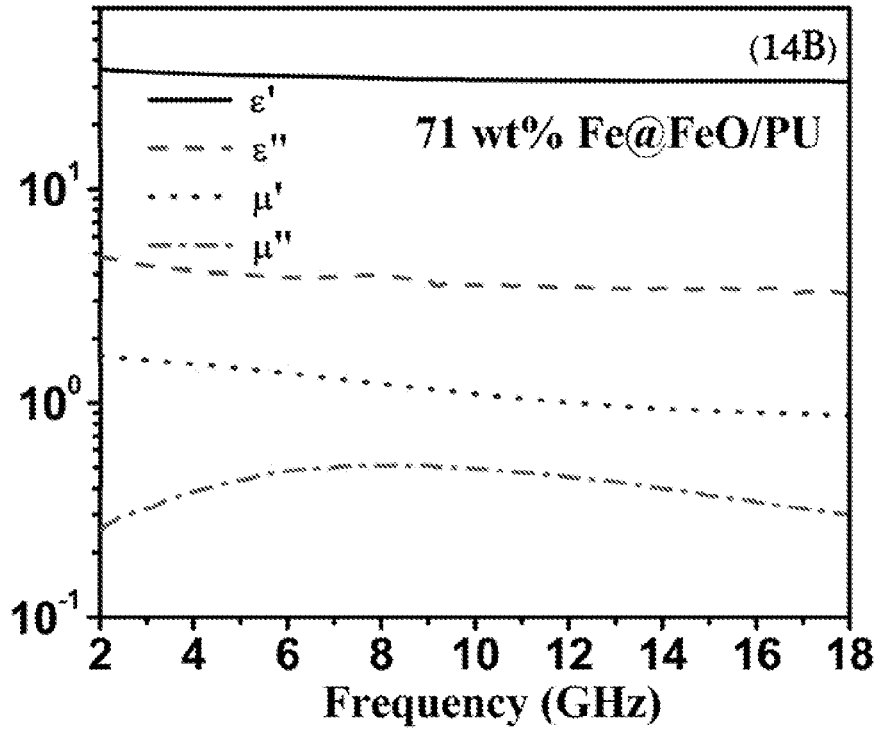

FIG. 14 shows the frequency dependent real part (∈') and imaginary part (∈") of the relative complex permittivity ($\in_r = \in' j\in''$), and real part (μ') and imaginary part (μ") of the relative complex permeability ($\mu_r = \mu' - j\mu''$) for the Fe—$SiO_2$ (FIG. 14(*a*)) and Fe—FeO (FIG. 14(*b*)), core-shell nanoparticles filled PU PNCs, respectively. The e value experiences a slight decrease within the frequency range of 2-18 GHz in both composite systems. The PNCs reinforced with Fe—$SiO_2$ particles show the ∈' between 11.5 and 12.5, while a significantly higher ∈' value of 31.8-36.3 is observed from the Fe—FeO/PU PNCs. Referring to FIG. 14(*a*), the ∈" shows a slight decrease with increasing frequency for both PNCs. It is interesting to observe that the μ' and μ" curves of both PNCs are quite similar to each other. The μ' value slightly decreases from 2 to 18 GHz, which is in the range of 1.53-1.02 and 1.66-0.88 for the Fe—$SiO_2$/PU and Fe—FeO/PU PNCs, respectively. This is favorable for microwave surface impedance match because the wavelength in the microwave absorber decreases with increasing the frequency.[49] The spectra of μ" show a convex curve, which is recognized as the frequency dispersion phenomena. The frequency dispersion of the PNCs is attributed to the magnetic resonance of the nanoparticles and domain wall turning.[22,49] The non-magnetic silica coating on the magnetic nanoparticles enhances the effective reluctance of the PNCs and thus results in the relatively weak frequency dispersion phenomena (relative flat curve of μ" in FIG. 14(*a*) than in FIG. 14(*b*).

Figure 15:
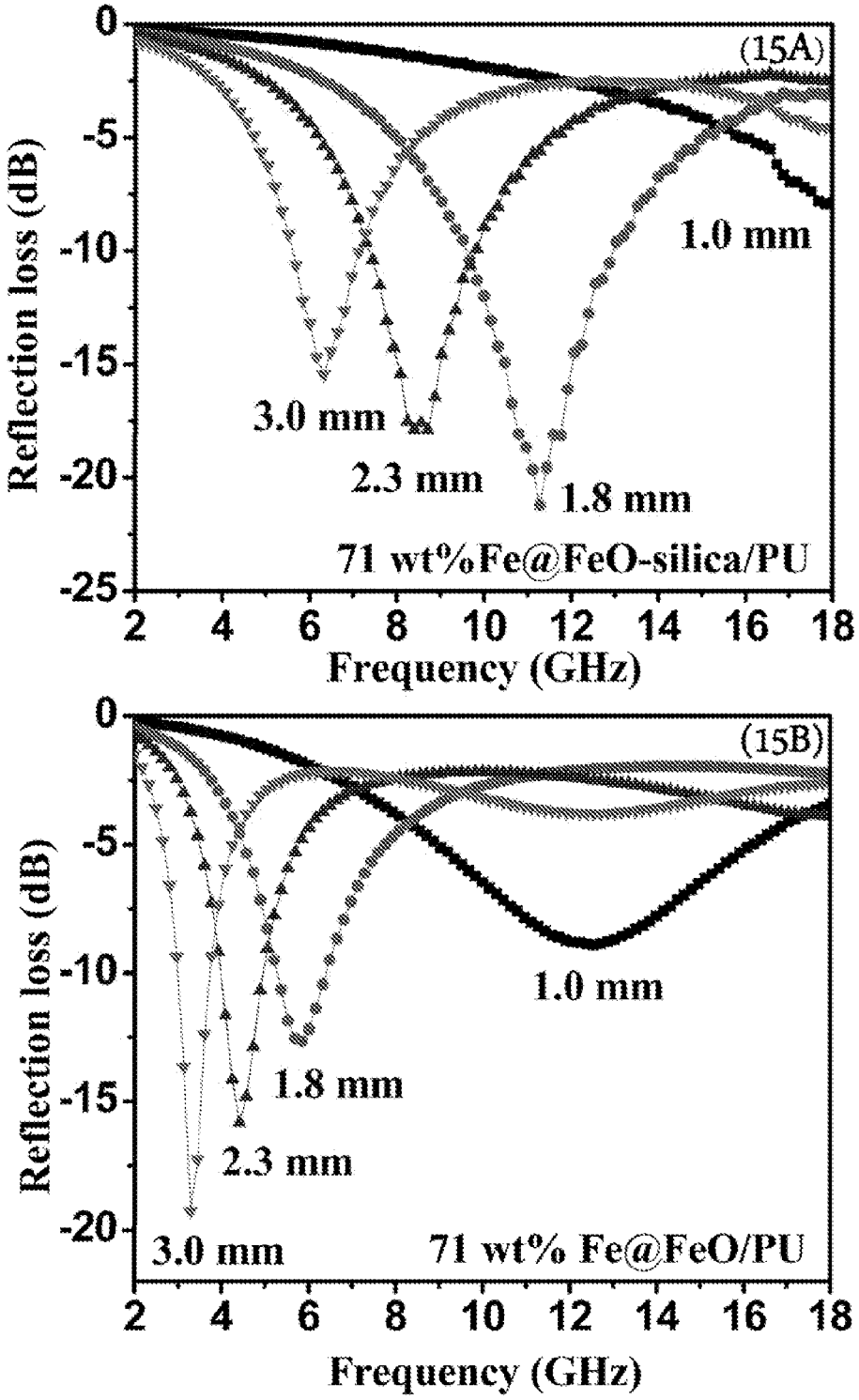
FIG. 15 shows dependence of RL on the thickness of absorption layer within a frequency range of 2-18 GHz (a) 71 wt % Fe@$SiO_2$/PU and (b) 71 wt % Fe@FeO/PU PNCs.
Figure 16:
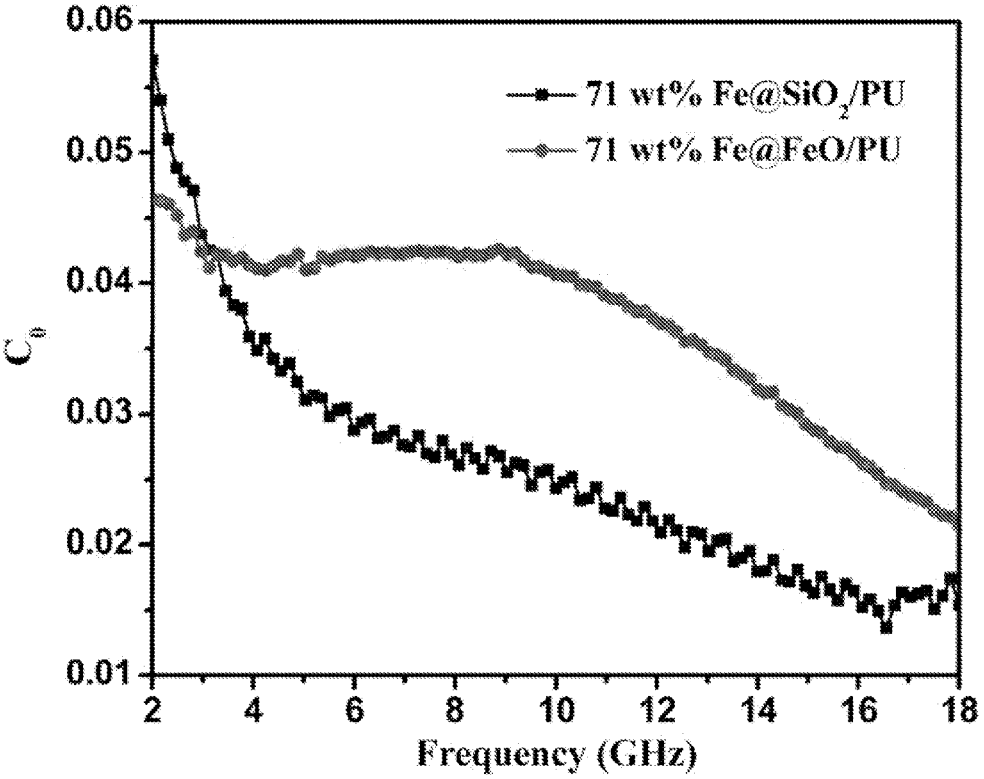
FIG. 16 shows $C_0$-f curves of Fe@$SiO_2$/PU and Fe@FeO/PU PNCs.

To acquire the microwave absorption properties, the MBRL is calculated according to transmission line theory.[50] The RL of EM radiation, under normal wave incidence at the surface of a single layer material backed by a perfect conductor, can be defined as:[51]

$$RL = 20\ \log_{10}\left|\frac{Z-1}{Z+1}\right| \quad (1)$$

where Z is the input impedance at the interface of free space and material, $$Z = \sqrt{\frac{\mu}{\varepsilon}}\tanh\left(-i\frac{2\pi fd}{c}\sqrt{\mu\varepsilon}\right) \quad (2)$$

where f is the frequency of the electromagnetic wave, d is the thickness of the absorbing material, ∈ and μ are the relative complex permittivity and permeability, and c is the velocity of electromagnetic waves in free space. Referring to FIG. 15, the RL of both the Fe—$SiO_2$/PU (top graph) and the Fe—FeO/PU PNCs (bottom graph) with the sample thickness varied from 1 to 3 mm is calculated. The maximum RL reaches −21.2 dB at 11.3 GHz for the Fe—$SiO_2$/PU absorber with a thickness of 1.8 mm. Moreover, the absorption bandwidth with the RL below −10 dB is up to 7.5 GHz (from 5.5 to 13.0 GHz). For the Fe—FeO/PU PNCs, the absorption bandwidth of RL below −10 dB is only 3.4 GHz (from 3.0 to 6.4 GHz) and the maximum RL is not able to reach −20 dB even when the absorber thickness is increased to 3 mm. Since the Fe—$SiO_2$/PU PNCs obtain the higher RL, a broader absorption bandwidth and a smaller absorber thickness than those of the Fe—FeO/PU PNCs, these Fe—$SiO_2$/PU PNCs are poised to be very promising for new types of EM wave absorptive materials. Based on the results observed above, it is indicated that the silica shell plays a positive role on the microwave absorption properties of the Fe—$SiO_2$/PU PNCs. The results are comparable to the results obtained from $Fe_3O_4$—$TiO_2$ core-shell nanotubes.[23] And the reasons can be explained from two aspects: the decrease of the eddy current effect and the increase of the anisotropy energy of the Fe—$SiO_2$ core-shell nanoparticles. For the ferromagnetic absorber, the EM absorption properties are usually subjected to degradation caused by the eddy current effect in the high frequency region. The eddy current loss can be expressed as follows: [52]

$$\mu'' \approx 2\pi\mu_0(\mu')^2\sigma\cdot d^2 f/3 \quad (3)$$

where σ ($S\cdot m^{-1}$) is the electrical conductivity and $\mu_0$ ($H\cdot m^{-1}$) is the permeability in vacuum. If the magnetic loss results from the eddy current loss effect, the values of $C_0$($C_0 = \mu''(\mu')^{-2}f^{-1}$) are constant when the frequency is changing. FIG. 16 shows the $C_0$-f curves of both Fe—FeO/PU and Fe—$SiO_2$/PU PNCs. For the Fe—FeO/PU PNCs, the value of $C_0$ is almost constant within the frequency range from 3 to 9 GHz, after that it decrease with increasing frequency. However, the Co decreases continuously from 2 to 16.5 GHz after coating silica on the Fe—FeO nanoparticles. This result implies that the Fe—FeO/PU PNCs have a significant eddy current effect, which is reduced after coating a silica layer on nanoparticles surface.

The other reason for the better microwave absorptive performance in the Fe—$SiO_2$/PU PNCs is ascribed to the enhanced anisotropic energy ($H_a$,), which can be expressed in as follows:

$$H_a = 4|K_1|/3\mu_0 M_s \quad (4)$$

where $|K_1|$ is the anisotropic coefficient. The $M_s$ value of the Fe—$SiO_2$/PU PNCs is about half of the Fe—FeO/PU PNCs, as shown in FIG. 12. Therefore, the anisotropic energy is higher for the Fe—$SiO_2$/PU PNCs. The higher anisotropic energy is helpful to the improvement of EM absorption properties especially at high frequency.[53-55]

Figure 17:
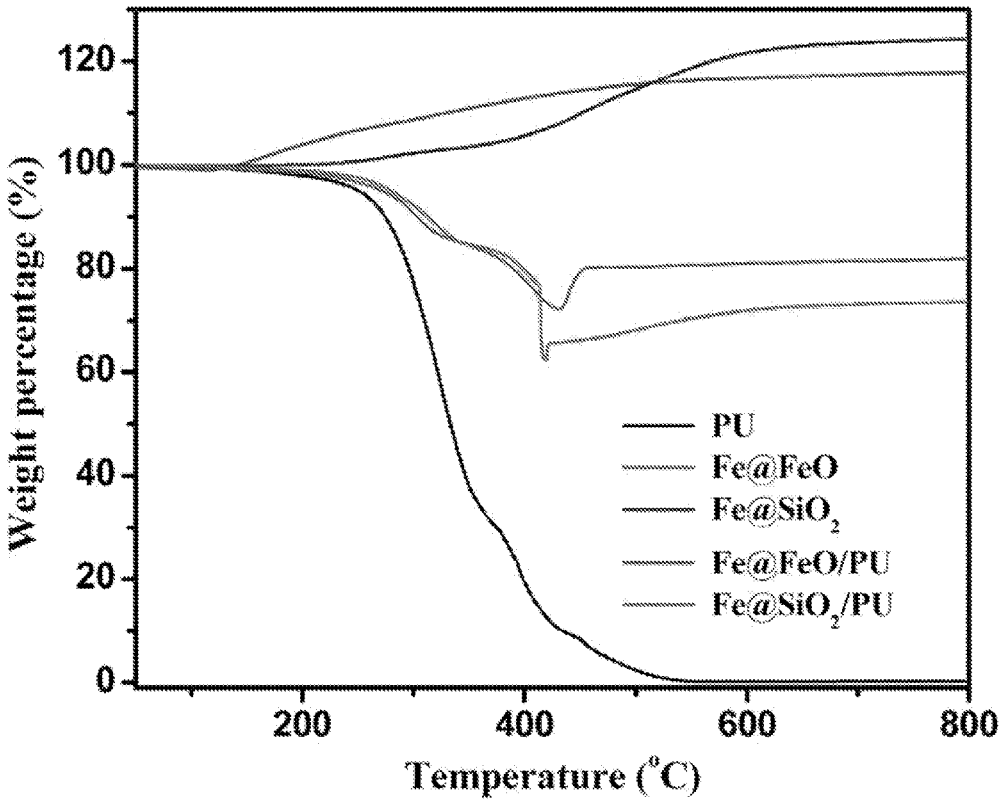
FIG. 17 shows a TGA curve of PNCs filled with different particles.

The thermal stability of the pure PU, Fe—FeO, Fe—$SiO_2$ and their composites is shown in FIG. 17. The pure PU began to decompose at around 250° C. and burns out at 550° C. Both nanoparticles exhibit a significant weight increase in the final stage owing to the oxidation in air at elevated temperatures. The Fe—FeO nanoparticles experience a slight weight loss at below 100° C., which is due to the adsorbed moisture on the particle surface. The weight of the nanoparticles begins to increase at ~130° C. After coating with a silica shell, the nanoparticles are protected and the oxidation temperature increases to about 215° C. The higher weight increase of the Fe—$SiO_2$ at high temperature range (500-800° C.) than that of Fe—FeO is primarily due to the reduction of FeO shell to Fe during the annealing process, and then the total oxygen content in iron oxide accounts for the final weight increase after oxidation. The similar weight increase induced by iron oxidation is also observed in the composites. Accompanied by the decomposition of PU, the degradation curves of composites are more complicated, especially within the temperature range of 300-500° C. The oxidation process for the Fe—FeO/PU is finished at ~460° C., which shows a flat curve afterward. However, after coating a silica layer, the oxidation process is much slower and the complete oxidation delayed to 650° C., which further confirms the protective behavior of the silica shell.

Figure 18:
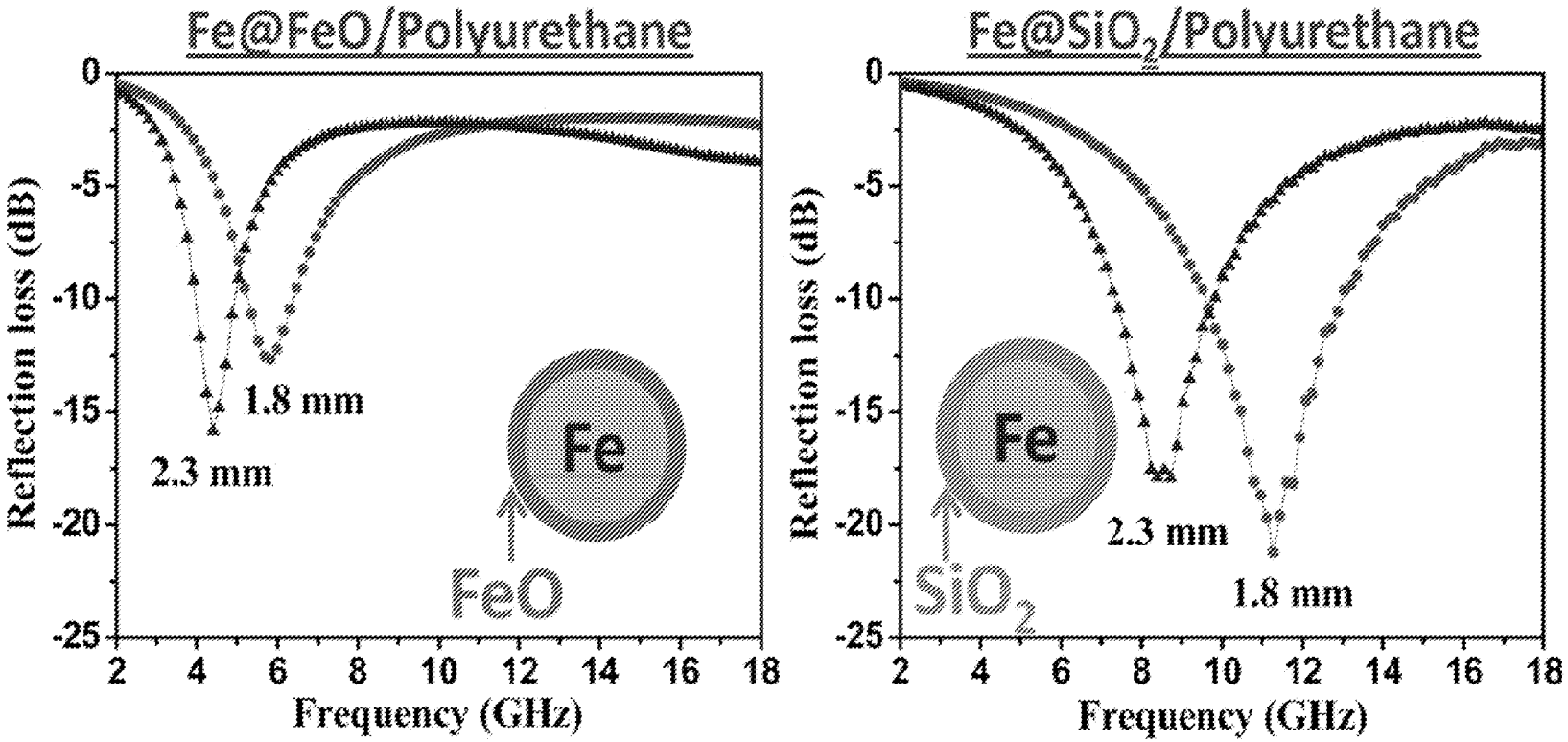
FIG. 18 shows EM shielding of nanocomposites in accordance with embodiments of the present invention.

In accordance with aspects of the present invention previously described, core-shell structured Fe—$SiO_2$ nanoparticles have been prepared using a modified Stöber method. The silica coated nanoparticles and the corresponding PNCs are more thermally stable based on the TGA results. The insulating silica layer on the magnetic particle surface is helpful to improve the resistivity of the PNCs, which is essentially important to acquire a high RL and broad absorption bandwidth for the microwave absorption. The silica shell greatly reduces the eddy current loss and increases the anisotropy energy, which are proved to be essentially important to acquire high RL and broad absorption bandwidth for the microwave absorption. Referring to FIG. 18, the Fe—$SiO_2$/PU PNC absorber with 1.8 mm thickness shows a good electromagnetic wave absorption performance (RL<−20 dB) at high frequency of 11.3 GHz, while the best RL of Fe—FeO/PU PNC absorber is still larger than −20 dB even increasing the absorber thickness to 3 mm.

REFERENCES (1) Al-Saleh, M. H.; Sundararaj, U. Carbon 2009, 47, 2-22.
(2) Zhu, J.; Wei, S.; Ryu, J.; Budhathoki, M.; Liang, G.; Guo, Z. J. Mater. Chem. 2010, 20, 4937-4948.
(3) Coleman, J. N.; Khan, U.; Blau, W. J.; Gun'ko, Y. K. Carbon 2006, 44, 1624-1652.
(4) Xu, Z.; Gao, C. Macromolecules 2010, 43, 6716-6723.
(5) RamanathanT; Abdala, A. A.; StankovichS; Dikin, D. A.; Herrera Alonso, M.; Piner, R. D.; Adamson, D. H.; Schniepp, H. C.; ChenX; Ruoff, R. S.; Nguyen, S. T.; Aksay, I. A.; Prud'Homme, R. K.; Brinson, L. C. Nat. Nano. 2008, 3, 327-331.
(6) Zhu, J.; Wei, S.; Zhang, L.; Mao, Y.; Ryu, J.; Karki, A. B.; Young, D. P.; Guo, Z. J. Mater. Chem. 2011, 21, 342-348.
(7) Zhu, J.; Wei, S.; Zhang, L.; Mao, Y.; Ryu, J.; Mavinakuli, P.; Karki, A. B.; Young, D. P.; Guo, Z. J. Phys. Chem. C 2011, 114, 16335-16342.
(8) Duquesne, S.; Jama, C.; Le Bras, M.; Delobel, R.; Recourt, P.; Gloaguen, J. M. Compos. Sci. Technol. 2003, 63, 1141-1148.

(9) Uhl, F. M.; Morgan, A. B.; Wilkie, C. A. Chem. Mater. 2001, 13, 4649-4654.
(10) Toneguzzo, P.; Viau, G.; Acher, O.; Fiévet-Vincent, F.; Fievet, F. Adv. Mater. 1998, 10, 1032-1035.
(11) Guo, Z.; Lee, S. E.; Kim, H.; Park, S.; Hahn, H. T,; Karki, A. B.; Young, D. P. Acta Mater, 2009, 57, 267-277.
(12) Wang, F.; Liu, J.; Kong, J.; Zhang, Z.; Wang, X.; Itoh, M.; Machida, K. J. Mater. Chem. 2011, 21, 4314-4320.
(13) Chiu, S.-C.; Yu, H.-C.; Li, Y.-Y. J. Phys. Chem. C 2010, 114, 1947-1952.
(14) Yang, Y.; Gupta, M. C.; Dudley, K. L.; Lawrence, R. W. Nano Lett. 2005, 5, 2131-2134.
(15) Fan, Z.; Luo, G.; Zhang, Z.; Thou, L.; Wei, F. Mater. Sci. Eng., B 2006, 132, 85-89.
(16) Sang-Eui Lee; Oyoung Choi; Hahn, H. T. J. Appl. Phys. 2008, 104, 033705.
(17) Wang, C.; Han, X.; Xu, P.; Zhang, X.; Du, Y.; Hu, S.; Wang, J.; Wang, X. Appl. Phys. Lett. 2011, 98, 072906.
(18) Barber, P.; Balasubramanian, S.; Anguchamy, Y.; Gong, S.; Wibowo, A.; Gao, H.; Harry J. Ploehn; Loye, H.-C. z. Materials 2009, 2, 1697-1733.
(19) Abbas, S. M.; Dixit, A. K.; Chatterjee, R.; Goel, T. C. Mater. Sci. Eng., B 2005, 123, 167-171.
(20) Azough, F.; Freer, R.; Wang, C. L.; Lorimer, G. W. J. Mater. Sci. 1996, 31, 2539-2549.
(21) Haijun, Z.; Zhichao, L.; Chengliang, M.; Xi, Y.; Liangying, Z.; Mingzhong, W. Mater. Sci. Eng., B 2002, 96, 289-295.
(22) Singh, P.; Babbar, V. K.; Razdan, A.; Srivastava, S. L.; Goel, T. C. Mater. Sci. Eng., B 2000, 78, 70-74.
(23) Zhu, C.-L.; Zhang, M.-L.; Qiao, Y.-J.; Xiao, G.; Thang, F.; Chen, Y.-J. J. Phys. Chem. C 2010, 114, 16229-16235.
(24) Yoshida, S.; Sato, M.; Sugawara, E.; Shimada, Y. J. Appl. Phys. 1999, 85, 4636.
(25) Snoek, J. L. Physica 1948, 14, 207-217.
(26) Zhu, J.; Wei, S.; Li, Y.; Sun, L.; Haldolaarachchige, N.; Young, D. P.; Southworth, C.; Khasanov, A.; Luo, Z.; Guo, Z., Macromolecules 2011, 44, 4382-4391.
(27) Chikazumi, S. Physics of Magnetism, Krieger, Boca Raton, Fla., 1998.
(28) Sun, X.-C.; Nava, N. Nano Lett. 2002, 2, 765-769.
(29) Thang, X. F.; Dong, X. L.; Huang, H.; Lv, B.; Lei, J. P.; Choi, C. J. J. Phys. D: Appl. Phys. 2007, 40 5383.
(30) Graf, C.; Vossen, D. L. J.; Imhof, A.; van Blaaderen, A. Langmuir 2003, 19, 6693-6700.
(31) Kobayashi, Y.; Katakami, H.; Mine, E.; Nagao, D.; Konno, M.; Liz-Marzán, L. M. J. Colloid Interface Sci. 2005, 283, 392-396.
(32) Santra, S.; Tapec, R.; Theodoropoulou, N.; Dobson, J.; Hebard, A.; Tan, W. Langmuir 2001, 17, 2900-2906.
(33) Lu, Y.; Yin, Y.; Mayers, B. T.; Xia, Y. Nano Lett. 2002, 2, 183-186.
(34) Guo, X.; Deng, Y.; Gu, D.; Che, R.; Zhao, D. J. Mater. Chem. 2009, 19, 6706-6712.
(35) Ni, X.; Zheng, Z.; Hu, X.; Xiao, X. J. Colloid Interface Sci. 2010, 341, 18-22.
(36) Guo, Z.; Park, S.; Hahn, H. T.; Wei, S.; Moldovan, M.; Karki, A. B.; Young, D. P. J. Appl. Phys. 2007, 101, 09M511.
(37) Stöber, W.; Fink, A.; Bohn, E. J. Colloid Interface Sci. 1968, 26, 62-69.
(38) Nicolson, A. M.; Ross, G. F. IEEE Trans. Instrum. Meas. 1970, IM-19, 377-382.
(39) Nicolson, A. M.; Ross, G. F. IEEE Trans. Instrum. Meas. 1968, 17, 395-402.
(40) Wood, J. H. Phys. Rev. 1962, 126, 517.
(41) Bagayoko, D.; Callaway, J. Phys. Rev. B 1983, 28, 5419.
(42) Zhu, J.; Wei, S.; Rya, J.; Sun, L.; Luo, Z.; Guo, Z. ACS Appi. Mater. Interfaces 2010, 2, 2100-2107.
(43) Guo, Z.; Lei, K.; Li, Y.; Ng, H. W.; Prikhodko, S.; Hahn, H. T. Compos. Sci. Technol. 2008, 68, 1513-1520.
(44) Guo, Z.; Lin, H.; Karki, A. B.; Wei, S.; Young, D. P.; Park, S.; Willis, J.; Hahn, T. H. Compos. Sci. Technol. 2008, 68, 2551-2556,
(45) Kim, H.; Miura, Y.; Macosko, C. W. Chem. Mater, 2010, 22, 3441-3450.
(46) Kirkpatrick, S. Rev. Mod. Phys. 1973, 45, 574.
(47) Zallen, R. The Physics of Amorphous Solids. New York: Wiley, 1983,
(48) Sze, S. M. Physics of semiconductor devices. Wiley Eastern Ltd, 1981.
(49) Yang, Y.; Zhang, B.; Xu, W.; Shi, Y.; Zhou, N.; Lu, H. J. Magn. Magn. Mater. 2003, 265, 119-122.
(50) Miles, P. A.; Westphal, W. B.; Von Hippel, A. Rev. Mod. Phys. 1957, 29, 279.
(51) Michielssen, E. S., J.; Ranjithan, S.; Mittra, R. IEEE Trans. 1993, 41, 1024-1030.
(52) Wu, M.; Zhang, Y. D.; Hui, S.; Xiao, T. D.; Ge, S.; Hines, W. A.; Budnick, J. I.; Taylor, G. W. Appi. Phys. Lett. 2002, 80, 4404.
(53) Che, R. C.; Zhi, C. Y.; Liang, C. Y.; Thou, X. G. Appl. Phys. Lett. 2006, 88, 033105.
(54) Liu, X. G.; Geng, D. Y.; Meng, H.; Shang, P. J.; D., Z. Z. Appl. Phys. Lett. 2008, 92, 173117
(55) Che, R. C.; Peng, L. M.; Duan, X. F.; Chen, Q.; Liang, X. L. Adv. Mater. 2004, 16, 401-405.

Aspects of the present invention further provide silica stabilized iron particles toward anti-corrosion magnetic polyurethane nanocomposites. A sol-gel method may be used to introduce fluorescent silica shells with tunable thickness on spherical carbonyl iron particles ("CIP") by a combined hydrolysis and condensation of tetraethyl orthosilicate ("TEOS"). Both gelatin B and 3-aminopropyltriethoxysilane ("APTES") may be used as primers to render the metal particle surface compatible with TEOS. The silica shell may be formed through the hydrolysis and condensation of TEOS on the primer-treated CIP, and the shell thickness may be controlled by varying the ratio of chemicals (such as TEOS and ammonia). The silica shell on the particle surface may be confirmed by Fourier transform infrared spectroscopy ("FT-IR"), thermogravimetric analysis ("TGA"), and/or transmission electron microscopy ("TEM"). The magnetic and anti-corrosive properties of the CIP and CIP-silica particles have been evaluated. A conformal coating shell is confirmed surrounding the CIP against their etching/dissolution by protons. Polyurethane composites filled with CIP and CIP-silica particles may be fabricated with a surface initialized polymerization ("SIP") method. A salt fog industrial-level test indicates an improved anti-corrosive behavior of the CIP-silica/PU composites than that of the CIP/PU composites. Both CIP-silica particles and OP-silica/PU composites exhibit better thermal stability and antioxidation capability than their CIP and CIP/PU counterparts, respectively, due to the stronger barrier effect of the noble silica shell. The insulating silica shell decreases the efficiency of the electron transportation among the particles and thus leads to a higher resistivity in the composites.

Surface coating of magnetic particles with various materials to form core-shell structures results in new hybrid materials, which can be used as magnetic resonance imaging (MRI) contrast agents,[1] and in the fields of magnetically guided site specific drug delivery,[2, 3] magnetic separation of cells and biocomponents,[4, 5] and environmental remediation.[6, 7] Numerous technical applications require magnetic particles embedded in a nonmagnetic matrix or coated with a uniform nonmagnetic layer.[8-12] Encapsulating magnetic particles with silica is a promising and important approach in the development of magnetic materials for biomedical applications.[13, 14] For magnetoelectronic applications, silica-coated particles may be used to form ordered arrays with a controlled interparticle magnetic coupling through tuning the silica shell thickness.[15]

The reported silica coating techniques may be performed with a well-known Stöber process, in which silica is formed in-situ through the hydrolysis and condensation of a sol-gel precursor.[16] It was firstly applied to rod-like magnetic $\gamma$-$Fe_2O_3$ nanoparticles (NPs),[17] and then to micrometer-sized hematite ($Fe_2O_3$) colloids[18] and other nanoparticles such as gold[19] and silver.[20] The silica coating technologies surrounding the particles can be divided into two categories according to whether a primer is introduced or not before adding the silica precursor. Wang et al.[21] have demonstrated that silica will not adhere to the metal particles if the silica sol is prepared in the presence of the metal particles alone. However, silica may be successfully coated on the iron surface if gelatin is used as a priming agent to modify the iron particle (~1 μm) surface. Fu et al.[22] introduced 3-mercaptopropyltrimethoxysilane as a surface primer to functionalize cobalt nanoparticles, and then used the Stöber process to obtain silica coatings with different thicknesses. Xia et al.[23] reported that $\gamma$-$Fe_2O_3$ and $Fe_3O_4$ could be directly coated with amorphous silica because the iron oxide surface has a strong affinity toward silica, no primer is required to promote the deposition and adhesion of silica.

Polymer nanocomposites (PNCs), combining the characteristics of parent constituents into a single specimen, have wide and promising applications arising from their tunable unique mechanical, magnetic and electrical properties,[24-26] cost-effective processability, and light weight. Elastomeric polyurethane with unique properties has received wide attention for their various applications.[27-29] Polyurethane nanocomposites with enhanced thermal stability and improved mechanical and electrical properties have demonstrated excellence as structural and functional materials.[30-32] For polymer composites filled with metallic fillers, corrosion is the major concern especially when exposed to harsh environments, such as high temperature, humidity and even in corrosive sodium chloride solution.[33, 34] To maintain the physical properties of these composites, a stable coating material may be used to protect the metal fillers against oxidation/dissolution. Silica is may be preferred against the other coating materials due to its chemical inertness, optical transparency, and easily tunable surface functionalities due to the terminated silanol group, which can react with various coupling agents.[35-37]

Figure 19:
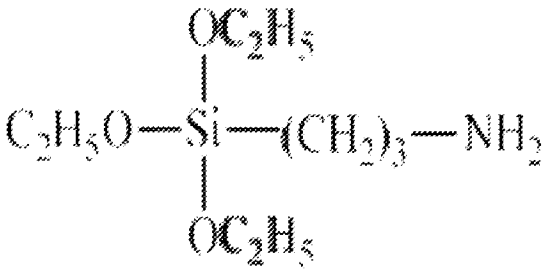
FIG. 19 shows chemical structures of (a) APTES, (b) gelatin, and (c) TEOS.
Figure 19:
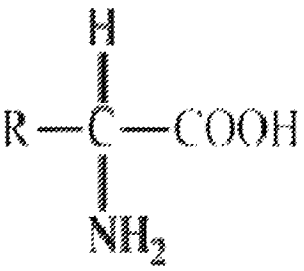
Figure 19:
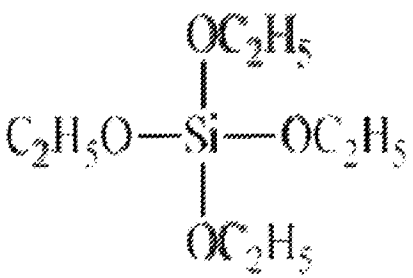

Exemplary Materials: Carbonyl iron particles were commercially obtained from BASF Group (e.g., 99.5 wt % Fe with a size range of 2-5 μm). 3-aminopropyltriethoxysilane (APTES) (e.g., with a purity of 99%) and gelatin (e.g., type B) were commercially obtained from Sigma-Aldrich, which can be used as primers to promote the deposition and adhesion of silica on CIP. Tetraethyl orthosilicate (TEOS) (e.g., with a purity of 99+%) was commercially obtained from Alfa Aesar. The chemical structures of APTES, gelatin, and TEOS are shown in FIG. 19. Ammonia (e.g., 28%, lab grade), ethanol (e.g., 99%), and tetrahydrofuran (THF, e.g., 99%) were commercially obtained from Fisher Scientific.

Figure 20:
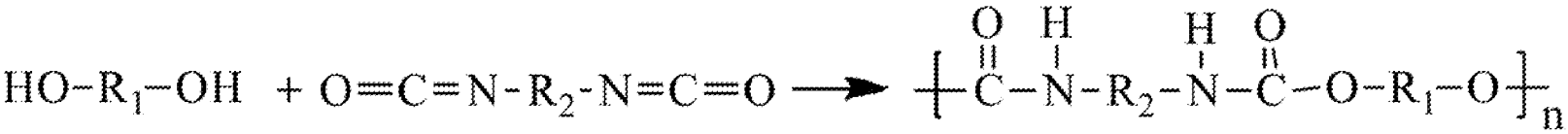
FIG. 20 shows synthesis of PU.

The monomers for the polyurethane were commercially obtained from PRC-Desoto international, Inc, which contains three parts. Part A and C are accelerators, and part B is the base compound. The chemical reaction to form the polyurethane is shown in FIG. 20.

Figure 21:
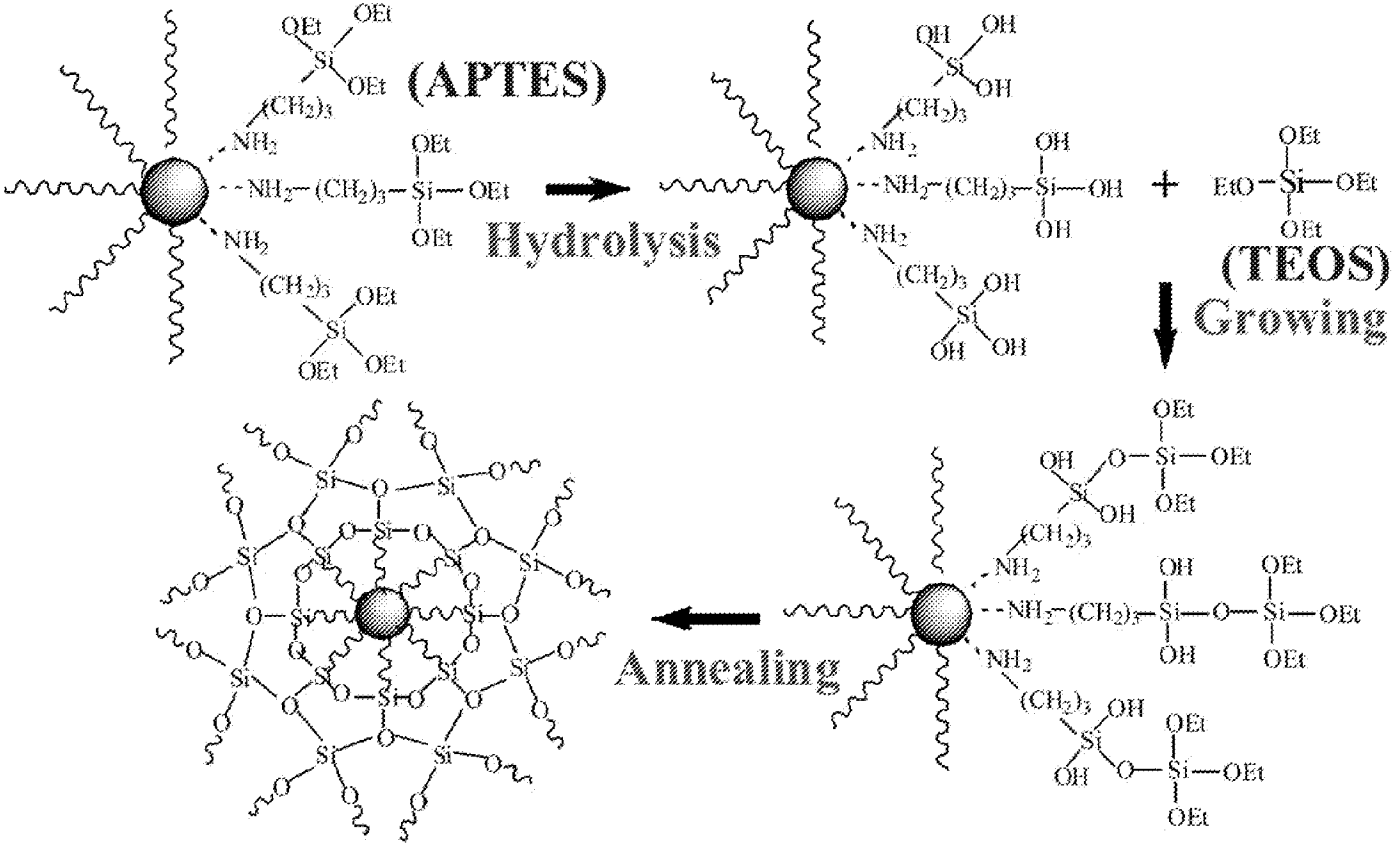
FIG. 21 shows silica coating growth on a particle surface in accordance with embodiments of the present invention.

Referring to the exemplary silica coating process illustrated in FIG. 21, CIP (e.g., 3.0 g) was dispersed in ethanol (e.g., 120 mL) (or an alternative solvent) containing APTES (e.g., 0.4 mL). After mixing (e.g., 30 minutes of sonication), the obtained suspension may be allowed to age (e.g., for 1 hour) to ensure a complete complexation reaction between the amine groups of APTES and CIP surface. To investigate the primer effect on the final shell morphology, gelatin B (e.g., 1 wt %, 20 mL solution) may be also used to functionalize the CIP surface. The CIP may be coated with a uniform layer of silica by a modified Stöber process.[16] The suspension may be stirred (e.g., vigorously mechanically at 500 rpm). Different amounts of TEOS (e.g., 1.8 or 5 mL) and ammonia (e.g., 12 or 16 mL) may be used in the reaction system to control growth of the silica shell thickness. TEOS may be injected (e.g., rapidly) into the suspension and followed by an addition of ammonia (e.g., dropwise for about 5 minutes). The reaction may be continued (e.g., for 5 hours and then the powders separated from the mother liquid (e.g., using a magnet). The powders may be washed (e.g., with ethanol and DI water several times) and then dried (e.g., in a vacuum oven overnight at room temperature) to obtain the core-shell CIP-silica particles (also referred to herein as "CIP-silica"). The annealing of CIP-silica (e.g., at 650° C. for 2 hours under $H_2$/Ar atmosphere (e.g., hydrogen ratio: 5%)), implements the reaction from TEOS to silica and reduces the iron oxides.

In an exemplary process, the CIP (e.g., 7.0 g) may be mixed with a diluted mixture solution (e.g., containing accelerator part A (0.36 g), catalyst part C (0.40 g) and THF (20.0 mL)), followed by mixing (e.g., 1-hour sonication at room temperature) to enable the adsorption of accelerator part A and catalyst part C on the CIP surface. And then monomer part B (e.g., 2.24 g) may be added to the suspension and mechanically stirred together (e.g., at 200 rpm in an ultrasonic bath for one hour at 50° C.). The suspension becomes more viscous as the reaction proceeds. The viscous suspension may be transferred into a mold (e.g., and maintained at room temperature for an additional 7 days) to promote a complete reaction and solvent evaporation. Composites with similar loading of CIP-silica (e.g., shell thickness: 55 nm) may be fabricated following similar procedures. A CIP-silica/PU composite thin film (e.g., thickness: ~10 μm) on a glass slide may also be prepared from the THF-diluted composite solution by using the drop casting method.

Fourier transform infrared spectroscopy (FT-IR, Bruker Inc. Vector 22, coupled with an ATR accessory) was used to characterize the bare and silica-coated CIP in the range of 500 to 4000 $cm^{-1}$ at a resolution of 4 $cm^{-1}$. The core-shell structure of the CIP-silica was examined by a transmission electron microscopy (TEM, FEI Tecnai G2 F20) with a field emission gun at a working voltage of 200 kV. The samples were prepared by drying a drop of particles suspended ethanol solution on the carbon-coated copper TEM grids. All images were recorded as zero-loss images by excluding the contributions of the inelastically scattered electrons using a Gatan Image Filter.

The fluorescence images were obtained using Olympus DP72 camera accompanied with Olympus CellSens software. The samples were prepared by immobilizing the particles on a glass slide to form thin film ready for observation. A cover glass was placed on the slide with a drop of water and sealed. The slides were visualized under different objectives of an Olympus BX51 fluorescence microscope.

The thermal stability of the CIP, CIP-silica, and their corresponding polyurethane composites was studied with a thermogravimetric analysis (TGA, TA Instruments Q-500). TGA was conducted on these samples from 25 to 800° C. with an air flow rate of 60 in L/min and a heating rate of 10° C./min.

The anti-corrosion behavior of the CIP and CIP-silica was studied by immersing these particles in 1.0 M HCl to compare the durability. Additional stability measurements on the PU composites were carried out according to ASTM B 117. Briefly, the specimens were supported between 15° and 30° from vertical and preferably parallel to the principle direction of the fog flow in the chamber, based upon the dominant surface being tested. The fog was such that for each 80 $cm^2$ of the horizontal collecting area, there would be 1.0 to 2.0 mL collected solution per hour. The salt fog was continuously supplied with an exposure period of one week. The salt solution was prepared by dissolving 5±1 parts by mass of sodium chloride in 95 parts of Type IV water, as required by the standard ASTM B117. The pH of the collected solution was from 6.5 to 7.2. The exposure zone of the salt spray chamber was maintained at 35±2° C.

A high resistance meter (Agilent 4339B) equipped with a resistivity cell (Agilent, 16008B) was used to measure the volume resistivity after inputting the sample thickness. This equipment allows resistivity measurement up to $10^{16}\Omega$. The source voltage was set at 0.1 V for all the samples. The reported results represent the mean value of eight measurements with a deviation less than 10%. The magnetic properties of the particles and composites were carried out in a 9 T physical properties measurement system (PPMS) by Quantum Design at room temperature.

Figure 22:
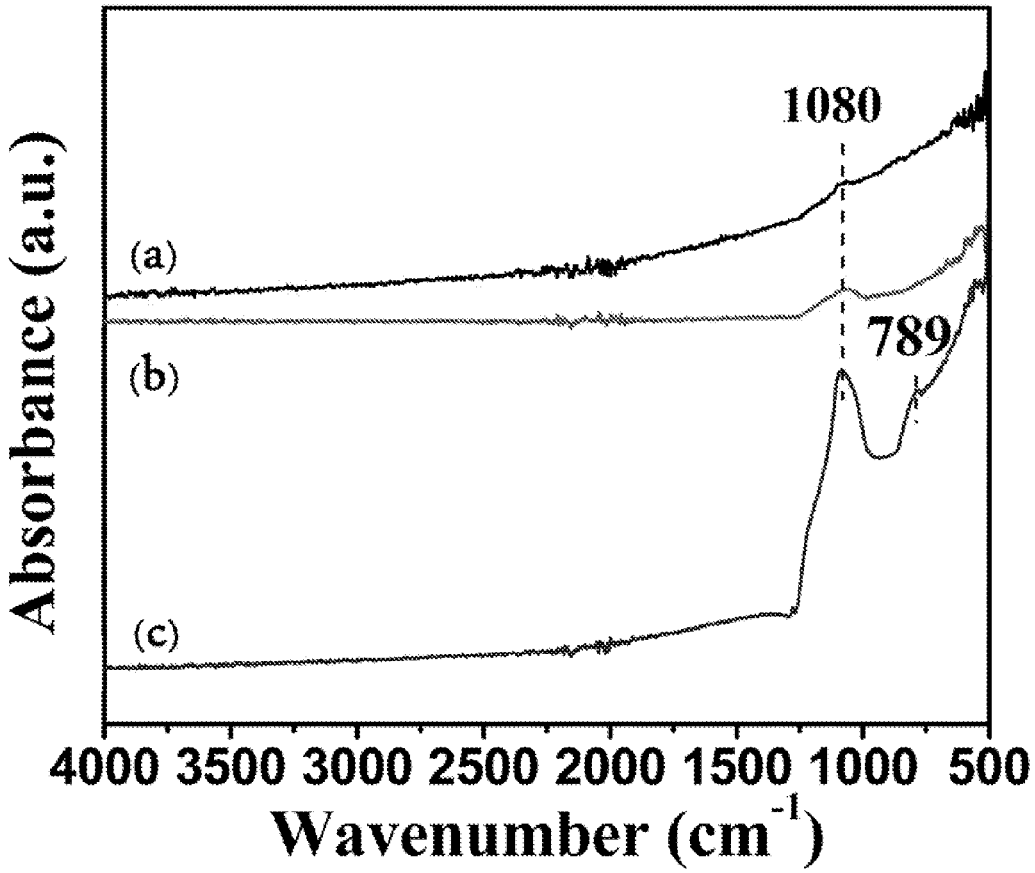
FIG. 22 shows FT-IR of the particles (a) CIP, (b) CM-silica, and (c) CIP-silica after annealing.

FIG. 22 shows the FT-IR spectra of the (a) as-received CIP, (b) as-prepared CIP-silica, and (c) CIP-silica after annealing (e.g., at 650° C. for 2 hours under $H_2$/Ar atmosphere). The intensified band strength at 1080 $cm^{-1}$ in spectra (b) and (c) as compared to (a) originates from the asymmetric stretching of Si—O—Si bond of silica.[38,39] And the new peak at 789 $cm^{-1}$ on curve (c) is attributed to the symmetric stretching of Si—O—Si bond after annealing.[40] This results indicate that $SiO_2$ is immobilized on the CIP surface.

Figure 23:
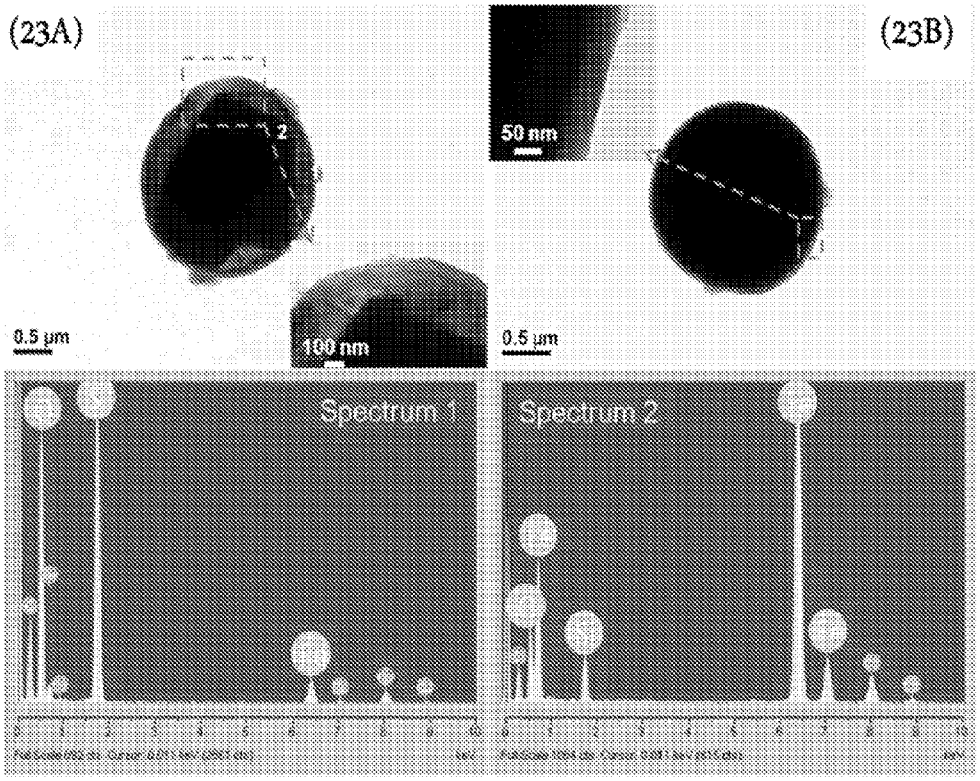
FIG. 23 shows TEM images and EDAX of core-shell structured particles with a (*a*) non-sphere core and (*b*) sphere core CIP particle.

FIG. 23 shows the morphology of CIP-silica core-shell structured particles derived from non-spherically and spherically shaped CIP. Both types of CIP particles were observed to obtain a final spherical structure after coating with silica, which is due to the silica shell growth towards the lowest surface energy. It is worth noting that the shell is a compact solid rather than a porous structure. Referring to FIGS. 23(*a*)-(*b*), the elemental analysis at selected areas marked "1" and "2" is shown in Spectrum 1 and 2, respectively. The element analysis of the $SiO_2$ shell components is confirmed by the strong peak of Si and O in Spectrum 1. Meanwhile, a small Fe peak shows at around 6.4 keV. In Spectrum 2, the major component is Fe accompanied with small amounts of Si and O taking from the front side of the shell in area "2".

Figure 24:
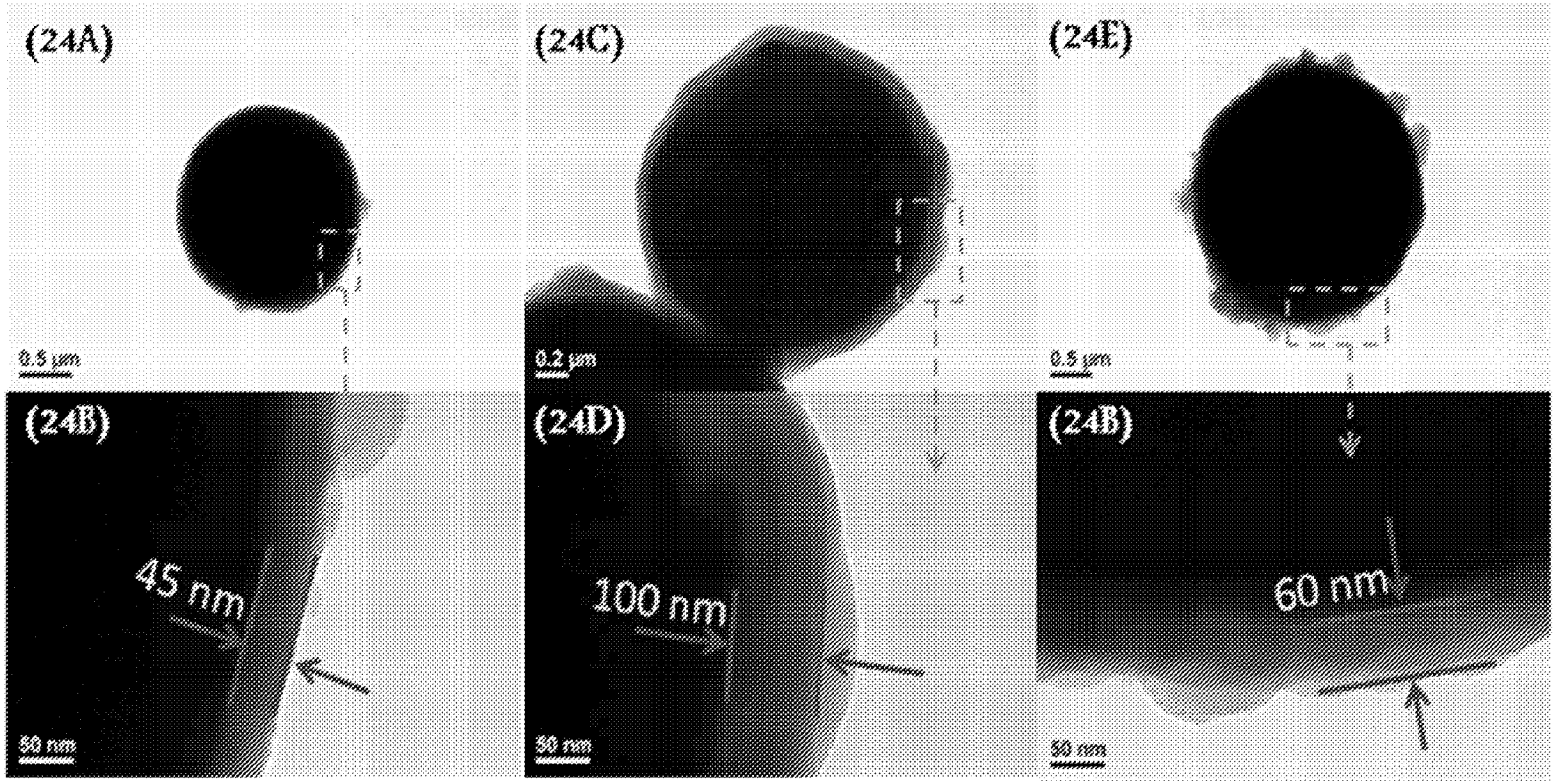
FIG. 24 shows CIP-silica with different shell thicknesses and morphologies.

FIGS. 24(*a*)-(*d*) show the smooth CIP-silica surface using APTES as surfactant. The thickness of the silica shell can be controlled by adjusting the concentrations of TEOS and ammonia. The ammonia concentration is observed to be more appreciable in controlling the thickness than TEOS. FIGS. 24(*a*)-(*b*) show the silica shell with a thickness of about 45 nm grown using 5 mL TEOS and 12 mL ammonia. By reducing the TEOS to 1.8 mL and increasing the ammonia to 16 mL, the shell thickness is increased to around 100 nm as shown in FIGS. 24(*c*)-(*d*). As shown in FIGS. 24(*e*)-(*f*), the shell morphology is relatively rough with an average thickness of around 60 nm while using gelatin rather than APTES as the surfactant. Only the functional amine group of APTES interacts with the particle surface[21] and the tail group (—$Si(OEt)_3$) of APTES will form more ordered patterns on the particle surface. Moreover, as shown in FIG. 19, the structural similarity between the tail group (—$Si(OEt)_3$) of APTES and TEOS (the shell precursor) will favor subsequent uniform silica shell formation. However, gelatin has three different active sites in each molecule, which can be complexed with the iron particles. Therefore, it is more difficult to form a patterned structure using gelatin alone. In addition, the different terminal groups provide the possibility for TEOS to grow selectively on some specific sites and thus form a rough structure.

Figure 25:
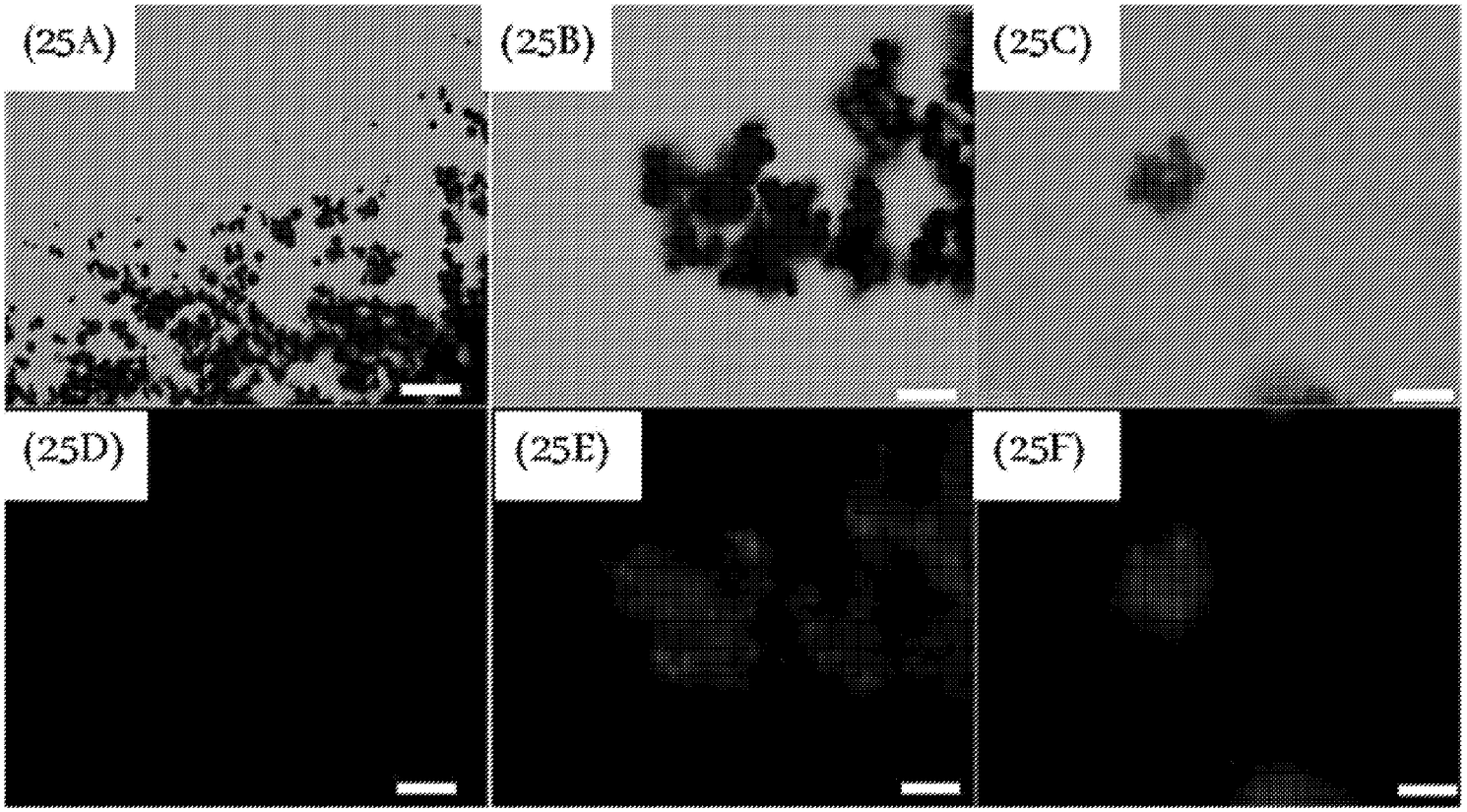
FIG. 25 shows bright field fluorescence microscopy images of (*a*) CIP, (*b*) CIP-silica, and (*c*) CIP-silica/PU film ((*d*)-(*f*) correspond to (*a*)-(*c*) in dark field) (the scale bar is 10 μm).

Referring to FIG. 25, the fluorescence images of the particles and composite thin films, taken in both bright field and dark field are compared. FIGS. 25(*a*)-(*c*) show the CIP, CIP-silica, and CIP-silica/PU thin film in bright field, and the particles are aggregated, especially after coating with a silica layer. Referring to FIG. 25(*d*), in the dark field, the CIP did not show any emission signal, indicating that bare CIP are not fluorescent active as expected. After coating a silica layer on the CIP surface, red emission is observed from the CIP-silica, as shown in FIG. 25(*e*). Referring to FIG. 25(*f*), embedding the CIP-silica in the PU thin film, the red emission signal is still observed in the composites thin film, which indicates that the processing condition would not affect the optical properties of the particles.

Figure 26:
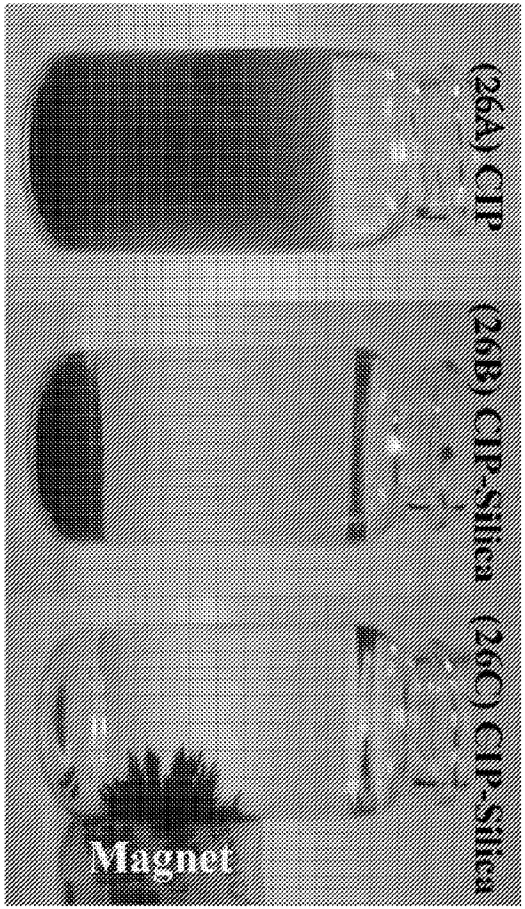
FIG. 26 shows a corrosion test of (*a*) CIP and (*b*) CIP-silica in 1 M HCl, and (c) the CIP-silica attracted by a magnet after a 4 hour test.

FIGS. 26(*a*)-(*b*) show the images of the CIP and CIP-silica particles immersed in 1 M HCl aqueous solution. The pure CIP react with the HCl acid solution immediately formed hydrogen bubbles, as shown in FIG. 26(*a*). The solution turns green due to the formation of $FeCl_2$ after the reaction. In contrast, the CIP-silica is stable in the HCl solution and precipitates to the bottom of the glass vial, as shown in FIG. 26(*b*). After 4-hour immersion, the CIP-silica is still stable in the HCl solution, which can be easily attracted by a magnet, as shown in FIG. 26(*c*). These observations indicate that CIP are protected from $H^+$ ions by a compact solid rather than porous silica shell. This protective behavior may come from the thin $Fe_2SiO_4$ layer surrounding the Fe metallic core, which is found during the thermal reduction of iron oxide nanoparticles encapsulated in polydisperse silica particles.[41] This protective layer produced in the silica matrix is responsible for the high stability against corrosion of the core-shell particles.

Figure 27:
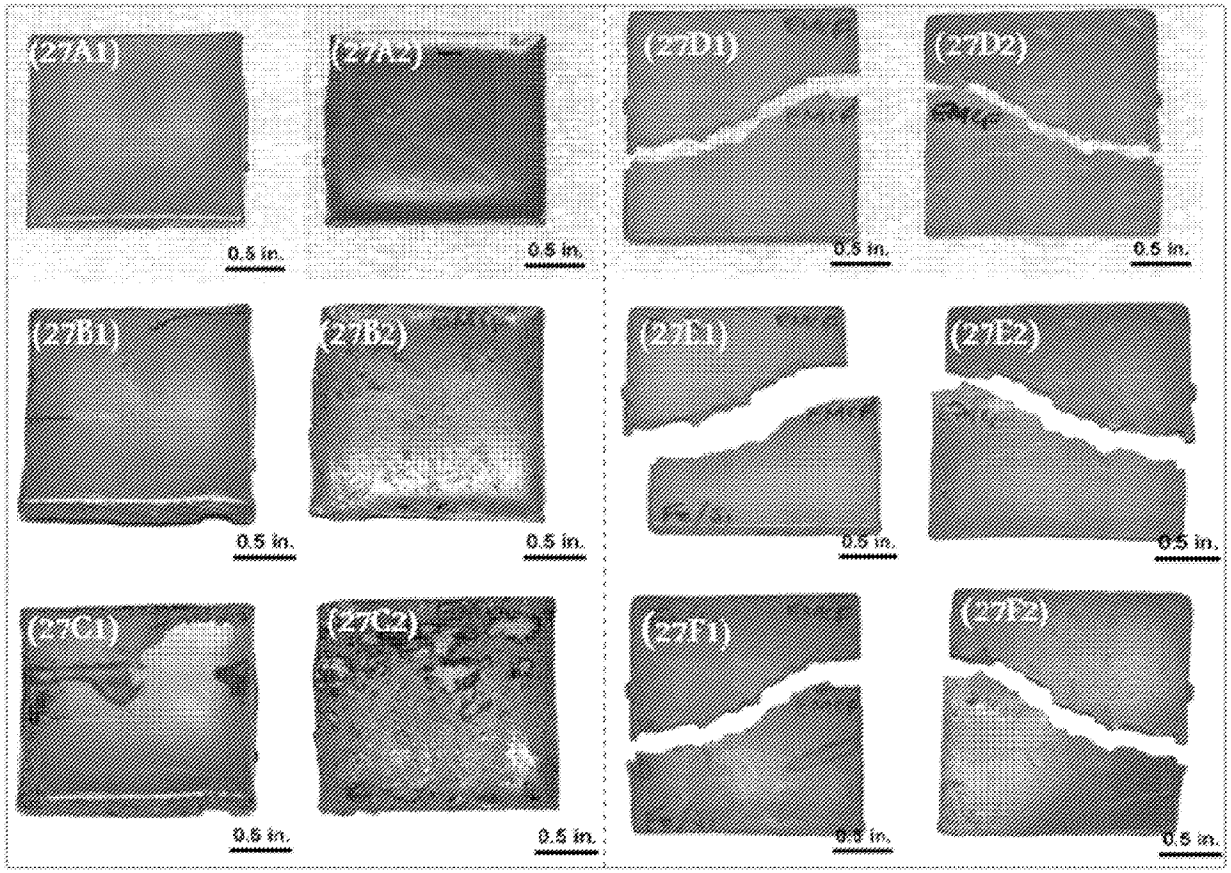
FIG. 27 shows salt fog exposure tests on 88 wt % CIP/PU and 88 wt % CIP-silica/PU composites, wherein A, B, and C represent the CIP/PU composites under the condition of pre-salt fog exposure, 48 hours exposure and one week exposure, respectively, and wherein D, E, and F represent the CIP-silica/PU composites tested under the same conditions of pre-salt fog exposure, 48 hours exposure and one week exposure, respectively, and wherein 1 and 2 represent the two sides of the sample.

FIG. 27 shows the CIP and CIP-silica reinforced polyurethane composites after corrosion test with spraying salt fog. Samples A1 and A2 are two sides of the polyurethane composites filled with CIP. After exposing the sample to the salt fog for 48 hours, rust is evident in samples B1 and B2, especially on the B2 side. The rust is more pronounced after one week exposure. Sample C2 shows serious corrosion with large area of rust. The observed anti-corrosive difference between the two sides of a test sample probably arises from the precipitation of CIP during the curing process. The anti-corrosive performance of the CIP-silica/PU composites has been significantly improved, as shown in samples D to F. After 48-hour exposure to the salt fog, no obvious difference is observed between the CIP-silica/PU composites and the original sample, E1 and E2. After one week, only slight amount of rust is observed on one side (F1), and the other side (F2) seems not affected including at the edge. This observation further confirms the protection of the silica shell against corrosion.

Figure 28:
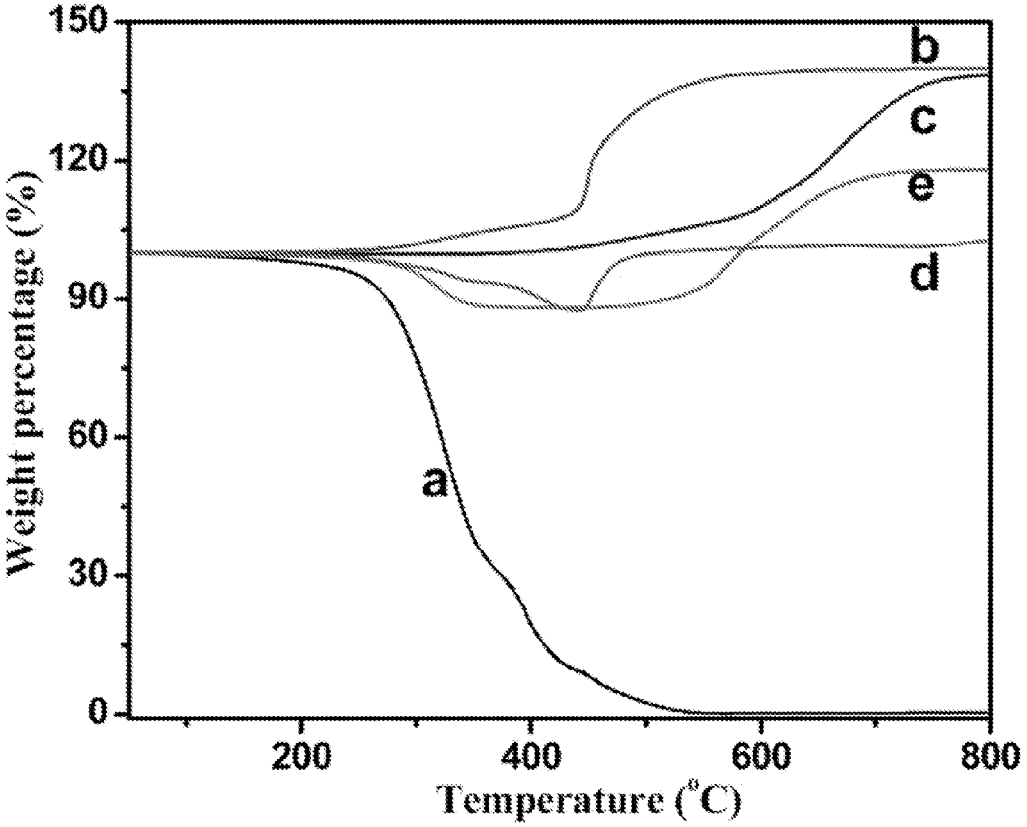
FIG. 28 shows TGA curves of (a) pure PU, (b) CIP, (c) CIP-silica, (d) 88 wt % CIP/PU composites, and (e) 88 wt % CIP-silica/PU composites.

The thermal stability of pure PU, CIP, and CIP-silica as well as their polyurethane composites is shown in FIG. 28. The cured pure PU (curve (a)) begins to decompose at around 250° C. and burns out at 550° C. All the particles exhibit a significant weight increase in the final stage owing to the oxidation in air at elevated temperatures. The CIP (curve (b)) begins to increase its weight at around 200° C. After coating with a silica shell, the CIP are protected and the oxidation process starts at about 360° C., which is higher than that of the bare CIP and the complete oxidation is delayed to 650° C. The final weight of CIP (curve (b)) and CIP-silica (curve (c)) is ~1.4 times larger than that of the original weight, which indicates a transition from pure Fe to $Fe_2O_3$. After introducing CIP into the PU matrix, the thermal stability of the composites is enhanced in different scales. Generally, composites filled with CIP and CIP-silica show higher thermal stability than that of pure PU as evidenced by the onset degradation temperature (PU: 270.6° C., CIP/PU: 316.3° C., and CIP-silica/PU: 294.4° C.). The similar weight increase induced by iron oxidation is also observed in all the composites. As companied with the decomposition of PU, the curve is more complicated within the temperature range of 300-500° C. It is interesting to observe that the weight increase is higher for the CIP-silica/PU composites (curve (e)) than that of the CIP/PU composites (curve (d)), which is due to the slight oxidation of CIP during the composite fabrication.

Figure 29:
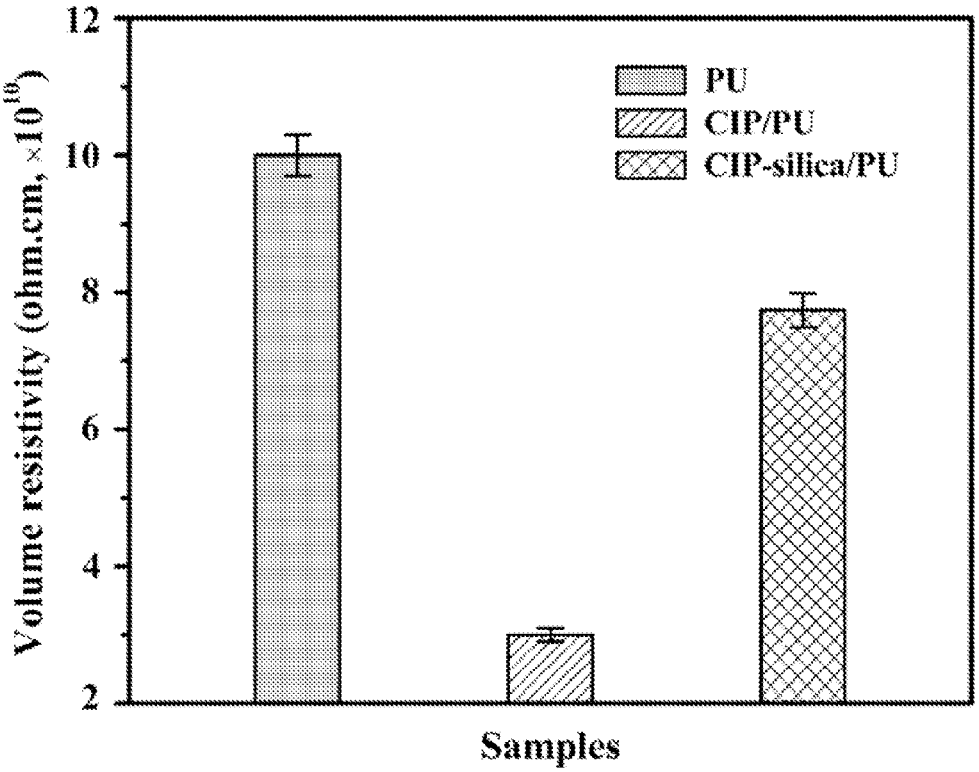
FIG. 29 shows volume resistivity of (a) pure PU, and 88 wt % (b) CIP and (c) CIP-silica polyurethane composites.

FIG. 29 shows volume resistivity of pure PU and the composites filled with 88 wt % CIP and CIP-silica, respectively. Pure PU shows a volume resistivity around $10^{11}$ ohm·cm, which is in good agreement with the other reported value.[42] It is interesting to observe that the composites filled with 88 wt % (~50 vol %) CIP still behave like an insulator despite a reduction in resistivity of around 70%. Comparing with the prominent geometrical models created by Kirkpatrick[43] and Zallen,[44] the required minimum touching spherical particles is 16 vol %. This value is in approximate agreement with most experimental observations that the critical volume fraction is between 5 and 20 vol % for polymer composites filled with powdery materials.[25] However, the insulating property of these composites may ascribe to the uniform polymer coating on CIP surface from a surface initialized polymerization method, which prevents the direct contact among the CIP. After coating the CIP with a silica shell (e.g., 55 nm), the corresponding composites exhibit higher volume resistance than that of the bare CIP, which is due to the insulating effect of the silica coating on the CIP surface.

Figure 30:
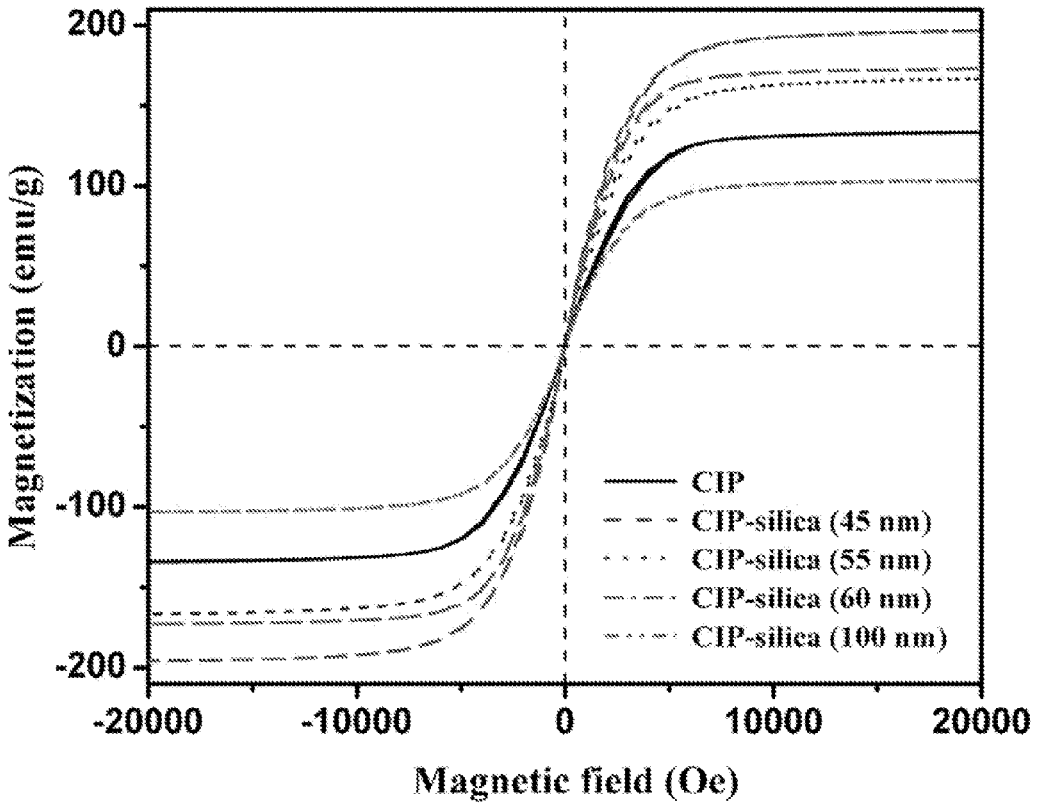
FIG. 30 shows magnetic hysteresis loops of CIP and silica-coated CIP at room temperature.

FIG. 30 shows room-temperature magnetic hysteresis loops of the as-received CIP and CIP-silica with different shell thickness. The saturation magnetization ($M_s$) is evaluated at the state when an increase in the magnetic field cannot increase the magnetization of the material further. The CIP show a $M_s$ of 125 emu/g, while an increased or decreased $M_s$ is observed in the CIP-silica coated with different silica layer thickness. The increased $M_s$ is observed with a silica layer thickness from 45 to 60 nm, which is primarily due to the annealing process under $H_2$ environment, under which iron oxide is converted to magnetically stronger iron. The particles with a silica shell thickness of 45 nm reach a $M_s$ value of about 200 emu/g. With a thicker silica layer of 55-60 nm, $M_s$ is decreased to ~170 emu/g, which is still higher than that of the as-received CIP (125 emu/g). With further increase of the shell thickness to 100 nm, a lower $M_s$ of 100 emu/g is observed. Apparently, larger silica shell thickness leads to a lower $M_s$ of the core-shell particles, which is due to the lower weight fraction of the magnetic part in the core-shell particles. The shell weight ratio in the core-shell particles with different thickness (the volume and weight fraction of the silica shell in core-shell particles) is calculated and listed in Table 2.

TABLE 2

| No. | $R_{core}$/μm | $R_{shell}$/μm | $V_{core}$/μm$^3$ | $V_{shell}$/μm$^3$ | $V_{shell}/V_{core\text{-}shell}$ | $W_{shell}/W_{core\text{-}shell}$ |
|---|---|---|---|---|---|---|
| 1 | 1 | 0.045 | 4.19 | 0.59 | 0.12 | 0.045 |
| 2 | 1 | 0.055 | 4.19 | 0.73 | 0.15 | 0.055 |
| 3 | 1 | 0.060 | 4.19 | 0.80 | 0.16 | 0.060 |
| 4 | 1 | 0.100 | 4.19 | 0.39 | 0.25 | 0.099 |

Density data used for calculation: $\rho_{core}$ = 7.87 g/cm$^3$, $\rho_{shell}$ = 2.63 g/cm$^3$.

From the table, the weight ratio of the silica shell increased from 4.5% to 9.9% with increasing shell thickness from 45 nm to 100 nm. Theoretically, the maximum reduction in $M_s$ is 9.9% from CIP to CIP-silica (100 nm) excluding any other possibilities affecting the M. However, the magnetization is reduced 20% (from 125 to 100 emu/g), which is consistent with the formed nonmagnetic $Fe_2SiO_4$ and antiferromagnetic oxide layers surrounding the Fe metallic core.[41] During the coating process, the thick silica shell could serve as a barrier that prevents hydrogen from reducing the iron oxides on CIP surface. It is interesting to observe that CIP-silica (60 nm) could exhibit higher $M_s$ than that of CIP-silica (55 nm), which may be due to the rougher shell structure (using gelatin as primer), which favors the $H_2$ diffusion. The coercivity ($H_c$, Oe) is the applied external magnetic field that is required to return the material to a zero magnetization. The remnant magnetization ($M_r$) is the residual magnetization after the applied field is reduced to zero. Both values are negligible in all the samples, which indicate a superparamagnetic state of each sample.

Figure 31:
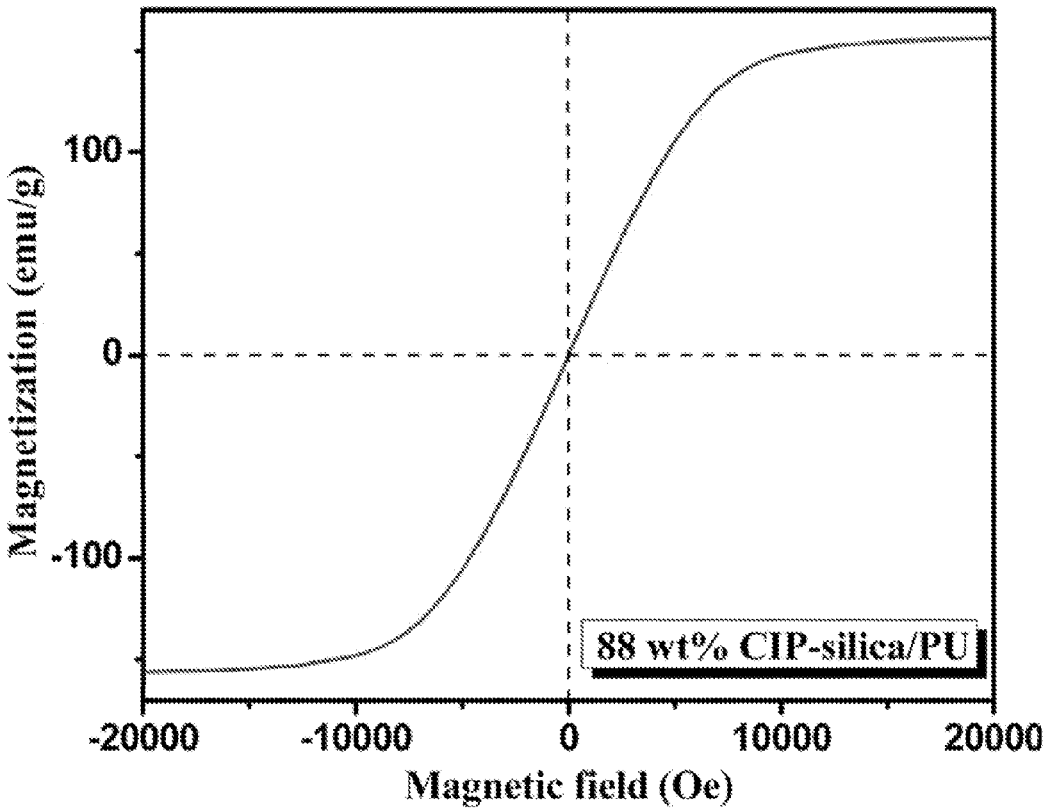
FIG. 31 shows hysteresis loops of PNCs filled CIP-silica.

FIG. 31 shows the magnetic hysteresis loops of the PU composites filled with 88 wt % CIP-silica. The composites exhibit an $M_s$ of 156 emu/g. Like the CIP and CIP-silica, the sample exhibits negligible coercivity and remnant magnetization, which correspond to a superparamagnetic behavior.

Figure 32:
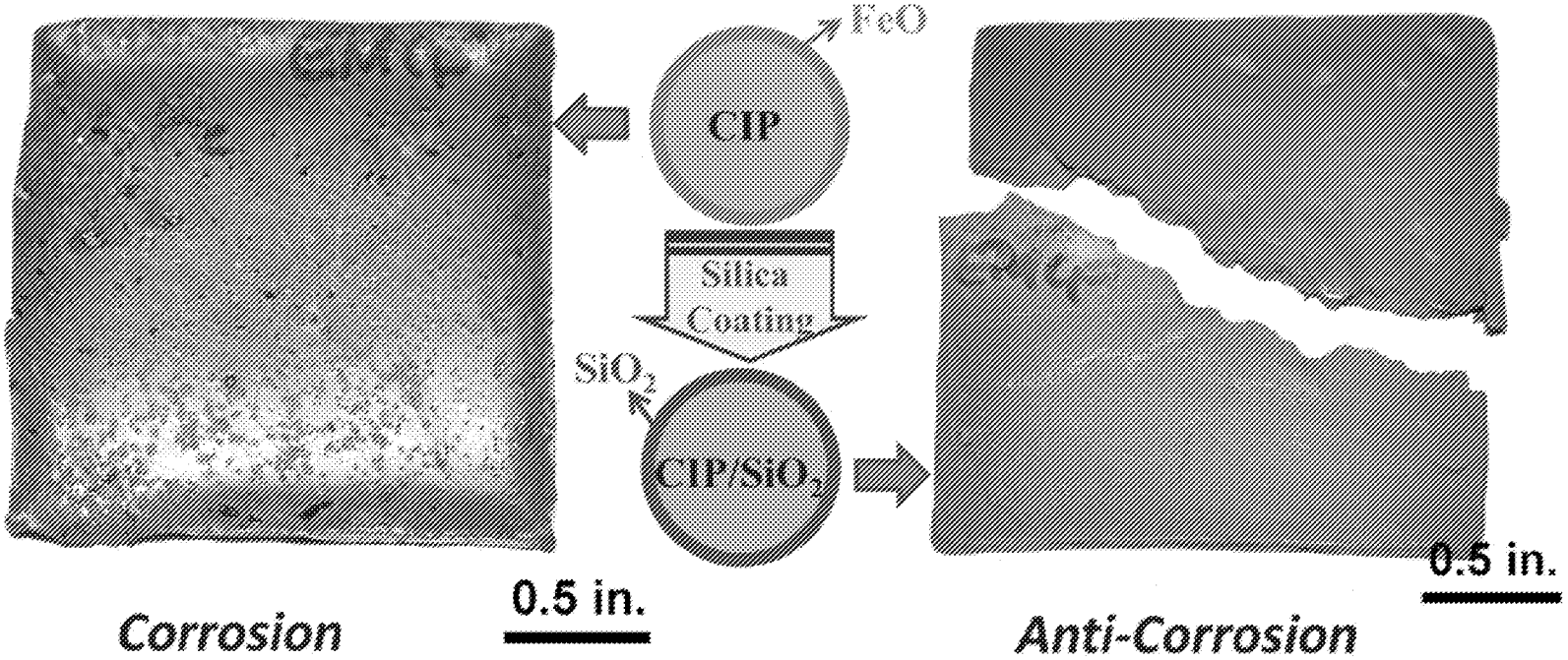
FIG. 32 shows fluorescent silica shell stabilized magnetic iron particles exhibiting super stability against oxidation and processed into polyurethane nanocomposites.
Figure 33:
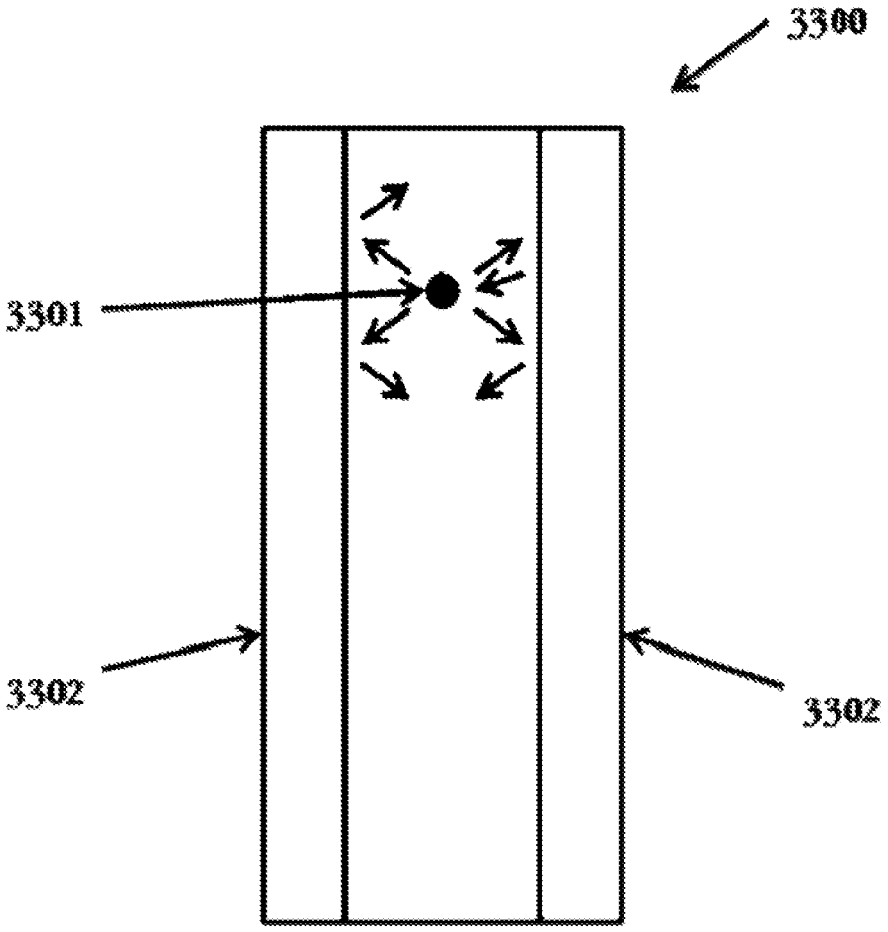
FIG. 33 shows an embodiment of the present invention for EM shielding.

Based on the foregoing disclosure, fluorescent CIP-silica particles may be prepared using a modified Stöber process. The silica shell thickness may be controlled by the ratio of TEOS and ammonia, which can be adjusted from approximately 45 nm to 100 nm. As shown in FIG. 32, the silica-coated CIP are more thermally and chemically stable based on the results from TGA and acid corrosive test. The $M_s$ of the CIP-silica is higher than that of CIP, which is due to the reduction of iron oxide to iron under a hydrogen atmosphere. Polyurethane composites filled with CIP and CIP-silica using the SIP method exhibit a strong interfacial interaction between the two phases as evidenced by the enhanced thermal stability over that of pure PU. The CIP-silica/PU composites show much higher corrosion resistivity than CIP/PU after one week salt fog test. The insulating silica layer on the magnetic particle surface improves the resistivity of the polymer composites and introduces the unique fluorescence to these hybrid magnetic core particles.

Figure 35:
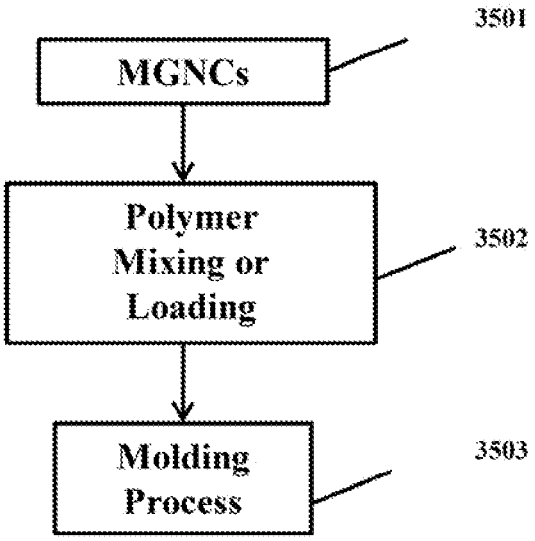
FIG. 35 shows a process for mixing embodiments of the present invention with a polymer.

Referring to FIG. 35, the various embodiments of the present invention disclosed herein may be mixed with a polymer or loaded into a polymer matrix. For example, the MGNCs 3501 may be mixed with a polymer or loaded into a polymer matrix in step 3502, and then the composite material molded to a desired form with typical molding processes in step 3503.

REFERENCES

1 L. Babes, B. Denizot, G. Tanguy, J. J. Le Jeune and P. Jallet, J. Colloid Interface Sci., 1999, 212, 474.

2 A. Truchaud, B. Capolaghi, J. P. Yvert, Y. Gourmelin, G. Glikmanas and M. Bogard, Pure Appl. Chem., 1991, 63, 1123.
3 Z. Lu, M. D. Prouty, Z. Guo, V. O. Golub, C. S. S. R. Kumar and Y. M. Lvov, Langmuir, 2005, 21, 2042.
4 K. E. McCloskey, J. J. Chalmers and M. Zborowski, Anal. Chem., 2003, 75, 6868.
5 S. Miltenyi, W. Müller, W. Weichel and A. Radbruch, Cytometry, 1990, 11, 231.
6 D. Zhang, S. Wei, C. Kaila, X. Su, J. Wu, A. B. Karki, D. P. Young and Z. Guo, Nanoscale, 2010, 2, 917.
7 S. Wei, Q. Wang, J. Zhu, L. Sun, H. Lin and Z. Guo, Nanoscale, 2011, in press, DOI: 10.1039/C1031NR11000D.
8 X.-C. Sun and N. Nava, Nano Lett., 2002, 2, 765.
9 J. Zhu, S. Wei, Y. Li, S. Pallavkar, H. Lin, N. Haldolaarachchige, Z. Luo, D. P. Young and Z. Guo, J. Mat. Chem., 2011, 21, 16239.
10 Z. Guo, M. Moldovan, D. P. Young, L. L. Henry and E. J. Podlaha, Electrochem. Solid State Let, 2007, 10, E31.
11 D. Zhang, R. Chung, A. B. Karki, F. Ti D. P. Young and Z. Guo, J. Phys. Chem. C, 2009, 114, 212.
12 J. Zhu, S. Wei, N. Haldolaarachchige, D. P. Young and Z. Guo, J. Phys. Chem. C, 2011, 115, 15304.
13 J. Guo, W. Yang, C. Wang, J. He and J. Chen, Chem. Mater., 2006, 18, 5554.
14 J. Kim, H. S. Kim, N. Lee, T. Kim, H. Kim, T. Yu, I. C. Song, W. K. Moon and T. Hyeon, Angew. Chem. Int. Ed., 2008, 120, 8566.
15 P. R. Krauss and S. Y. Chou, Appl. Phys. Lett., 1997, 71, 3174
16 W. Stöber, A. Fink and E. Bohn, J. Colloid Interface Sci., 1968, 26, 62.
17 A. M. Homola and S. L. Rice, U.S. Pat. No. 4,280,918 1981.
18 M. Ohmori and E. Matijevic, J. Colloid Interface Sci., 1992, 150, 594.
19 R. I. Nooney, D. Thirunavukkarasu, Y. Chen, R. Josephs and A. E. Ostafin, Langmuir, 2003, 19, 7628.
20 Y. Yin, Y. Lu, Y. Sun and Y. Xia, Nano Lett., 2002, 2, 427.
21 G. Wang and A. Harrison, J. Colloid Interface Sci., 1999, 217, 203.
22 W. Fu, H. Yang, B. Hari, S. Liu, M. Li and G. Zou, Mater. Chem. Phys., 2006, 100, 246.
23 Y. Lu, Y. Yin, B. T. Mayers and Y. Xia, Nano Lett., 2002, 2, 183.
24 J. Zhu, S. Wei, J. Ryu, M. Budhathoki, G. Liang and Z. Guo, J. Mater. Chem., 2010, 20, 4937.
25 J. Zhu, S. Wei, J. Ryu, L. Sun, Z. Luo and Z. Guo, ACS Appl. Mater. Interfaces, 2010, 2, 2100.
26 J. Zhu, S. Wei, M. Alexander, Jr., T. D. Dang, T. C. Ho and Z. Guo, Adv. Funct. Mater., 2010, 20, 3076.
27 Z. Guo, S. E. Lee, H. Kim, S. Park, H. T. Hahn, A. B. Karki and D. P. Young, Acta Mater., 2009, 57, 267.
28 J. Klánová, P. Eupr, J. Kohoutek and T. Harner, Environ. Sci. Technol., 2007, 42, 550.
29 W. M. Huang, B. Yang, Y. Zhao and Z. Ding, J. Mater. Chem., 2010, 20, 3367.
30 Z. Guo, T. Y. Kim, K. Lei, T. Pereira, J. G. Sugar and H. T. Hahn, Compos. Sci. Technol., 2008, 68, 164.
31 Z. Guo, S. Park, H. T. Hahn, S. Wei, M. Moldovan, A. B. Karki and D. P. Young, Appl. Phys. Lett., 2007, 90, 053111.
32 Z. Guo, S. Park, H. T. Hahn, S. Wei, M. Moldovan, A. B. Karki and D. P. Young, J. Appl. Phys., 2007, 10, 09M511
33 J.-M. Hu, J.-T. Zhang, J.-Q. Zhang and C.-N. Cao, Corros. Sci., 2005, 47, 2607.
34 G. Paliwoda-Porehska, M. Stratmann, M. Rohwerder, K. Potje-Kamloth, Y. Lu, A. Z. Pich and H. J. Adler, Corros. Sci., 2005, 47, 3216.
35 I. Pastoriza-Santos, J. Pérez-Juste and L. M. Liz-Marzán, Chem. Mater., 2006, 18, 2465.
36 F. G. Aliev, M. A. Correa-Duarte, A. Mamedov, J. W. Ostrander, M. Giersig, L. M. Liz-Marzán and N. A. Kotov, Adv. Mater., 1999, 11, 1006.
37 V. Yong and H. T. Hahn, J. Mater, Res., 2009, 24, 1553.
38 H. Hu, Z. Wang, L. Pan, S. Zhao and S. Zhu, J. Phys. Chem. C, 2010, 114, 7738.
39 Y. Chen and J. O. Iroh, Chem. Mater., 1999, 11, 1218.
40 D. Y. kong, M. Yu, C. K. Lin, X. M. Liu, J. lin and J. Fang, J. Electrochem. Sci., 2005, 152, H146.
41 P. Tartaj and C. J. Serna, J. Am. Chem. Soc., 2003, 125, 15754.
42 H. Kim, Y. Miura and C. W. Macosko, Chem. Mater., 2010, 22, 3441.
43 S. Kirkpatrick, Rev. Mod. Phys., 1973, 45, 574.
44 R. Zallen, The Physics of Amorphous Solids, 1983, New York: Wiley.

What is claimed is:

1. A method for forming magnetic graphene composites comprising: adhering iron particles on a graphene substrate; and forming at least one shell on the iron particles subsequent to the iron particles being adhered to the graphene substrate, wherein the at least one shell comprises silicon and sulfur.

2. The method as recited in claim 1, wherein the iron particles comprise iron nanoparticles.

3. The method as recited in claim 2, wherein the iron nanoparticles comprise an iron oxide layer.

4. The method as recited in claim 3, wherein the shell comprising silicon and sulfur surrounds the iron nanoparticles comprising the iron oxide layer.

5. The method as recited in claim 4, wherein the forming of the at least one shell is performed with an annealing process.

6. The method of claim 5, wherein the annealing process is performed at approximately 500° C. in an $H_2$/Ar atmosphere.

7. The method as recited in claim 1, further comprising mixing the magnetic graphene composites with a polymer.

8. The method as recited in claim 1, wherein the magnetic graphene composites comprise double shell iron particles decorated on the graphene substrate, wherein the double shell iron particles comprise a crystalline iron core, an inner iron oxide layer around the crystalline iron core, and an outermost amorphous Si—S—O compound shell around the iron oxide layer.

9. The method as recited in claim 1, further comprising loading the magnetic graphene composites in a polymer matrix.

10. A method for forming magnetic graphene composites comprising:

adhering iron nanoparticles on a graphene substrate; and forming at least one shell on the iron particles subsequent to the iron nanoparticles being adhered to the graphene substrate, wherein the at least one shell comprises silica.

11. The method as recited in claim 10, wherein the forming of the at least one shell is performed with an annealing process.

12. The method as recited in claim 10, further comprising mixing the magnetic graphene composites with a polymer.

13. The method as recited in claim 10, further comprising loading the magnetic graphene composites in a polymer matrix.

14. The method as recited in claim 10, wherein the at least one shell comprises sulfur.

15. The method as recited in claim 14, wherein the iron nanoparticles comprise an iron oxide layer.

16. The method as recited in claim 15, wherein the shell comprising silica and sulfur surrounds the iron nanoparticles comprising tile iron oxide layer.

17. The method as recited in claim 14, wherein the magnetic graphene composites comprise double shell iron nanoparticles decorated on the graphene substrate, wherein the double shell iron nanoparticles comprise a crystalline iron core, an inner iron oxide layer around the crystalline iron core, and an outermost amorphous Si—S—O compound shell around the iron oxide layer.

* * * * *